United States Patent [19]

Richardson

[11] Patent Number: 4,848,771

[45] Date of Patent: Jul. 18, 1989

[54] GAMING SYSTEM WITH SESSION MASTER AND GAMING BOARDS

[75] Inventor: John Richardson, San Diego, Calif.

[73] Assignee: Selectro-Vision, Ltd., San Diego, Calif.

[21] Appl. No.: 820,521

[22] Filed: Jan. 16, 1986

[51] Int. Cl.[4] ..... A63F 3/06

[52] U.S. Cl. ..... 273/237; 273/269

[58] Field of Search ..... 273/269, 1 E, 237, 138 A; 340/323 R; 364/410–412

[56] References Cited

U.S. PATENT DOCUMENTS

| | | | |
|---|---|---|---|
| Re. 32,480 | 10/1984 | Bolan | 364/410 |
| 4,365,810 | 12/1982 | Richardson | 273/269 |
| 4,475,157 | 10/1984 | Bolan | 364/410 |
| 4,475,157 | 10/1984 | Bolan | 273/237 |
| 4,624,462 | 11/1986 | Itkis | 273/269 |
| 4,651,995 | 3/1987 | Henkel | 273/269 |

*Primary Examiner*—Maryann Lastova
*Attorney, Agent, or Firm*—Fitch, Even, Tabin & Flannery

[57] ABSTRACT

An automatic gaming system for games of chance, such as BINGO or the like, is disclosed comprising a system base station, a plurality of electronic gaming boards, and a plurality of validation units. The electronic gaming boards are initialized by the system base station with a complex gaming schedule developed by the system operator. The system base station includes an interactive program to create a complex gaming schedule having completely arbitrary win patterns, multiple levels of payouts, and multiple place win combinations. The system base station further loads each gaming card with data representing a variable time interval which causes all of the boards to enter the play mode at the same time. The validation units are initialized by the system base station with a validation code which is used when checking a win claim of an electronic card. The validation units store audit information gained during the validation of win claims and upload that stored information to the system base station at the end of a gaming session. The system base station further includes a program to command the electronic gaming boards and validation units to turn off or on.

35 Claims, 8 Drawing Sheets

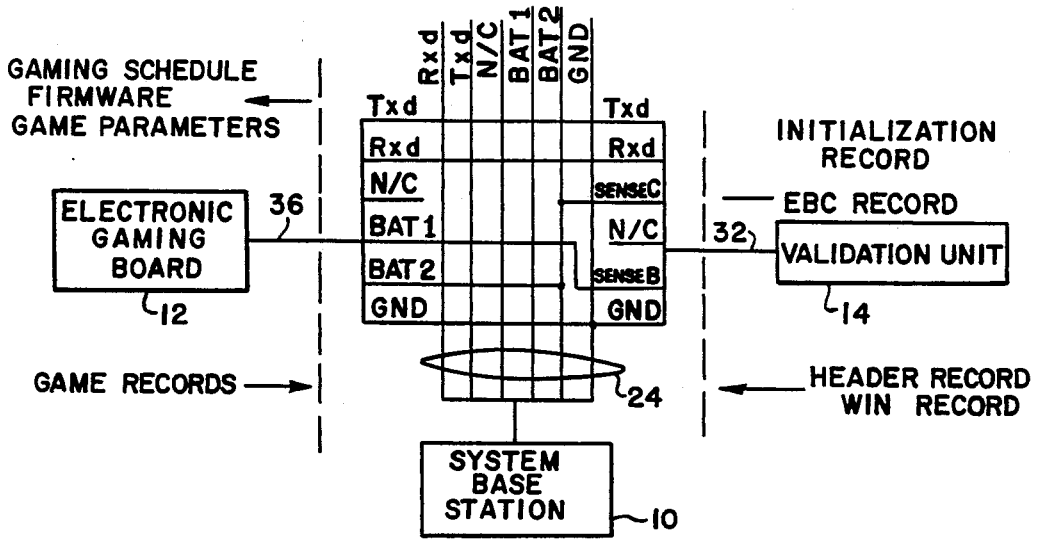

FIG. 8

INITIALIZATION RECORD (DOWNLOAD)

| |
|---|
| ASSIGNMENT CODE 8 BYTES |
| VALIDATION CODE 16 BYTES |

FIG. 9A

HEADER RECORD (UPLOAD)

| |
|---|
| NO. OF RECORDS 3 BYTES |
| NULLS 4 BYTES |
| VU SERIAL NO. 8 BYTES |

FIG. 9B

WIN RECORD (UPLOAD)

| | |
|---|---|
| PLACE | CARD |
| WIN PATTERN | |
| GAME | LEVEL |
| EBC SERIAL NO. 8 BYTES | |

FIG. 9C

EBC RECORD (UPLOAD)

| |
|---|
| FREE SPACE |
| BAR LINE |
| CARD NUM |
| PATTERN NO. |
| GAME NO. |
| LEVEL NO. |
| EBC SERIAL NO. 8 BYTES |
| VALIDATION CODE 16 BYTES |
| REGULAR CARD |
| SPECIAL CARD |
| INSTANT BINGOS |
| CHECK BYTE |

FIG. 9D

******** PLAYER RECEIPT ********

| ITEM | QTY | AMT |
|---|---|---|
| REGULAR CARDS | 10 | $20.00 |
| SPECIAL CARDS | 6 | $18.00 |
| | TOTAL | $38.00 |
| | CASH IN | $40.00 |
| | CHANGE | $2.00 |

THANK YOU FOR PLAYING BINGO... GOOD LUCK

CARD (S) SERIAL NUMBER SN007

FIG. 11

SUMMARY REPORT FOR BINGO SESSION

BINGO SALES

| | |
|---|---|
| NO. OF CUSTOMER | 1 |
| TOTAL REGULAR CARDS SOLD | 10 |
| TOTAL SPECIAL CARDS SOLD | 6 |
| TOTAL INSTANT BINGO CARDS SOLD | 0 |
| TOTAL BINGO SALES | $38.00 |

OTHER SALES

| | |
|---|---|
| NO. OF SALES | 0 |
| TOTAL AMOUNT | $0.00 |
| TOTAL SALES | $38.00 |

PAYOUTS

| | |
|---|---|
| TOTAL BINGO PAYOUT AMOUNT | $200.00 |
| TOTAL BONUSES PAID | $0.00 |
| TOTAL OTHER PAYOUTS | $0.00 |
| TOTAL REFUNDS | $0.00 |
| TOTAL PAYOUTS | $200.00 |

NET INCOME/LOSS ( $162.00 )

FIG. 12

******** BINGO PRICES ********

DISCOUNT PERCENTAGE 50%

| | |
|---|---|
| PRICE FOR MINIMUM SALE | $10.00 |
| UNIT PRICE FOR REGULAR CARDS | $2.00 |
| UNIT PRICE FOR SPECIAL CARDS | $3.00 |

FIG. 13

******** INSTANT BINGO DATA ********

1 FOR $1.00 OR 6 FOR $5.00

INSTANT BINGO FORMAT: REGULAR BINGO
NO. OF PUSHES FOR WIN: 13
PAYOUT AMOUNT: $5.00

FIG. 14

******** PACKAGE DEAL DATA ********

TOTAL NUMBER OF PACKAGE DEALS 5

| | |
|---|---|
| **PACKAGE DEAL NO. 1** | |
| REGULAR CARDS | 8 |
| SPECIAL CARDS | 4 |
| INSTANT BINGO | 6 |
| PRICE | $13.00 |
| **PACKAGE DEAL NO. 2** | |
| REGULAR CARDS | 8 |
| SPECIAL CARDS | 6 |
| INSTANT BINGO | 6 |
| PRICE | $15.00 |
| **PACKAGE DEAL NO. 3** | |
| REGULAR CARDS | 10 |
| SPECIAL CARDS | 8 |
| INSTANT BINGO | 12 |
| PRICE | $16.50 |
| **PACKAGE DEAL NO. 4** | |
| REGULAR CARDS | 16 |
| SPECIAL CARDS | 8 |
| INSTANT BINGO | 12 |
| PRICE | $27.50 |
| **PACKAGE DEAL NO. 5** | |
| REGULAR CARDS | 20 |
| SPECIAL CARDS | 12 |
| INSTANT BINGO | 12 |
| PRICE | $35.00 |

FIG. 15

******** FORMAT LIBRARY ****

| NUMBER | NAME | PATTERN VALUE |
|---|---|---|
| 1 | REGULAR BINGO | 12 |
| 2 | REG. INCL 4 CORS | 13 |
| 3 | P. 1 LAYER CAKE | 3 |
| 4 | P. 2 LAYER CAKE | 3 |
| 5 | FULL LAYER CAKE | 1 |
| 6 | P. 1 OUTSIDE SQ. | 4 |
| 7 | P. 2 OUTSIDE SQ. | 6 |
| 8 | P. 3 OUTSIDE SQ. | 4 |
| 9 | FULL OUTSIDE SQ. | 1 |
| 10 | INSIDE SQUARE | 1 |
| 11 | COVER ALL BLKOUT | 1 |
| 12 | P. 1 RAIL. TRACKS | 2 |
| 13 | RAILROAD TRACKS | 1 |
| 14 | 5 NUMBER BINGO | 8 |
| 15 | 9 IN A SQUARE | 9 |
| 16 | CRAZY KITE | 4 |
| 17 | STAMPS DIAGONAL | 2 |
| 18 | CUPID'S ARROW | 1 |
| 19 | CRAZY LETTER "E" | 4 |
| 20 | CRAZY LETTER "F" | 6 |
| 21 | CRAZY LETTER "H" | 2 |
| 22 | CRAZY LETTER "L" | 4 |
| 23 | CRAZY LETTER "S" | 2 |
| 24 | CRAZY LETTER "T" | 4 |
| 25 | LETTER "X" | 1 |
| 26 | CRAZY LETTER "Z" | 2 |
| 27 | NUMBER 7 | 1 |
| 28 | LARGE DIAMOND | 1 |
| 29 | SML DIA OR CROSS | 1 |
| 30 | SMALL CROSS/4 COR | 1 |
| 31 | BRACKET | 1 |
| 32 | H I | 1 |
| 33 | LARGE CROSS | 1 |
| 34 | HOUR GLASS | 1 |
| 35 | HOUSE | 1 |
| 36 | DOUBLE CROSS | 1 |
| 37 | SNOWFLAKE | 1 |
| 38 | TREETOP | 1 |
| 39 | LORRAINE CROSS | 1 |
| 40 | TEST | 1 |
| 41 | CHECKERBOARD | 1 |
| 42 | CRAZY LETTER 'S' | 2 |
| 43 | ********** | |
| 44 | ********** | |
| 45 | ********** | |

FIG. 16

********** GAME FORMAT

| NUMBER | NAME | PATTERNS |
|---|---|---|
| 43 | LETTER J | 1 |

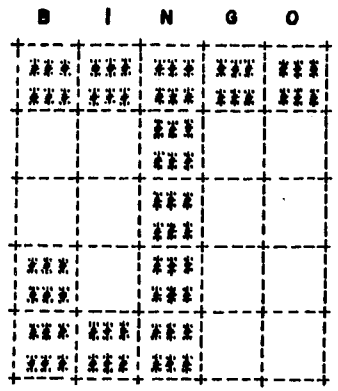

FIG. 17

******** GAME SCHEDULE DATA ********

| R/S | GAM | LEV | FORMAT NAME | PAYOUTS | |
|---|---|---|---|---|---|
| R | 1 | 1 | REGULAR BINGO | 1 | 200.00 |
| | | | | 2 | 50.00 |
| S | 2 | 1 | LETTER "X" | 1 | 150.00 |
| | | | | 2 | 50.00 |
| R | 3 | 1 | P. 1 OUTSIDE SQ. | 1 | 20.00 |
| R | 3 | 2 | P. 2 OUTSIDE SQ. | 1 | 30.00 |
| R | 3 | 3 | P. 3 OUTSIDE SQ. | 1 | 40.00 |
| R | 3 | 4 | FULL OUTSIDE SQ. | 1 | 150.00 |
| R | 4 | 1 | REGULAR BINGO | 1 | 50.00 |
| R | 4 | 2 | COVER ALL BLKOUT | 1 | 150.00 |
| | | | | 2 | 50.00 |
| R | 5 | 1 | 5 NUMBER BINGO | 1 | 150.00 |
| | | | | 2 | 75.00 |
| S | 6 | 1 | STAMPS DIAGONAL | 1 | 200.00 |
| | | | | 2 | 50.00 |
| R | 7 | 1 | REG. INCL 4 CORS | 1 | 150.00 |
| | | | | 2 | 50.00 |
| R | 8 | 1 | SMALL CROSS/4 COR | 1 | 125.00 |
| | | | | 2 | 75.00 |
| R | 9 | 1 | CRAZY LETTER "T" | 1 | 200.00 |
| | | | | 2 | 50.00 |
| S | 10 | 1 | COVER ALL BLKOUT | 1 | 250.00 |
| R | 11 | 1 | REGULAR BINGO | 1 | 175.00 |
| | | | | 2 | 50.00 |
| R | 12 | 1 | 9 IN A SQUARE | 1 | 200.00 |
| | | | | 2 | 50.00 |
| S | 13 | 1 | LARGE DIAMOND | 1 | 200.00 |
| | | | | 2 | 50.00 |
| S | 14 | 1 | COVER ALL BLKOUT | 1 | 200.00 |
| | | | | 2 | 50.00 |

FIG. 18

GAMING SYSTEM WITH SESSION MASTER AND GAMING BOARDS

The invention pertains generally to games of chance, such as bingo and the like, and is more particularly directed to automatic gaming systems including an interactive system base station and a plurality of electronic gaming boards. Further, the invention is directed to such automatic gaming systems including a plurality of validation units with which to validate win claims for the electronic gaming boards.

In bingo and similar games of chance the basic elements of the game are a gaming board and a random number generating device. The gaming board can be a square array of numbers, usually a 5×5 array, with the centermost location being blank or termed a "free space". The game is generally played with either 75 or 90 numbers. Each column in the array is limited to only one-fifth of the numbers, e.g., the first column numbers are taken from the group 1 to 15 in the event 75 numbers are used, and 1 to 18 if 90 numbers are used; the second column numbers are taken from the group 16 to 30 or 19 to 36, and so on. Further, duplicate numbers cannot appear on a gaming card.

When the game is being played, the game operator specifies a shape or pattern to be formed on the gaming card by randomly drawn numbers and then proceeds to call numbers at random between 1 and 75, or 1 and 90, whichever is appropriate. If a number called coincides with one on a player's board, the player marks the number in some fashion on his board. The object of the game is to be the first player to have a set of randomly-called numbers coincide with the marked numbers on the player's board so as to form the specified shape or pattern.

The specified shape or pattern may be an X, T, L, a diagonal line, and five numbers horizontally or vertically, and so on. Several of these games, usually between twelve and eighteen, constitute a bingo program or session which is played during the course of an evening over several hours. The games are played consecutively and essentially without any major interruption except possibly for intermissions.

These games have long been played with boards which have a fixed printed numerical array. Players select from a large number of boards and, therefore, are unable to create and play an array of their own choosing and determination. While some games have been played with blank paper boards that are filled in with numbers of the player's own choosing, the cards are limited in size and can essentially be used only once since the player marks out the numbers called with an ink dauber or like means. This type of random array selection results in an inefficiency of operation for playing consecutive games on a minimum interruption basis.

This inefficiency affects not only the game operator, who must find and check a copy of the marked paper boards which are collected to avoid an unauthorized change in the numbers once the game has started, but also the player, who must prepare a new board prior to each game. These actions require time and detract from the desired even, and essentially uninterrupted, flow of a successful bingo program. It is mainly for these reasons that the blank board approach has been used only for single games and then generally only for the first game of the bingo program.

Another important factor is to provide a gaming board which cannot be changed without the knowledge of the game operator, which provides an indication that it was acquired for use in the particular program being conducted, and which can be checked quickly in the event it displays a winning combination. Furthermore, during a typical bingo program, the shape of the winning array generally varies from one game to the next. Therefore, it is desirable for the player to have the shape of a winning array promptly displayed on his board and, additionally, to be provided with an automatic indication of when a match for that array has been achieved.

Recently, electronic gaming boards have been developed which permit a player to select his own numbers and to display the shape of a winning array. These boards signal the player when a winning array has been achieved on his board. An electronic gaming board of this type is more fully described in U.S. Pat. No. 4,365,810 issued in the name of John Richardson on Dec. 28, 1982. Other advantageous electronic gaming systems are disclosed in copending application U.S. Ser. No. 441,771, filed Jan. 17, 1986, entitled, "Multiple Gaming Board" filed in the name of John Richardson, now U.S. Pat. No. 4,798,387 issued Jan. 17, 1989. The disclosures of Richardson are hereby expressly incorporated by reference.

Even with the improvement in game play brought about by electronic gaming boards, the play during a bingo gaming session has become much more complex. More and different types of games are played today than just the five across, up or down of traditional bingo. Specialized win patterns for each game are becoming commonplace, and it would be impractical to provide a select switch for every possible pattern. Additionally, the gaming schedules are complicated by playing either regular cards or special cards for a particular game. It is necessary for a player to recognize and determine which type of card and game is being played for a particular gaming schedule.

Moreover, even in a single game there may be multiple win patterns or levels that build to a final payoff. For example, the final win pattern may be three completely filled horizontal bars comprising the first, third, and fifth rows of a card. The first level win pattern may be the fifth row, the second level win pattern may be the first and fifth rows, and the third level win pattern may be the first, third and fifth rows. The final payoff is given to the first player to totally fill all three bars. It is difficult with presently configured electronic gaming boards to play different game levels conveniently. These complex schedules become even more difficult to play when considering that many players will desire multiple cards or boards.

Moreover, many bingo gaming sessions today offer place payouts where there is a declining amount for a sequence of wins. The first person matching a particular pattern receives a substantial first prize, a lesser amount is awarded to the second person matching the same pattern, a still lesser amount is paid to the third person matching the same pattern, and so on. These place-type games are also more difficult to play on presently configured electronic gaming boards.

One of the more popular pastimes during intermission at a bingo gaming session is "instant" or "break open" bingo. While this game can be played in a variety of different ways and on different types of cards, the principle of the game is essentially the same. The players purchase cards where all the numbers are covered by pull tabs and no caller is involved. The player simply peels off or breaks open the tab and if the card contains B, I, N, G, O in any order or rotation, it is scored as a win. Because prior-art electronic gaming boards cannot be used to play this game, an operator is required to use two different types of cards and to employ more people to sell these instant cards.

For security reasons, the above-referenced electronic gaming boards of Richardson use a timer which, after a predetermined amount of time has elapsed, locks out the board from play if the purchased card(s) have not been filled. While accomplishing its security purpose, this operation for an electronic gaming board causes the gaming session to be somewhat more inflexible than is necessary. For example, if every gaming board is set for a predetermined time, then no gaming cards can be sold within that interval before starting the game or the session cannot begin on time. These predetermined time periods, if fixed for all the boards, make it difficult to buy cards between games or a gaming session or at intermission. Moreover, there are players who do not want to choose their own numbers and consider it an imposition to have to fill out a gaming card on an electronic board. Further, an operator must make some provision for those players who have already paid for cards, but because the time for filling in the cards has elapsed, will not play in a particular game or gaming session.

An electronic gaming board as described in copending application Ser. No. 820,448, entitled "Gaming Board With Instant Win Feature" filed in the name of John Richardson, now U.S. Pat. No. 4,747,600, issued May 31, 1988 provides for the storage of a complex gaming schedule therein to produce arbitrary win patterns with multiple level and place formats. These electronic gaming boards have produced a need for a means by which the gaming operator can easily program a large number of the boards in a rapid manner with a completely arbitrary gaming schedule. The gaming operator further needs a means to assist him in formulating the complex gaming schedule from one gaming session to the next.

Another problem which confronts the operator when using electronic gaming boards, or even regular paper cards, is the lack of available auditing procedures. Because a winning player is paid in cash at the time of this win, if some inconsistency develops either in the amount paid for one game or the total amount paid over all the games, there is no practical means for correcting the error.

An electronic validation unit as described in copending application Ser. No. 820,245, entitled 'Portable Validation Unit for Gaming System,' filed in the name of John Richardson, provides for the operation of validating win claims for electronic gaming boards, such as those described immediately above, and for accumulating an audit record of the win claim. These validation units have produced a need for a means by which the gaming operator can easily program the units to validate the wins of a complex gaming schedule and to assemble the separate audit information from each validation unit into an integrated audit record for the entire gaming session.

Because the electronic gaming boards and validation units described above are hand-held, battery-powered apparatus, a considerable maintenance cost for such boards is changing the batteries. Generally, such hand-held, battery-powered devices have an on/off switch which connects and disconnects a battery from the circuitry such that power can be conserved during non-use. However, in a gaming session context, an operator does not want a player to be able to turn on and off an electronic gaming board, or an employee to be able to turn on and off a validation unit, for a number of reasons.

Initially, if the electronic gaming board or validation unit stores information in a random-access memory, turning off the device during the gaming session will excise this information from memory. Secondly, for security purposes as much as for power savings, the gaming operator does not want an electronic gaming board or validation unit operable until the start of the gaming session and then would prefer it to be disabled after the gaming session is complete. This type of operation would prevent unauthorized use and persons from storing or reading data from the electronic gaming board or validation unit which might effect the play of the game.

SUMMARY OF THE INVENTION

The invention solves these and other problems for a bingo gaming session, or the like, by providing an automatic gaming system comprised of a system base station and a plurality of electronic gaming boards. The system further includes, in another preferred embodiment, a plurality of validation units with which to validate the win claims for the electronic gaming boards.

The system base station is a data processing and control means which includes means for inputting information into a processor means. The processor means includes means for visually displaying data and means for communicating with either the electronic gaming boards or the validation units. Preferably, the system base station comprises a microprocessor-based disk operating system which runs an interactive application program receiving operator inputs and providing system control, communications, and auditing functions for the electronic gaming boards and the validation units.

The system base station has a number of modes by which an operator, through the input means, performs various functions for a gaming session as either the manager of the gaming session, the cashier of the gaming session, or an accountant at the end of the session developing an audit record for the complete gaming session.

In the manager mode, a complex gaming schedule can be assembled with an interactive routine which provides data for a gaming schedule. The routine provides the choice of selecting a win pattern from a format library of patterns or the choice of inputting an entirely arbitrary win pattern. From the selected win patterns, a gaming schedule is generated which is limited only by the imagination and ingenuity of the scheduler. Regular and special gaming cards, multiple win places and multiple win levels may be interspersed in an arbitrary fashion. Any time before the gaming session begins this schedule can be reformatted, deleted from, added to, etc. The manager or scheduler has complete discretion in game schedule formation and changes thereto and is provided with means for accomplishing these tasks in a facile manner.

In addition, the system, when in a manager mode, permits the selection of a validation code which is unique to the particular gaming session to be played.

The validation code will be loaded into all of the electronic gaming boards and validation units to provide a security check for the devices being played and to verify win claims during the gaming session.

The system in the manager mode also provides means to set a real-time clock and to set a starting time for a gaming session. When the electronic gaming boards are loaded with the gaming schedule, they are additionally loaded with information pertaining to the time remaining prior to the start of a game, i.e., the difference between the real time and the starting time. The players have the amount of time remaining before the start of the gaming session to load arbitrary arrays for the number of cards they have purchased before the electronic gaming boards lock out the load mode and switch to the play mode. Because the electronic gaming boards are initialized at different times, this feature permits each board to count down its own variable time interval before the starting time so that all the gaming boards will switch to the play mode together.

An aspect of the invention is using the system base station, during the cashier mode, to turn on and initialize each electronic gaming board and each validation unit by connection to a communications means.

Another aspect of the invention is using the system base station, during the accounting mode, to form an audit record of the gaming session and to upload audit information from each validation unit and then turn it off.

These and other objects, features, and aspects of the invention will become apparent upon reading the following detailed description when taken in conjunction with the attached drawings wherein:

BRIEF DESCRIPTION OF THE DRAWINGS

FIG. 8 is a block diagram view of the system base station illustrated in FIG. 1 showing its electrical connection to either an electronic gaming board or a validation unit;

FIGS. 9A–9D are pictorial representations of the data packages which are transferred between the system base station and a validation unit;

FIGS. 11–18 are pictorial representations of printouts from the various modes of the system base station illustrated in FIG. 1.

DETAILED DESCRIPTION OF THE PREFERRED EMBODIMENTS

Figure 1:
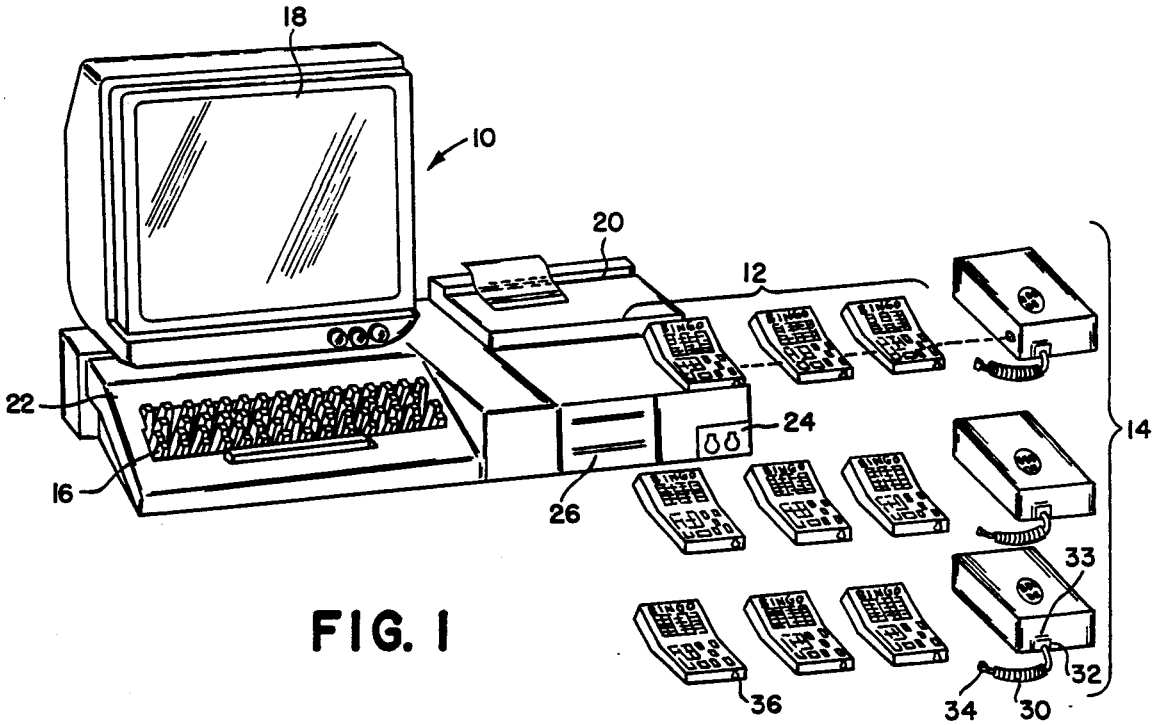
FIG. 1 is a pictorial representation of an automatic gaming system including a system base station, a plurality of electronic gaming boards, and a plurality of validation units which are constructed in accordance with the invention.

In FIG. 1 there is shown an automatic gaming system, preferably an electronic bingo system, constructed in accordance with the invention. The electronic bingo system comprises three major components including a system base station 10, a plurality of electronic bingo or gaming boards 12, and a plurality of validation units 14. The system base station 10 includes a keyboard 16, a video monitor 18, a printer 20, a computer or processor means 22, a communication cradle 24, and a dual floppy disk drive 26. The elements 10-26 are connected as a specialized data processing system.

The system base station 10 is microprocessor-controlled and functions as a system control center, a point-of-sale terminal, and an accounting or auditing center. The system base station 10 uses the communications cradle unit 24 to communicate with any of the electronic gaming boards 12 or any of the validation units 14 such that data can be transferred between the devices. The electronic gaming boards 12 are used by players in place of physical paper cards and markers which have been used traditionally in the game of bingo. A software control program is used to operate the system base station 10.

Preferably, the processor means 22 is under control of an operating system loaded into the memory of the station 10 through one drive of the dual drive 26. The software control program is then loaded from the other drive of the dual drive 26 and executed as an application program of the operating system.

In general, each electronic gaming board 12 is in turn connected through cradle 24 to the system base station 10 during an initialization step such that the board is downloaded with a gaming schedule for use in a series of games termed a gaming session. The electronic gaming boards 12 are also downloaded from the system base station 10 with an assignment code, a validation code, game parameters, and, optionally, firmware to execute. Preferably, the electronic gaming boards 12 are those having the features described in the Richardson application Ser. No. 820,448 entitled "Gaming Board with Instant Win Feature".

During a first mode, the player loads game arrays into an electronic gaming board 12 by arbitrarily selecting the symbols (numbers) which comprise each of the bingo cards he has purchased. After loading, the gaming boards 12 enter a second mode, termed "play mode", where matching the numbers selected and announced by the caller takes place. As the numbers of a game are called, the player enters them into the electronic gaming board 12 to determine if they match any numbers of one of the bingo cards contained therein. A particular game in the session is played until one or more of the electronic gaming boards 12 signals, audibly and by a visual indicator, that the game has been won. A payout is made using the validation units 14 and play is resumed until an entire gaming schedule is completed.

The validation units 14 are additionally initialized by connection to the cradle 24 of the system base station 10. The validation units 14 receive an assignment code and a validation code for a particular gaming session. When a player scores a bingo, or any other type of winning combination, one of the validation units 14 is used to verify that the win was legitimate. At the time of verification, information specific to a win is recorded within the validation unit 14. Later, these stored data records are uploaded to the system base station 10 via the cradle 24. Preferably, the validation units 14 are those having the features described in the Richardson application Ser. No. 820,245, entitled "Portable Validation Unit for Gaming System".

As more fully detailed in FIGS. 1 and 8, the electronic gaming boards 12 communicate with either the system base station 10 or one of the validation units 14 through a serial digital communications interface including an adaptor plug 36 (FIG. 1). The adaptor plug 36 is a six-pin, female-type telephone jack which is available for connection with the other devices. The validation unit 14 connects to the adaptor plug 36 through a cable 30 with a male plug end 34. The cable 30 has another male plug end 32 which connects to a similar adaptor plug 33 on the validation unit 14.

When an operator needs to validate an electronic gaming board 12, he plugs the cable end 34 into the connector 36 in the bottom of the board 12 and then listens for an audible annunciation by the validation unit 14. Several distinguishable audible annunciations may be produced by the validation unit 14, each indicating a different status for an electronic gaming board 12.

Connection of the electronic gaming board 12 to the system base station 10 is through a male plug of the cradle 24 which is received by the adaptor plug 36. The pins of the adaptor plug 36 form a serial data transmit line TxD, a serial data receive line RxD, two low voltage detection lines BAT1, BAT2, a nonconnected pin NC, and ground. These pins connect to similarly-labelled pins of the cradle 24 and plug end 34 of the validation units 14.

The validation units 14 additionally communicate with the system base station 10 through the serial communications interface including the adaptor plug 33. The adaptor plug 33 is a six-pin, female-type telephone jack which is available for connection with the other devices. The coiled cable 30 with two male plug ends 32, 34 (FIG. 1) extends from the jack to connect the validation unit 14 to the system base station 10 at a female plug of the cradle 24. The pins of the adaptor plug 33 form a serial data transmit line TxD, a serial data receive line RxD, two sense lines-sense B, C, a low battery detection line BAT1, and ground. These pins connect to similarly-labelled pins in the cradle 24 and adaptor plug 36 of the gaming boards 12.

Figure 10A:
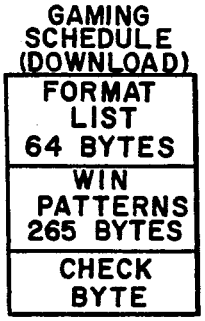
FIGS. 10A–10F are pictorial representations of data packages which are transferred between the system base station and an electronic gaming board.
Figure 10B:
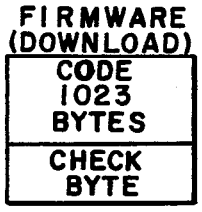
Figure 10C:
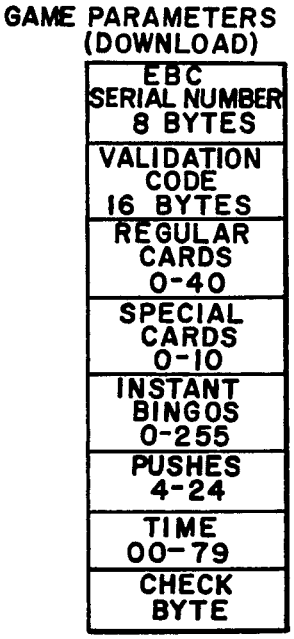

The system base station 10 can download through the communications interface cradle 24 to an electronic gaing board 12 three different types of data blocks as illustrated in FIGS. 10A, 10B, and 10C. A gaming schedule is shown in FIG. 10A, preferably including 64 bytes of a format list, 256 bytes of win patterns, and ending with a check byte. The second type of data block in FIG. 10B which can be downloaded into the gaming board 12 is 1023 bytes of firmware which is terminated by a check byte. The block of firmware is executable by the gaming board 12 upon a special sequence of key actuations or commands. It is used for special security applications or other functions.

The last block of data which can be downloaded is a game parameters block shown in FIG. 10C. The system base station 10 assigns each gaming board 12 an 8-byte serial number defining the board and the player to which it is entrusted for the gaming session. The serial number is used for audit purposes to track the cards in play and is the first 8 bytes of the game parameters. The next 16 bytes of the game parameters is a validation code which is identically input to every gaming board 12 and validation unit 14 to define a gaming session. Next in the game parameters block is a byte indicating how many regular cards the player has purchased which byte have a value between 0 and 40. The following byte is the number of special cards, between 0 and 10, purchased and, thereafter, a byte indicates the number of instant bingo games between 0 and 255, purchased. The next to the last byte of information in the block indicates the number of chances available to select instant bingo spaces. The last information byte is a number between 0 and 79 indicating the time in minutes that a player has to load the board before it automatically switches to play mode. This variable is to ensure that play of the game starts all boards at the same actual time.

Figure 10D:
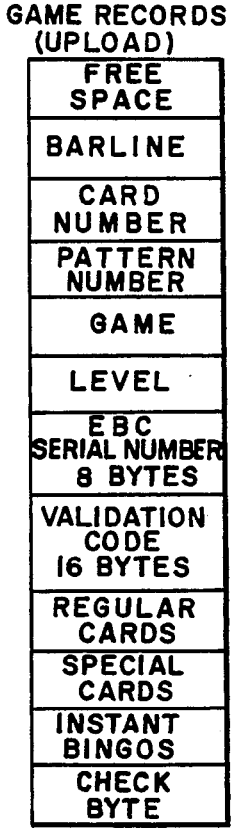

The validation unit 14 can upload a block of data from an electronic gaming board 12 through its communications interface 33 as illustrated in FIG. 10D. These game records or parameters are assembled internally within the gaming board 12 and are available upon command from the validation unit 14. The first six bytes of this block are the values of status indicators for the gaming board 12 at the time of a win or a validation command. The status (contents) of the free space, the annunciator bar and the pattern, game, and level of the gaming schedule are uploaded. The next 27 bytes are copies of the initialization information downloaded previously including the serial number, validation code, and the number of regular, special, and instant cards. The block ends with a check byte.

Figure 10E:
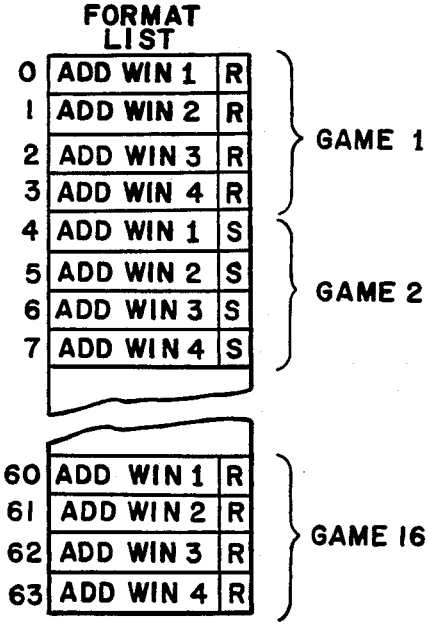
Figure 10F:
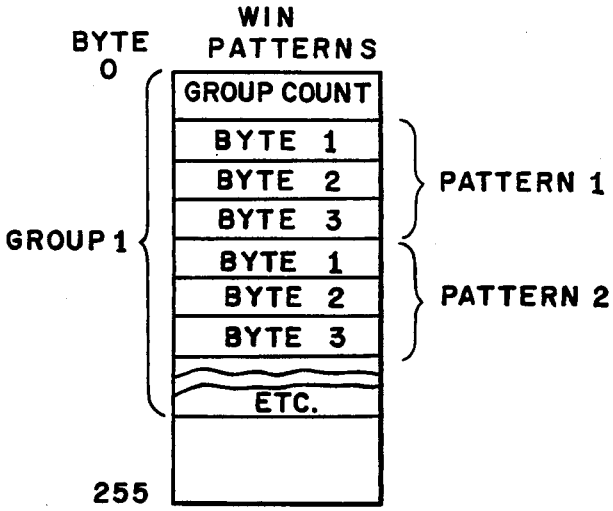

A flexible and complex gaming schedule can be formed by the system base station 10 and downloaded into each gaming board 12. FIGS. 10A, 10E, and 10F illustrate a schedule for a typical 16-game session with up to either 4 sublevels or places for each game. The schedule in FIG. 10A is separated into a format list shown in detail in FIG. 10E, and a plurality of win patterns shown in detail in FIG. 10F. The maximum of 16 games of the session are each assigned four bytes which contain addresses of win pattern groups in the win pattern bytes. Therefore, each game area of the format list points to the winning pattern for that particular game.

For different game levels, the addresses of the win pattern groups can be different, each building into a more complex pattern. For different game places, the addresses of the win pattern groups can be repeated. In addition, combinations of place and level games may be played in this manner. For example, a two-level game with a first and second place for each level can be played by storing the same win group address in the first byte and the second byte. Another win group address would be stored in the third byte and the fourth byte. It is evident that a 16-game, 4-level or 4-place schedule that is completely an arbitrary choice, or other schedules of this type, can be used.

Each win pattern group comprises a group count byte and a plurality of 3-byte (24-bit) win patterns. Each bit of a win pattern is assigned to one of the 24 spaces of the 5×5 bingo array (the free space is excluded) and a pattern is formed by selecting which spaces must be matched for a win. The selected spaces are marked one or zero, and the remaining bits are filled with the other logic value. The group count number identifies the number of ways or win patterns that will result in a win. For example, regular bingo has 12 win patterns (5 rows, 5 columns, 2 diagonals).

When first powered on, the validation units 14 receive from the system base station 10 an assignment code of eight bytes and a validation code of sixteen bytes, both in the form of ASCII strings (FIG. 9A). The validation code defines the particular game schedule or session of play and can be changed as often as the operator desires. The identical validation code is also stored in each of the electronic gaming boards 12 such that it can be matched with the validation code stored in the validation unit 14. The assignment code is a number given by the system base station 10 to the validation unit 14 describing the particular unit and the employee to whom it is entrusted for the session.

After the validation of a winning electronic gaming board 12, an EBC record relating to the winning combination and stored in the gaming board 12 is transferred to the validation unit 14 (FIG. 9D). Thereafter, a plurality of win records from a validation unit 14 may be uploaded to the system base station 10 for auditing purposes by selecting operations that upload a header record (FIG. 9B) and upload a win record (FIG. 9C). The header record is a count kept by the validation unit 14 of the number of win records it has stored and also includes the assignment code of the device and a byte forming the checksum of the information sent. A command to upload the win record causes the validation unit 14 to transfer one of its stored records about a win. The win record of an electronic gaming board 12 contains information as to the place of the win, which card the win occurred on, the win pattern, and the game number. Further, the information indicates the level of the win and the serial number of the winning gaming board 12. Operationally, when the validation unit 14 is connected to the electronic gaming board 12, it is used to validate the gaming board 12, validate either a regular or instant bingo, and upload the EBC records. When the validation unit 14 is connected to the system base station 10, it is used to receive the initialization record, or to upload the header records or win records.

The automatic gaming system uses a communications scheme or interface that allows the system base station 10, the electronic gaming boards 12, and the validation units 14 to act as one system. The communications interface uses an asynchronous serial communications protocol with the addition of a special handshaking routine to establish communications. The general communications protocol is a byte-serial communications with one start bit, eight data bits (no parity), and one stop bit at a data rate of 4800 baud. Serial data is transmitted via the transmit line TxD of each device and received via the receive line RxD of the other device.

When the gaming board 12 is connected to either the system base station 10 or the validation unit 14, the gaming board 12 acts as a slave unit and waits for one of the other devices to initiate the communication. In one mode, the gaming board 12 uses the BAT1 signal to signal the validation unit 14 with a high logic level. The gaming board 12 also uses the BAT1 and BAT2 signals to test for low battery voltage with the system base station 10.

Figure 7A:
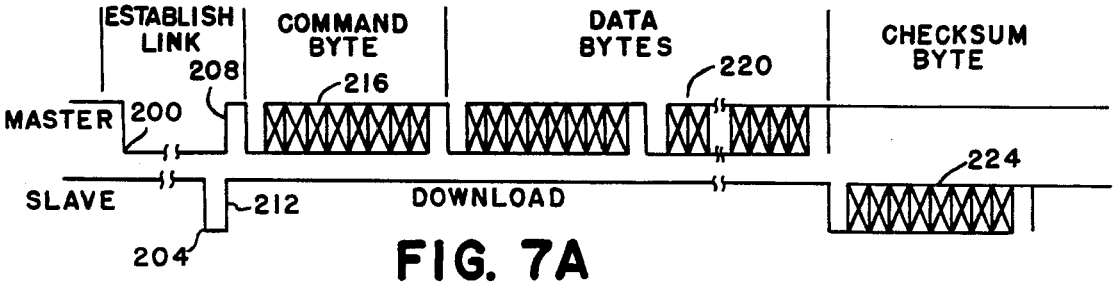
FIG. 7A is a pictorial representation of the waveforms for serial data communications for downloading information from the system base station to either the electronic gaming boards or the validation units.
Figure 7B:
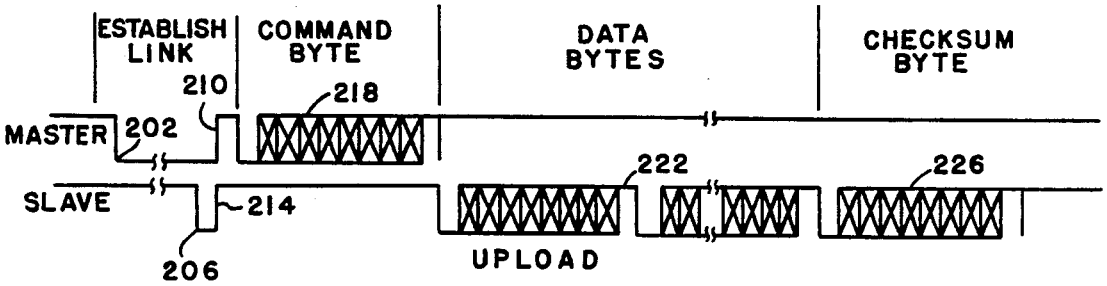
FIG. 7B is a pictorial representation of the waveforms for serial data communications for uploading information from validation units to the system base station.

When the validation unit 14 or system base station 10 detects the high logic level on the BAT1 signal line, it will establish a communications link with the gaming board 12, FIGS. 7A, 7B. The link is accomplished by the master device beginning the communications by placing a zero (break) 200 or 202 on the RxD line of the gaming board 12. This produces an interrupt to the board 12 which will be sensed by internal circuitry. The gaming board 12 will then reply with a low-level response, 204 or 206, by grounding the TxD line of the master device. The master device will again respond by setting the RxD input of the gaming board 12 high, 208 or 210, removing the interrupt. Thereafter, the board 12 will again reply by bringing its TxD line to a high logic level 212 or 214. Once the handshake has been accomplished the link is established and data communications may take place.

The system base station 10 or the validation unit 14 will then transmit a one-byte command 216 or 218 to the gaming board 12 requesting a particular operation. Depending upon which device the gaming board 12 is communicating with, it will perform either a download operation as illustrated in FIG. 7A or an upload operation as illustrated in FIG. 7B.

The command byte is an ASCII numeral from the set 1, 2, 3, 4, and 5 (all other numbers are ignored), specifying one of five commands as follows:

"1" Download gaming schedule
"2" Download gaming parameters
"3" Download gaming firmware
"4" Upload game records
"5" Power down After receiving the command byte, the gaming board 12 executes one of the five commanded operations depending upon the value of the byte. If the command byte is a "1", "2", , or "3", the gaming board 12 prepares to receive (download) a block of data 220 from the system base station 10. The downloaded data blocks have been illustrated previously with respect to FIGS. 10A, 10B, and 10C. If the command byte is a "4", the gaming board 12 will transmit (upload) a block of data 222 to the validation unit 14. The uploaded data block has been previously illustrated with respect to FIG. 10D. If the command byte is a "5" from the system base station 10 or the validation unit 14, the gaming board 12 will power down and turn itself off. Any other command byte value is ignored. After these actions are completed, the gaming board breaks the communication link, thereby requiring the link to be re-established for further communication to occur.

Following the data block transfers, regardless of whether data was transferred to or from the gaming board 12, a checksum byte, 224 or 226, is transmitted back to the master unit. The checksum is the arithmetic sum of all the bytes transmitted after the command byte in modulo 256. For data transmitted from the gaming board 12, the validation unit 14 must match this checksum 226 to the one it calculates while receiving the data. If they match, the transfer was good and if not, the validation unit 14 is responsible for re-establishing the link and reissuing the upload command until a good transfer is achieved. For data transmitted to the gaming board 12, the checksum 224 must equal zero for a good data transfer. A check byte will be included in each block of data 220 to make the check sum equal to zero if the transfer is valid. Again, if the checksum 224 transmitted to the system base station 10 is not zero, then it is incumbent upon the base station to re-establish the link and reissue the communications until a good transfer is achieved.

The validation units 14 communicate with two external devices, namely the system base station 10 and the electronic gaming boards 12, through the communications interface. When the validation unit 14 is not connected to any other device, the sense C and sense B lines are held at a low logic level. These lines are used to indicate which of the two external devices are connected to the validation unit 14. The sense C line is assigned to the system base station 10 while sense B line is assigned to the electronic gaming boards 12. Therefore, the sense C line has a voltage applied to it if the system base station 10 is connected, and the sense B terminal has a voltage applied to it if an electronic gaming board 12 is connected to the validation unit 14.

A different communications format is used, depending on which device the validation unit 14 is communicating with. When the validation unit 14 is connected to an electronic gaming board 12, the validation unit 14 initiates communications by generating commands as a master unit, shown in FIGS. 7A and 7B. When the validation unit 14 is connected to the system base station 10, the validation unit 14 acts as the slave unit and waits for the system base station 10 to initiate communications.

As seen in FIG. 7B, when the validation unit 14 detects a high logic level on the sense B line, it will establish a communications link with an electronic gaming board 12. The link is accomplished when the validation unit 14 begins communicating by placing a zero (break) 202 on its transmit line TxD. The validation unit 14 will then wait for the electronic gaming board 12 to respond with a zero 206 on its receive line RxD. A low logic level on the RxD line will end an interrupt to the validation unit 14, indicating that the electronic gaming board 12 has replied. Thereafter, the validation unit 14 responds by setting the data output line TxD high again at 210 and waiting for the electronic gaming board 12 to do the same to its RxD line at 214. Once this has been accomplished, the link is established and data communications can take place.

The validation unit 14 will transmit a one-byte command 218 to the electronic gaming board 12 requesting that the electronic gaming board 12 transmit stored audit information about the present card in play and, if applicable, a win pattern. The electronic gaming board 12 transmits a block of data 222 to the validation unit 14 in byte-serial format and terminates the transmission with a checksum 226. This communication protrocol, more particularly illustrated in FIG. 7B, is termed an upload operation from an electronic gaming board 12 to a validation unit 14. The uploaded information is an EBC record as illustrated in FIG. 9D.

Conversely, when a validation unit 14 detects a high logic level on the sense C line, this is an indication that it is connected to the system base station 10. The validation unit 14 does not initiate communication with the system base station 10, but instead waits for the system base station 10 to do so. The communications can be either an uploading operation, FIG. 7B, or a downloading operation, FIG. 7A.

In the manner illustrated, the system base station 10 places a logic zero 200 or 202 on the input data line RxD of the validation unit 14. After the sense B line has detected a high logic level during the connection, the validation unit 14 continuously checks its interrupt input line to detect a zero condition on its RxD line. When a logic zero on the RxD line appears, the validation unit 14 responds with a logic level zero, 204 or 206, on its output data line TxD. The handshake is completed when the system base station 10 detects the logic zero, and in response thereto, returns its TxD line to a logic level one, 208 or 210. The system base station 10 then waits for the validation unit 14 to sense the return of the TxD line to a high level and to brings its output data line back to a logic level of one at 212 or 214. This procedure establishes the communications link.

After the communications link has been established, the validation unit 14 waits to receive a command 216 or 218 from the system base station 10 and will idle waiting for the command as long as the sense C line is held high. If the sense C line goes low, then the link will have to be reestablished before any communications can occur. The system base station 10 thereafter sends a command byte to the validation unit 14 to request a certain operation.

The command byte is an ASCII numeral from the set 2, 5, 6, and 7 (all other numbers are ignored), specifying one of four commands as follows:

"2" Download Assignment and Validation Code
"5" Power Down
"6" Upload Header Record
"7" Upload Next Record After receiving the command byte, the validation unit 14 executes one of the four commanded operations depending upon the value of the byte. If the command byte is a "2" the validation unit 14 prepares to receive (download) a block of data 220 from the system base station 10. The data block which is downloaded is as shown in FIG. 9A. If the command byte is a "6" or "7", , the validation unit 14 will transmit (upload) a block of data 222 as previously described in FIGS. 9B and 9C, respectively. If the command byte is a "5" from the system base station 10, the validation unit 14 will power down and turn itself off. Any other command byte value is ignored. After these actions are completed, the validation unit 14 breaks the communications link thereby requiring the link to be reestablished for further communication to occur.

Following the data block transfers regardless of whether data went to or from the validation unit 14, a checksum byte 224 or 226 is transmitted to the system base station 10. The checksum is the arithmetic sum of all the bytes transmitted after the command byte in modulo 256. For data transmitted from the validation unit 14 (upload), the system base station 10 must match the checksum 226 received from the validation unit 14 to the checksum the system base station 10 calculates while receiving the data. If they match, the transfer was good and, if not, the system base station 10 is responsible for reestablishing the link and reissuing the command until a good transfer is achieved. For data transmitted to the validation unit 14 (download), the checksum 224 must equal zero, as a check byte will be included in each block of data to make the checksum equal to zero if the transfer is valid. If the checksum transmitted to the system base station 10 is not zero, then it is incumbent upon the system base station 10 to reestablish the link and reissue communications until a good transfer is achieved.

The main program which controls the system base station 10 is an interactive software package which allows an operator of the system base station 10 to perform particular functions for the automatic gaming system. In general, the main operational modes of the system are a manager mode, a cashier mode, and an accounting mode. The manager mode is used to initialize the system parameters, provide security information, and develop a gaming schedule. The cashier mode allows the system base station 10 to operate as a point-of-sale terminal for initializing the validation units 14 and for selling cards on the electronic gaming boards to patrons. Further, it permits the cashier to make refunds and payouts during the play of the gaming session. The accounting mode is used after the gaming session to provide an audit record of the card sales, the payouts, and the refunds. In this manner, an integrated gaming system is created whereby the system base station provides a focal point for performing the functions needed to efficiently and automatically run a gaming session, particularly a bingo gaming session.

Figure 2:
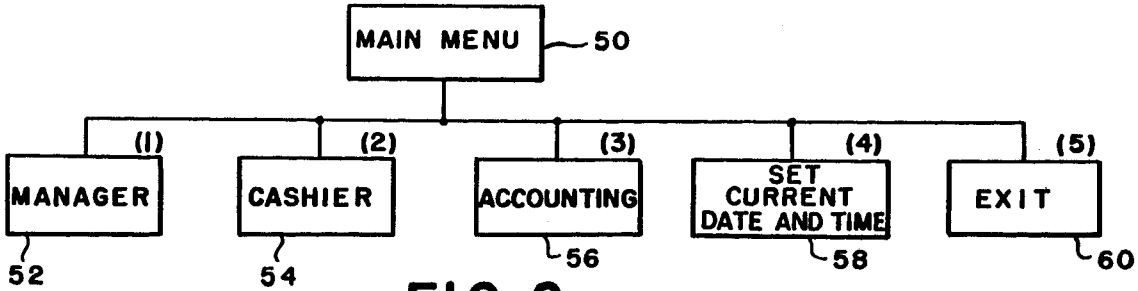
FIG. 2 is a pictorial representation of the menu of a software control program MAIN regulating the operations of the system base station illustrated in FIG. 1.

With respect now to FIG. 2, the main program is entered through a MAIN menu 50 which has a number of selections or choices which the operator can branch to by pressing a particular key. The MAIN menu 50 that the operator will produce on the display 18 during the initial part of the program consists of five selections. The operator can either select the manager mode 52, the cashier mode 54, or the accounting mode 56 of the program for the system base station 10. Further, by selecting a fourth routine in block 58, he can set the current date and time of a real-time clock which is used to provide a variable time interval for loading the electronic gaming boards 12. In general, the routine which embodies the operational block 58 depends upon the internal hardware of the system of the system base station 10 illustrated in FIG. 1. Conventional disk-operating systems which are compatible with MS-DOS or PC-DOS include means and instructions for settng a real-time clock. The routine 58 will produce a prompt on the screen of the display means 18 of the system base station 10 requesting an input of the current date and time from the operator on a keyboard 16. In response to his input, the current data and time will be stored in the real-time clock module of the hardware. The system will increment the date and time settings from that point.

Figure 3:
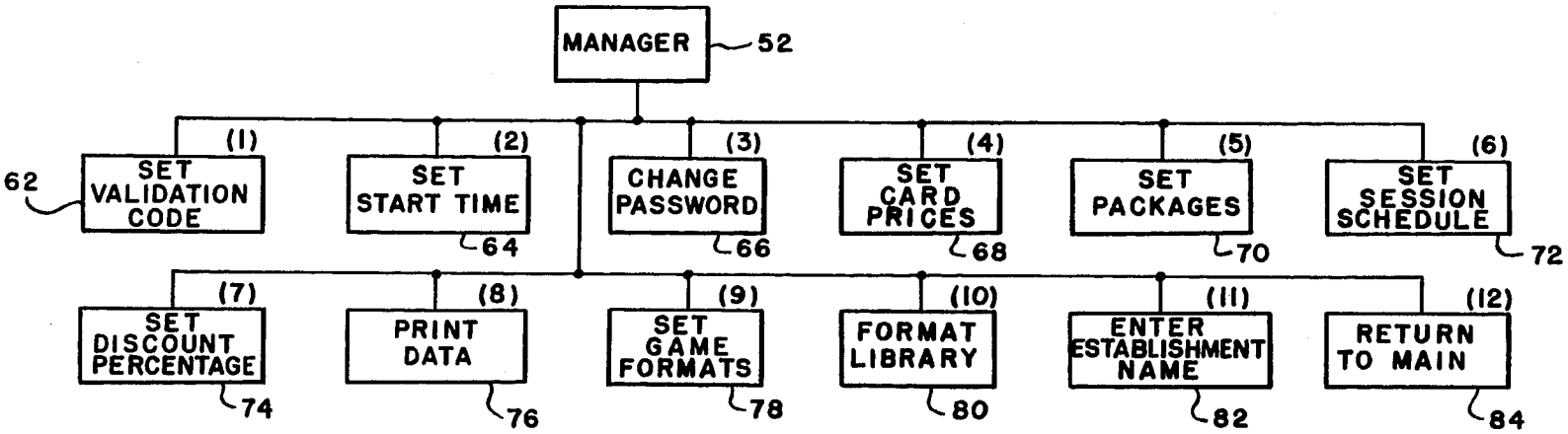
FIG. 3 is a pictorial representation of the menu of the MANAGER routine which can be selected from the MAIN menu illustrated in FIG. 2.

The manager mode routine 52 is more fully illustrated in FIG. 3 and is also an interactive, menu-oriented routine. Selecting the routine 52 from the MAIN menu 50 causes a MANAGER menu 52 providing twelve choices or selections to be displayed on the monitor 18 of the system base station 10. The first choice is a routine 62 which allows the operator to set the validation code. The routine requests the operator by means of a visual prompt on display means 18 to enter a 16-byte arbitrary code. This code can be input either as numbers, letters, or symbols and in any order. The manager mode 52 is used at this point to set the validation code for the entire gaming session. At any time before the start of play, or before the programming of the electronic gaming boards 12 and validation units 14 is completed, the validation code can be changed or updated if the operator believes that the system has been compromised.

Another selection of the manager mode 52 allows a routine 64 to be called to set the start time of the gaming session. The routine 64 permits the operator to set one beginning time for the gaming session so that all of the electronic gaming boards 12 will commence play at the same time. Further, this feature allows extra cards to be sold during intermissions by ensuring that the gaming boards 12 will start together at the end of the intermission. When the routine 52 is selected, the operator is prompted with a request to enter the start time on the display 18. After this operation is successfully completed, the program will return to the manager menu 52.

A selection of routine 66 by the operator when in the manager mode 52 will provide means for changing the password which is used to gain entrance to the main program. When in this mode the program prompts the operator with a message to enter a new password. In response to the prompt, the operator will type in a six-digit or longer identifier which is then used by the manager to access the main program at the next gaming session.

The fourth selection, a routine 68, allows the operator to set the selling prices of each card. In response to a prompt for each type of available card, the operator inputs a price which is used thereafter to calculate audit records for the system. A further option, routine 70, allows a group of package prices to be charged for different combinations of cards and instant bingos. A routine 74 can be selected to set the discount percentages for purchasing any number of games or combinations of games. Printouts of these variables, as selected by the operator, is shown in FIG. 1B for price data and discount percentages. FIG. 15 illustrated a printout after the selection of the package variables for the gaming session.

Three selections of the MANAGER routines, namely routine 72, routine 78, and routine 80, allow for the formation of a complex gaming schedule which is completely arbitrary in nature. The selection of routine 78 allows the gaming operator to set the game formats, and routine 80 allows him to call up a format library. An example of a format library which has been printed is shown in FIG. 16, but this is the same data which would be shown on display 18 for the interactive routine. The format library is a set of predetermined win patterns which are used to select a number of different game formats in the routine 78. After the format of each game is chosen, the routine 72 is called to set the gaming session schedule by inserting the particular format chosen into a schedule and entering the number of levels and win combinations available to the player. Further, data as to the amount of the payoff for each game, and whether a regular or special card is required, are selected. An example of a game schedule selected in this manner is illustrated in FIG. 18.

Figure 5:
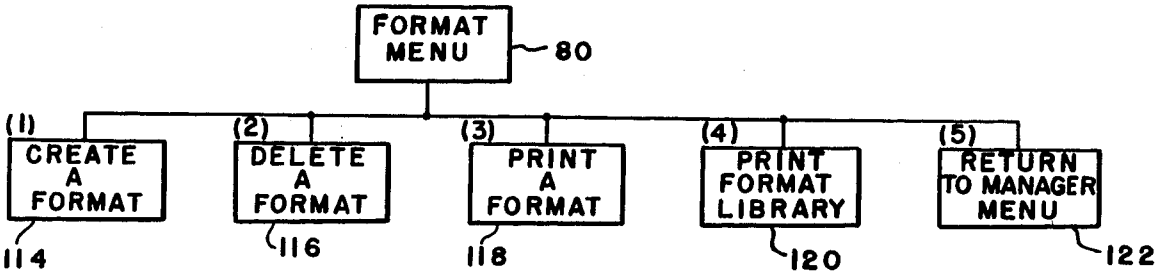
FIG. 5 is a pictorial representation of the submenu for the FORMAT routine which can be selected from the MANAGER menu illustrated in FIG. 3.

Setting the game format routine 78 produces a separate submenu illustrated in FIG. 5 from which a number of operations may be chosen. The operator or game scheduler may choose to create a format by selecting routine 114, to delete a format by selecting routine 116, or to print a copy of a selected format by routine 118. Further, the entire format library can be printed by selecting routine 120. Finally, from the format menu routine 80, the operator has the choice of returning to the MANAGER menu 52 by selecting an option illustrated in block 122. FIG. 17 shows an example of a win format which was created with the routine 114 and then printed by routine 118.

Figure 4:
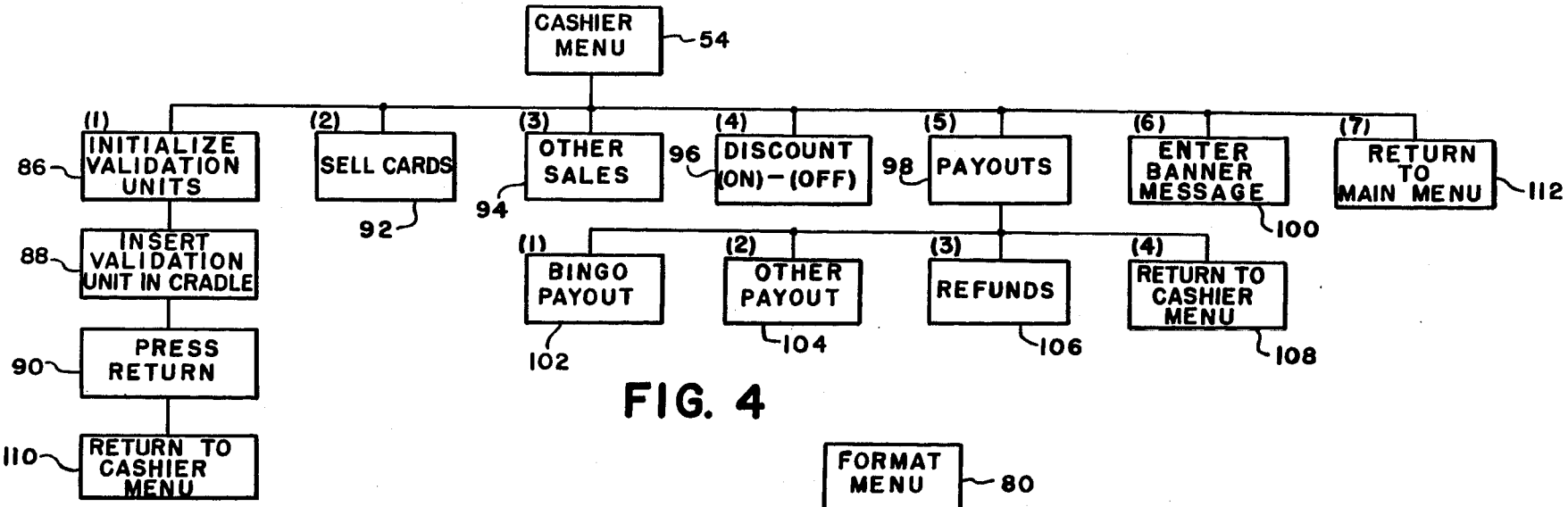
FIG. 4 is a pictorial representation of the menu of the CASHIER routine which can be selected from the MAIN menu illustrated in FIG. 2.

After the operator has accomplished all of the functions that are necessary for his particular establishment and gaming session in manager mode, he can return to the MAIN menu by selecting the appropriate routine in block 84. Once back in the MAIN menu, the system base station 10 is ready to start the gaming session, which may or may not begin immediately. When it is desired to start the gaming session, the MAIN menu 52 is entered by the correct password and the cashier mode 54 is selected. The selection of the cashier mode 54 causes a CASHIER menu illustrated in FIG. 4 to be displayed on the monitor 18.

The CASHIER menu allows for the initialization of the validation units 14 by selecting the beginning of a routine 86. This selection causes the operator to be prompted with a message to insert a validation unit 14 in the communications cradle 24 of the system base station 10 in block 88. When the operator has finished the insertion step, he will press a carriage return in block 90 and the system will automatically initialize the validation unit 14 with the data previously described. After the routine 86 has successfully completed the initialization, the program will return to the cashier menu in block 110. This program is repeated if any other validation units 14 are present and need to be initialized.

The number of validation units 14 will be proportional to the number of gaming cards sold during a particular gaming session. Therefore, the validation units 14 may be initialized in a group before the start of the gaming session if the average number of players is known. Alternatively, a validation unit 14 may be initialized at any time during the gaming session when it becomes apparent that more cards are being sold than was originally anticipated.

If the second selection on the cashier menu 54 is taken, then a routine to sell the cards is entered. The card sale routine 92 consists of a prompt to the operator to insert one of the uninitialized electronic gaming boards 12 into the communications cradle 24. The particular board is assigned the next serial number, beginning with a particular offset, and the operator is prompted to input the number of regular cards which the player has purchased. The operator then enters a number from 0-40 or none. After the operator makes the entry, the program prompts with a request to enter the number of special cards purchased. After the operator has responded to this, he must also input the number of instant bingos that the player has purchased. The last input that the operator makes is the number of chances that the player has to produce an instant bingo. Once all the information has been loaded into the system and formatted into the correct data blocks, the operator will press the carriage return and cause the system base station 10 to download the gaming schedule that was developed during the manager mode 52, and to download the selected game parameters.

After the successful loading of a gaming board 12, the player is given a gaming board to load with numbers of the arrays he has purchased and a printed receipt of the transaction. An example of a printed receipt showing the purchase during routine 92 is illustrated in FIG. 11.

A routine 94 may be selected to manage other sales, and a routin 96 may be selected to determine whether a discount should be given for some purchases. The selection of a routine 100 allows the operator to enter a message into a special storage area of the system base station 10. When the players receive their receipts from the sales of the cards, a message will be preprinted thereon as a banner or header advertisement such as in FIG. 11. Further, the CASHIER menu 54 allows for a selection in block 112 to permit the operator to return to the main menu 50. The last selection of the CASHIER menu 54 is a payout routine 98. The payout routine 98, when selected, causes a submenu having four choices to be displayed on the monitor 18 of the system base station 10. The selections of the PAYOUT menu 98 include whether the payout is a bingo payout 102, another payout 104, or a refund 106. One last selection allows the operator to return to the CASHIER menu in block 108.

Figure 6:
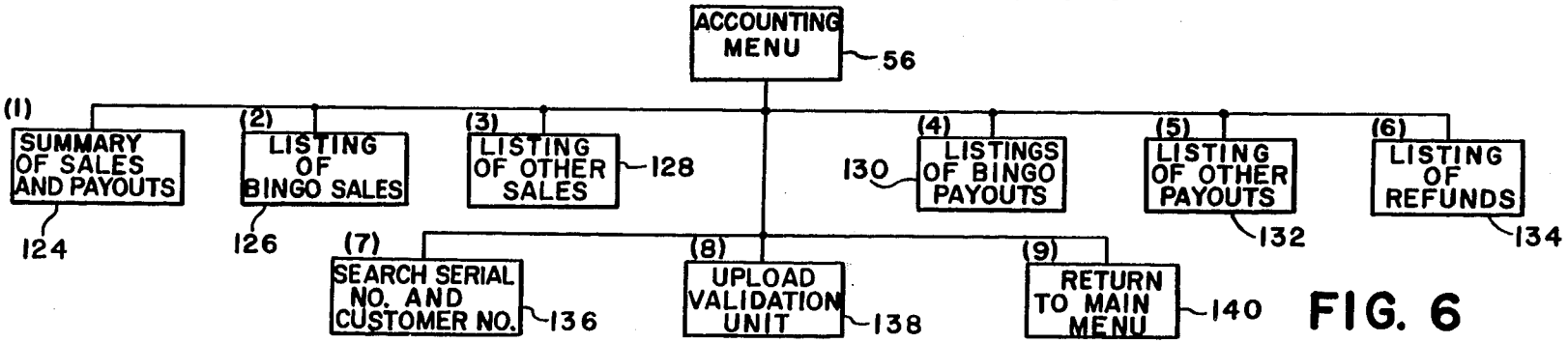
FIG. 6 is a pictorial representation of a menu for the ACCOUNTING routine which can be selected from the MAIN menu illustrated in FIG. 2.

After the gaming session has been completed and the validation units 14 have been collected, the operator will cause the program to branch back to the MAIN menu 50 (FIG. 2) where the ACCOUNTING routine 56 is selected. FIG. 6 illustrates a detailed menu displayed on the monitor 18 of the system base station 10 when the ACCOUNTING routine 56 is selected from the main menu 50. The accounting menu 56 allows the listing of a number of system parameters on the display screen or, alternatively, their printout on a paper tape printer 20. The system base station 10 has been collecting data from all of the sales, payouts, and refuns of the gaming session. The stored information concerning the entire gaming session dyanamics is condensed and compressed into a formatted output. A listing of the bingo sales may be obtained by selecting routine 126, or a listing of other sales may be obtained by requesting routine 128. Further, the listings of the bingo payouts or the other payouts may be obtained by requesting the appropriate routine, either 130 or 132, respectively. In addition, a listing of all refunds may be obtained by selecting block 134 from the ACCOUNTING menu 56. A summary of all of the sales and payouts can be collectively obtained by selecting the routine 124. This routine gives a listing of the sum total of all sales in a category type, rather than individual listings as routines 126-134 provide. An example of a summary report is shown in FIG. 12.

To obtain actual support information for these audit functions from the validation units 14, a routine 138 is selected and executed. The upload validation routine causes a prompt to be displayed on the monitor 18 of the system base station 10 indicating that the validation unit 14 should be connected to the communications cradle 24. After the operator has accomplished the connection, he will press the carriage return key and the system base station 10 will automatically interrogate the validation unit 14, causing an upload of the audit information contained therein. Once the audit information has been extracted from the validation unit 14, the command which causes the validation unit 14 to be powered down is generated by the system base station 10. This operation turns the validation unit 14 off during those times when a gaming session is not being played.

Routine 136 of the ACCOUNTING menu 56 provides for the selection of a search serial number and customer number routine. This routine permits the system to do a global record search of all the audit information that it has stored for a particular serial number or customer number which is entered by the operator. This operation is for checking purposes and allows the operator to quickly find a record if there is some discrepancy between sales, payouts, and refunds. The last selection 140 in the ACCOUNTING menu allows the operator to return to the main menu.

While a preferred embodiment of the invention has been illustrated, it will be obvious to those skilled in the art that various modifications and changes may be made thereto without departing from the spirit and scope of the invention as defined in the appended claims. A listing of the routines for controlling the system base station 10 in a high level language (BASIC) follows on pages 32–94.

```
40 GOTO 60
50 KILL"BINGO.BAK":NAME "BINGO.BAS" AS "
                BINGO.BAK":SAVE"BINGO":END
60 LI$=STRING$(76,32):SP$=" ":C1$=CHR$(1
7):R1$=CHR$(18):BA$=CHR$(8):CL$=CHR$(26)
:ESC$=CHR$(27):B$=CHR$(7):PR$="PRESS 'RE
                                    TURN'"
70 DIM T(12),M$(12),D$(7)
80 FOR X=1 TO 12:READ M$(X):NEXT:FOR X=1
                                TO 7:READ D$(X):NEXT
90 DATA "JANUARY","FEBRUARY","MARCH","AP
RIL","MAY","JUNE","JULY","AUGUST","SEPTE
   MBER","OCTOBER","NOVEMBER","DECEMBER"
100 DATA "SUN.","MON.","TUES.","WED.","T
                                HUR.","FRI.","SAT."
110 GOTO 1490
120 I$="":PFC=0
130 X$=INPUT$(1)
140 IF FC THEN FC=0:GOSUB 1110:IF X$="'"
 THEN X$=C1$:RETURN ELSE IF ASC(X$)=127
THEN X$=R1$:RETURN ELSE IF SC% =1 AND AS
                                C(X$)=0  THE
N X$=T$:RETURN ELSE PFC=1:RETURN
150 IF X$=CHR$(13) THEN RETURN
160 IF X$=BA$ THEN IF LEN(I$)=0 THEN GOT
O 130 ELSE I$=LEFT$(I$,LEN(I$)-1):PRINT
BA$;SP$;BA$;:GOTO 130:REM PROCESS BACKSP
                                    ACE
170 IF X$=ESC$ AND NFC=0 THEN GOSUB 1110
:V=YL:H=XL:GOSUB 240:PRINT STRING$(LEN(I
$),32):V=19:H=1:GOSUB 240:PRINT STRING$(
                                    20,42);" FUN
CTION CODES ";STRING$(20,42):PRINT"1. GO
                BACK TO LAST ENTRY":FC=1
180 IF X$=ESC$ AND NFC=0 THEN IF SC%=1 T
HEN PRINT"2. CANCEL AND RETURN TO MENU":
PRINT"3. TOTAL":PRINT "SELECT ONE :";:GO
                                TO 120 ELSE
PRINT"2. FINISHED AND RETURN TO MENU":PR
                INT "SELECT ONE :";:GOTO 120
190 IF ASC(X$)<AL OR ASC(X$) > AH THEN P
RINT B$;:GOTO 130:REM CHECKS IF INPUT CH
AR IS WITHIN THE ASCII VALUE DESIGNATED
                                BY AL (LOW)
AH (HIGH)
200 IF AL=46 THEN IF X$="/" THEN PRINT B
                                        $;
210 IF LEN(I$)=L THEN PRINT B$;:GOTO 130
 ELSE I$=I$+X$:REM L IS THE MAX. LENTH O
F INPUT. I$ IS THE INPUT STRING RETURNED
                                TO THE CALL
ING ROUTINE
220 IF P THEN PRINT "*"; ELSE PRINT X$;:
                REM P IS PASSWORD ENTRY FLAG
230 GOTO 130
240 Y$=CHR$(31+V):X1$=CHR$(31+H):PRINT E
SC$"=  ":PRINT ESC$"=";Y$;X1$;LI$:PRINT
                                ESC$"=";Y$;X1$;
250 RETURN
260 REM
270 REM    PRINT SCREEN.HEADER
280 REM
290 V=1:H=1:GOSUB 240:T1=LEN(I$):T1=INT(
                                T1/2):T1=38-T1
300 PRINT STRING$(T1,127);I$;STRING$(T1,
                                    127)
310 RETURN
320 REM GET CURRENT TIME FROM RTC
330 FOR N = 12 TO 0 STEP -1
340 OUT 60,N: OUT 60,16+N: OUT 60,N
350 OUT 60,64: T(N)= INP(60)-240: OUT 60
                                    ,0: NEXT
360 IF T(0)=TX THEN GOTO 330 ELSE TX=T(0
                                        )
370 MO$=M$((10*T(10))+T(9)):M1$=STR$((10
*T(10))+T(9)):M1$=RIGHT$(M1$,LEN(M1$)-1)
          :IF LEN(M1$)=1 THEN M1$="0"+M1$
380 YR=(10*T(12))+T(11):YR$=STR$(YR):YR$
                =RIGHT$(YR$,LEN(YR$)-1)
390 DA$=STR$((10*T(8))+T(7)):D$=RIGHT$(D
A$,LEN(DA$)-1):IF LEN(D$)=1 THEN D$="0"+
                                        D$
400 DATE$=M1$+"/"+D$+"/"+YR$:YRM1$=YR$+M
                                        1$
410 PM = 0 :IF T(5) => 4 THEN T(5) = T(5
                                ) - 4:PM=1
420 IF PM = 1 THEN PM$="PM" ELSE PM$="AM
                                        "
430 H$=STR$((10*T(5))+T(4)):H$=RIGHT$(H$
,LEN(H$)-1):IF LEN(H$)=1 THEN H$="0"+H$
440 MN$=STR$((10*T(3))+T(2)):MN$=RIGHT$(
MN$,LEN(MN$)-1):IF LEN(MN$)=1 THEN MN$="
                                    0"+MN$
450 SEC$=STR$((10*T(1))+T(0)):SEC$=RIGHT
$(SEC$,LEN(SEC$)-1):IF LEN(SEC$)=1 THEN
                            SEC$="0"+SEC$
460 CT$=H$+":"+MN$+" "+PM$
470 RETURN
480 REM SET TIME
490 T3=0
500 PRINT CL$:I$=" "+ENT$+"CURRENT DATE
                                AND TIME "
510 GOSUB 290
520 H=1:V=12:GOSUB 240:PRINT"CURRENT HOU
                                    R ";H$
530 H=1:V=4:GOSUB 240:PRINT ENT$;"HOUR:
 ";:YL=V:XL=12:L=2:AH=57:AL=48:GOSUB 120
540 IF X$=R1$ THEN 710 ELSE IF X$=C1$ OR
                                PFC THEN 530
550 IF LEN(I$)=0 THEN PRINT H$:GOTO 580
      ELSE IF LEN(I$)=1 THEN I$="0"+I$
560 IF VAL(I$)<1 OR VAL(I$)>12 THEN PRIN
                                T B$:GOTO 520
570 H$=I$
580 H=1:V=12:GOSUB 240:PRINT"CURRENT MIN
                                UTE ";MN$
590 V=6:H=1:GOSUB 240:PRINT ENT$;"MINUTE
S: ";:YL=V:XL=16:L=2:AH=57:AL=48:GOSUB 1
                                    20
600 IF X$=R1$ THEN 710 ELSE IF X$=C1$ TH
EN H=1:GOSUB 240:GOTO 520 ELSE IF PFC TH
                                EN 590
610 IF LEN(I$)=0 THEN PRINT MN$:GOTO 640
620 MN$=I$:IF LEN(I$)=1 THEN MN$="0"+MN$
630 IF VAL(MN$)>59 THEN PRINT B$:GOTO 59
                                        0
640 H=1:V=12:GOSUB 240:PRINT"CURRENT ";P
                                        M$
650 V=8:H=1:GOSUB 240:PRINT ENT$;"AM/PM:
 ";:YL=V:XL=14:L=2:AH=89:AL=65:GOSUB 120
660 IF X$=R1$ THEN 710 ELSE IF X$=C1$ TH
EN H=1:GOSUB 240:GOTO 580 ELSE IF PFC TH
                                EN 650
670 IF LEN(I$)=0 THEN I$=PM$:PRINT I$
680 IF I$ <>"AM" AND I$ <> "PM" THEN PRI
                                NT B$:GOTO 650
690 PM$=I$
700 V=12:H=1:GOSUB 240:PRINT PR$;:L=1:AH
=13:AL=13:YL=V:XL=18:GOSUB 120:IF X$=R1$
 THEN 710 ELSE IF X$=C1$ THEN H=1:GOSUB
                                240: GOTO 64
0 ELSE IF PFC THEN 700
710 REM
720 T(0)=1:T(1)=0:T(2)=VAL(RIGHT$(MN$,1)
):T(3)=VAL(LEFT$(MN$,1)):T(4)=VAL(RIGHT$
(H$,1)):T(5)=VAL(LEFT$(H$,1)):IF PM$="PM
                                " THEN T(5)
= T(5)+4
730 REM UPDATE RTC WITH DATE AND TIME
740 FOR X=12 TO 0 STEP -1:OUT 60,X:OUT 6
                                0,16+X:OUT 60,X
750 OUT 60,T(X):OUT 60,32+T(X):OUT 60,T(
                                        X)
760 NEXT
770 RETURN
780 REM SET TODAY'S DATE
790 GOSUB 330
800 PRINT CL$:I$=" "+ENT$+"CURRENT DATE
AND TIME ":GOSUB 290:H=1:V=12:GOSUB 240:
            PRINT"CURRENT DATE ";DATE$;
810 V=4:H=1:GOSUB 240:PRINT ENT$"TODAY'S
 DATE (MM/DD/YY): ";:YL=5:XL=16:L=8:AL=4
                7:AH=57:GOSUB 120
```

```
820 IF X$=R1$ THEN RETURN ELSE IF X$=C1$
                                OR PFC THEN 790
830 IF LEN(I$)=0 THEN PRINT DATE$:GOTO 9
                                          10
840 IF LEN(I$)<>8 THEN PRINT B$:GOTO 800
850 T1=0:FOR X=1 TO LEN(I$):IF MID$(I$,X
                          ,1)="/" THEN T1=T1+1
860 NEXT:IF T1<> 2 THEN PRINT B$:GOTO 80
                                          0
870 IF MID$(I$,3,1)<>"/" OR MID$(I$,6,1)
            <> "/" THEN PRINT B$:GOTO 800
880 IF VAL(LEFT$(I$,2))=0 OR VAL(LEFT$(I
          $,2)))>12 THEN PRINT B$:GOTO 800
890 IF VAL(MID$(I$,4,2))=0 OR VAL(MID$(I
        $,4,2)))>31 THEN PRINT B$:GOTO 800
900 DATE$=I$
910 V=12:H=1:GOSUB 240:PRINT "CURRENT DA
                          Y OF WEEK ";D$(T(6))
920 V=7:GOSUB 240:PRINT ENT$;"DAY OF WEE
K: ";:XL=20:YL=V:AL=65:AH=90:L=9:GOSUB 1
                                          20
930 IF X$=R1$ THEN 990 ELSE IF X$=C1$ TH
              EN 800 ELSE IF PFC THEN 910
940 IF LEN(I$)=0 THEN I$=D$(T(6)):PRINT
                                          I$
950 T1=0:FOR X=1 TO 7:IF LEFT$(D$(X),3)
            = LEFT$(I$,3) THEN T1=1:Y=X:
960 NEXT
970 IF T1<>1 THEN PRINT B$:GOTO 910
980 V=12:H=1:GOSUB 240:PRINT PR$;:XL=16:
YL=V:L=1:AH=13:AL=13:GOSUB 120:IF X$=R1$
 THEN 990 ELSE IF X$=C1$ THEN 910 ELSE I
                                F PFC THEN 9
80
990 I$=DATE$:GOSUB 330:DATE$=I$:T(6)=Y:T
(12)=VAL(MID$(DATE$,7,1)):T(11)=VAL(RIGH
T$(DATE$,1)):T(10)=VAL(LEFT$(DATE$,1)):T
                                (9)=VAL(MID$
(DATE$,2,1)):T(8)=VAL(MID$(DATE$,4,1)):T
                (7)=VAL(MID$(DATE$,5,1))
1000 GOSUB 740:IF X$=R1$ THEN RETURN
1010 GOTO 490
1020 REM
1030 REM  PASSWORD INPUT ROUTINE
1040 REM
1050 PRINT CL$:I$=" PASSWORD ENTRY ":GOS
UB 290:PRINT" ":PRINT"ENTER PASSWORD PLE
                                      ASE ";
1060 XL=23:YL=3:AL=32:AH=126:L=4:P=1:GOS
                                  UB 120:P=0
1070 RETURN
1080 REM
1090 REM  CLEAR MESSAGE AREA
1100 REM
1110 V=19:H=1:GOSUB 240:FOR Y=1 TO 5:PRI
  NT LI$:NEXT:V=YL:H=XL:GOSUB 240:RETURN
1120 RETURN
1130 PRINT CL$:V=12:H=20:GOSUB 240:PRINT
       "WAIT...LOADING CASHIER'S MENU ";
1140 RUN"BINGO-2"
1150 END
1160 GOSUB 1050:IF X$=R1$ THEN RETURN EL
            SE IF X$=C1$ OR PFC THEN 1160
1170 IF I$<>PW$ THEN PRINT CL$:V=12:H=12
:GOSUB 240:PRINT "PASSWORD ENTRY INVALID
  ";:FOR X=1 TO 13:PRINT B$;:NEXT:RETURN
1180 PRINT CL$:V=12:H=20:GOSUB 240:PRINT
       "WAIT...LOADING MANAGER'S MENU ";:
1190 RUN"MANAGER"
1200 END
1210 END
1215 REM LINE 1220 & 1230 ALLOWS ENTRY I
NTO ACCOUNTING MENU ON A PASSWORD PRIVIL
EDGE. KEEP THIS FEATURE UNTIL FINAL PROD
                                    UCTION
1220 REM GOSUB 1050:IF R1$=X1$ THEN RETU
     RN ELSE IF X1$=C1$ OR PFC THEN 1220
1230 REM IF I$<>PW$ THEN PRINT CL$:V=12:
H=12:GOSUB 240:PRINT "PASSWORD ENTRY INV
ALID";:FOR X=1 TO 13:PRINT B$;:NEXT:RETU
                                      RN
1240 IF OF$<>"O" THEN GOTO 1460 ELSE PRI
NT CL$;B$:I$=" CAUTION - CAUTION - CAUTI
ON - CAUTION - CAUTION ":GOSUB 290:V=12:
                                H=1:GOSUB 24
0:PRINT"A BINGO SESSION IS STILL IN PROG
RESS. DO YOU WANT TO END THE SESSION? (Y
                                      /N)"
1250 XL=1:YL=13:AH=90:AL=59:L=1:GOSUB 12
                                          0
1260 IF I$="N" THEN RETURN ELSE IF I$<>"
                                Y"THEN RETURN
1270 GOSUB 1280:GOTO 1460
1280 OPEN"R",#1,"CASHIER.DAT",33
1290 FIELD #1,2 AS T1$,2 AS T2$
1300 RSET T1$=MKI$(RN%):LSET T2$="C"
1310 PUT #1,1
1320 CLOSE#1:RETURN
1330 IF OF$="C" THEN GOTO 1390 ELSE GOSU
B 1050:IF X$=R1$ THEN RETURN ELSE IF C1$
                        =X$ OR PFC THEN 1330
1340 IF I$<>PW$ THEN PRINT CL$:V=12:H=12
:GOSUB 240:PRINT "PASSWORD ENTRY INVALID
  ";:FOR X=1 TO 13:PRINT B$;:NEXT:RETURN
1350 PRINT CL$;B$:I$=" CAUTION - CAUTION
 - CAUTION - CAUTION - CAUTION ":GOSUB 2
90:V=12:H=1:GOSUB 240:PRINT"A BINGO SESS
                                ION IS STILL
 IN PROGRESS. DO YOU WANT TO END THE SES
                                SION? (Y/N)"
1360 XL=1:YL=13:AH=90:AL=59:L=1:GOSUB 12
                                          0
1370 IF I$="N" THEN RETURN ELSE IF I$<>"
                                Y"THEN RETURN
1380 GOSUB 1280
1390 PRINT CL$:V=12:H=15:GOSUB 240:PRINT
 "PRESS RETURN TO EXIT TO SYSTEM: ";:AH=
        13:AL=13:L=1:YL=V:XL=48:GOSUB 120
1400 IF X$=R1$ THEN RETURN ELSE IF X$=C1
                        $ OR PFC THEN 1390
1410 PRINT CL$:V=12:H=1:GOSUB 240:PRINT"
PLEASE REMOVE THE DISKETT FROM THE DRIVE
          PRIOR TO TURNING THE POWER OFF"
1420 V=23:H=1:GOSUB 240:SYSTEM
1430 GOSUB 1050:IF X$=R1$ THEN RETURN EL
            SE IF X$=C1$ OR PFC THEN 1430
1440 IF I$<>PW$ THEN PRINT CL$:V=12:H=12
:GOSUB 240:PRINT "PASSWORD ENTRY INVALID
  ";:FOR X=1 TO 13:PRINT B$;:NEXT:RETURN
1450 RETURN
1460 PRINT CL$:V=12:H=22:GOSUB 240:PRINT
     "WAIT...LOADING ACCOUNTING MENU ";
1470 RUN"ACOUNT-1"
1480 END
1490 REM ON ERROR GOTO 15050
1500 OPEN"I",#1,"PRICE.DAT"
1510 INPUT#1,VC$,BN$,BS$,PW$,KPW$,MP,UR,
                US,UB,DB%,DB,DP,IBW%,BM$
1520 CLOSE#1
1530 OPEN "R",#1,"CASHIER.DAT",33
1540 FIELD #1, 2 AS T1$,2 AS OF$
1550 GET #1,1:RN%=CVI(T1$):OF$=LEFT$(OF$
                                      ,1)
1560 CLOSE#1
1565 GOSUB 330
1570 PRINT CL$:I$=" MAIN MENU ":GOSUB 29
                                          0
1580 PRINT:PRINT TAB(35);"BINGOTECH":PRI
NT TAB(18)"COPYRIGHT BY SELECTRO-VISION,
 LTD. FEB. 1984":PRINT TAB(34);"VERSION
                                    1.0.2"
1590 V=7:H=1:GOSUB 240:PRINT"1. MANAGER"
1600 PRINT"2. CASHIER"
1610 PRINT"3. ACCOUNTING"
1620 PRINT"4. SET CURRENT DATE AND TIME"
1630 PRINT"5. EXIT TO SYSTEM"
1640 V=13:H=1:GOSUB 240:PRINT"SELECT ONE
                                      : ";
1650 XL=13:YL=V:L=1:AH=53:AL=49:GOSUB 12
                                          0
1660 IF X$=R1$ OR X$=C1$ THEN 1640 ELSE
                        IF PFC THEN 1640
```

```
1670 ON VAL(I$) GOSUB 1160,1130,1220,790
                                    ,1330
1680 GOTO 1570

1 REM MANAGER.BAS

3 GOTO 10
7 KILL"MANAGER.BAK":NAME"MANAGER.BAS" AS
        "MANAGER.BAK":SAVE"MANAGER":END
8 SAVE"MANAGER",A:END
10 CLEAR:DIM GS%(16,4),PD%(15,3),PC(15),
M$(12),D$(7),T(12),OFFSET(45),SCHED%(16,
4),WINTAB%(255),REGSPEC%(16),NM$(45),PO(
                                16,4,3),PA(2'
5),PR$(15),PT%(64)
80 OPEN "I",#1,"VRBL.DAT":INPUT#1,LI$,SP
$,C1$,R1$,BA$,ESC$,B$,E4$,E3$,E2$,E1$,E5
$,T$,CARD$,REG$,SPEC$,ENT$,PO$,CUST$,IB$
                                ,OS$,PR$,P$,
C$,MN1$,MN2$,MN3$,MN4$,MN5$,MN6$,MN7$,MN
  8$,MN9$,MN10$,MN11$,MN12$,MN13$,MN14$
90 FOR X=1 TO 12:INPUT#1,M$(X):NEXT:FOR
X=1 TO 7:INPUT#1,D$(X):NEXT:CLOSE#1:CL$=
                        CHR$(26):GOTO 4910
100 PRINT CL$:V=12:H=20:GOSUB 600:PRINT
          "WAIT... SAVING DATA":RETURN
200 FC=1:V=YL:H=XL:GOSUB 600:PRINT STRIN
G$(LEN(I$),32):V=19:H=1:GOSUB 600:PRINT
STRING$(20,42);" FUNCTION CODES ";STRING
                                $(20,42)
210 IF GF=1 THEN 250
220 PRINT"1. GO BACK TO LAST ENTRY":PRIN
T"2. DONE - RETURN TO MENU":PRINT"SELECT
                                  ONE: ";
240 RETURN
250 PRINT"1. ACCEPT PATTERN":PRINT"2. SA
VE FORMAT PATTERNS":PRINT"3. EXIT TO MEN
                                       U"
260 PRINT"SELECT ONE: ";
270 RETURN
280 OPEN"R",#1,"FORMAT.NAM",18:FIELD#1,1
          6 AS NAM$,2 AS COUNT$:RETURN
400 I$="":PFC=0
410 X$=INPUT$(1)
420 IF FC THEN FC=0:GOSUB 2340:IF X$="'"
 THEN X$=C1$:RETURN ELSE IF ASC(X$)=127
THEN X$=R1$:RETURN ELSE IF GF =1 AND ASC
                                (X$)=0  THEN
 X$=T$:RETURN ELSE PFC=1:RETURN
430 IF X$=CHR$(13) THEN RETURN
440 IF X$=BA$ THEN IF LEN(I$)=0 THEN GOT
O 410 ELSE I$=LEFT$(I$,LEN(I$)-1):PRINT
                        BA$;SP$;BA$;:GOTO 410
450 IF X$=ESC$ AND NFC=0 THEN GOSUB 2340
                        :GOSUB 200:GOTO 400
460 IF ASC(X$)<AL OR ASC(X$) > AH THEN P
                        RINT B$;:GOTO 410
470 IF AL=46 THEN IF X$="/" THEN PRINT B
                                       $;
480 IF LEN(I$)=L THEN PRINT B$;:GOTO 410
                        ELSE I$=I$+X$
490 IF P THEN PRINT "*"; ELSE PRINT X$;
500 GOTO 410
510 GOSUB 3700:GOSUB 280:GOSUB 3750:T2=4
2:I$=" FORMAT LIBRARY ":GOSUB 620:LPRINT
"":LPRINT"NUMBER  NAME";SPC(15);"PATTE
                                R VALUE":LPR
INT" "
550 FOR X=1 TO 45:GET#1,X:LPRINT TAB(3);
X;TAB(9);NAM$;TAB(30);COUNT$:NEXT:CLOSE#
                                1:GOSUB 3610
580 RETURN
600 Y$=CHR$(31+V):X1$=CHR$(31+H):PRINT E
SC$="  ":PRINT ESC$=";Y$;X1$;LI$:PRINT
                        ESC$=";Y$;X1$;
610 RETURN
620 T1=LEN(I$):T1=20-INT((T1/2)+.05):LPR
INT STRING$(T1,T2);I$;:IF LEN(I$)+T1+T1>
                        40 THEN T1=T1-1
630 LPRINT STRING$(T1,T2)
640 RETURN
650 T1=0:E=T1:FOR Z=1 TO LEN(I$):IF MID$
  (I$,Z,1)="." THEN T1=T1+1:T3=LEN(I$)-Z
670 IF T1>1 THEN Z=LEN(I$):E=1
680 NEXT:IF T3>2 THEN E=1
690 RETURN
700 E=0:IF ASC(I$)<>80 THEN PRINT B$;:E=
1:RETURN ELSE IF LEN(I$)=1 THEN E=1:PRIN
                                T B$;:RETURN
710 I$=RIGHT$(I$,LEN(I$)-1):FOR Y=LEN(I$
) TO 1 STEP -1:IF ASC(MID$(I$,Y,1))>57 A
ND ASC(MID$(I$,Y,1))<91 THEN E=1:Y=1:PRI
                                NT B$;
730 NEXT:RETURN
740 PRINT CL$:V=1:H=1:GOSUB 600:T1=LEN(I
$):T1=INT(T1/2):T1=38-T1:PRINT STRING$(T
                1,127);I$;STRING$(T1,127)
760 RETURN
770 CT$=BS$:H$=LEFT$(BS$,2):MN$=MID$(BS$
,4,2):PM$=RIGHT$(BS$,2):I$=MN2$:GOSUB 74
                                        0
790 H=1:V=12:GOSUB 600:PRINT C$"HOUR ";H
                                        $
800 H=1:V=4:GOSUB 600:PRINT ENT$;"HOUR:
 ";:YL=V:XL=12:L=2:AH=57:AL=48:GOSUB 400
810 IF X$=R1$ THEN 980 ELSE IF X$=C1$ OR
                        PFC THEN 800
820 IF LEN(I$)=0 THEN PRINT H$:GOTO 850
        ELSE IF LEN(I$)=1 THEN I$="0"+I$
830 IF VAL(I$)<1 OR VAL(I$)>12 THEN PRIN
                        T B$:GOTO 790
840 H$=I$
850 H=1:V=12:GOSUB 600:PRINT C$"MINUTE "
                                      ;MN$
860 V=6:H=1:GOSUB 600:PRINT ENT$;"MINUTE
S: ";:YL=V:XL=16:L=2:AH=57:AL=48:GOSUB 4
                                        00
870 IF X$=R1$ THEN 980 ELSE IF X$=C1$ TH
EN H=1:GOSUB 600:GOTO 790 ELSE IF PFC TH
                                EN 860
880 IF LEN(I$)=0 THEN PRINT MN$:GOTO 910
890 MN$=I$:IF LEN(I$)=1 THEN MN$="0"+MN$
900 IF VAL(MN$)>59 THEN PRINT B$:GOTO 85
                                        0
910 H=1:V=12:GOSUB 600:PRINT C$;PM$
920 V=8:H=1:GOSUB 600:PRINT ENT$;"AM/PM:
 ";:YL=V:XL=14:L=2:AH=89:AL=65:GOSUB 400
930 IF X$=R1$ THEN 980 ELSE IF X$=C1$ TH
EN H=1:GOSUB 600:GOTO 850 ELSE IF PFC TH
                                EN 920
940 IF LEN(I$)=0 THEN I$=PM$:PRINT I$
950 IF I$ <>"AM" AND I$ <> "PM" THEN PRI
                        NT B$:GOTO 920
960 PM$=I$
970 V=12:H=1:GOSUB 600:PRINT PR$;:L=1:AH
=13:AL=13:YL=V:XL=18:GOSUB 400:IF X$=R1$
 THEN 980 ELSE IF X$=C1$ THEN H=1:GOSUB
                        600: GOTO 91
0 ELSE IF PFC THEN 970
980 BS$=H$+":"+MN$+" "+PM$
990 REM ON ERROR GOTO ******** TBD *****
                                      ****
1000 GOSUB 3040:RETURN
1070 IF X=1 THEN 1140
1080 X=X-1:IF X=0 AND T=1 THEN X=1:GOTO
                                      1110
1090 IF X<>0 THEN RETURN
1100 X=X+1:T=T-1
1110 V=8:H=1:GOSUB 600
1120 V=4:H=1:GOSUB 600:PRINT"GAME NO. "T
1130 V=13:H=1:GOSUB 600:PRINT C$"GAME: "
;:IF REGSPEC%(T)=1 THEN PRINT"SPECIAL" E
                        LSE PRINT "REGULAR"
1140 V=7:H=1:GOSUB 600:V=6:H=1:GOSUB 600
:PRINT"REGULAR OR SPECIAL (R/S): ";:AH=9
        0:AL=58:L=1:XL=27:YL=V:GOSUB 400
1150 IF X$=R1$ THEN X=4:RETURN ELSE IF X
$=C1$ THEN T=T-1:IF T=0 THEN T=1:GOTO 11
                        20 ELSE GOTO 1120
1160 IF PFC THEN 1140
1170 V=4:H=1:GOSUB 600:PRINT"GAME NO.: "
T;SPC(15);:IF LEN(I$)=0 THEN IF REGSPEC%
(T)=1 THEN PRINT"SPECIAL GAME":GOTO 1200
                        ELSE PRINT"
REGULAR GAME":GOTO 1200
```

```
1180 IF I$<>"R" AND I$<>"S" THEN PRINT B
                                    $:GOTO 1140
1190 IF I$="R" THEN REGSPEC%(T)=0:PRINT".
REGULAR GAME" ELSE REGSPEC%(T)=1:PRINT"S
                                  PECIAL GAME"
1200 RETURN
1210 I$=" "+ENT$+"MINIMUM SALE ":GOSUB 7
                                        40
1220 V=13:H=1:GOSUB 600:PRINT C$;P$;"FOR
      MINIMUM SALE:";:PRINT USING E3$;MP
1230 V=5:H=1:GOSUB 600:PRINT P$;BA$;":";
TAB(27);:AL=46:AH=57:L=6:YL=5:XL=25:GOSU
                                        B 400
1240 IF X$=C1$ THEN V=5:H=1:GOSUB 600:GO
TO 1220 ELSE IF X$=R1$ THEN 1840 ELSE IF
                                  PFC THEN 1230
1250 IF LEN(I$)=0 THEN PRINT STRING$(3,8
      );:PRINT USING E3$;MP:GOTO 1270
1260 GOSUB 650:IF E THEN PRINT B$:GOTO 1
                                  230 ELSE MP=VAL(I$)
1270 V=13:H=1:GOSUB 600:PRINT"PRESS 'RET
      URN' ";:AH=13:AL=AH:L=1:GOSUB 400
1280 IF X$=C1$ THEN 1220 ELSE IF X$=R1$
       THEN 1840 ELSE IF PFC THEN 1270
1290 I$=" "+ENT$+P$+"FOR BINGO CARDS ":G
                                    OSUB 740
1300 V=13:H=1:GOSUB 600:PRINT C$;P$;"FOR
        "REG$CARD$;:PRINT USING E3$;UR
1310 V=3:H=1:GOSUB 600:PRINT REG$;CARD$;
BA$;":  ";:AL=46:AH=57:L=6:YL=3:XL=17:GO
                                    SUB 400
1320 IF X$=R1$ THEN 1840 ELSE IF X$=C1$
       THEN 1210 ELSE IF PFC THEN 1290
1330 IF LEN(I$)=0 THEN PRINT USING E3$;U
                                  R:GOTO 1350
1340 GOSUB 650:IF E THEN PRINT B$:GOTO 1
                                  310 ELSE UR=VAL(I$)
1350 V=13:H=1:GOSUB 600:PRINT C$;P$"FOR
      ";SPEC$;CARD$;:PRINT USING E3$;US
1360 V=4:H=1:GOSUB 600:PRINT SPEC$;CARD$
;BA$;":  ";:AL=46:AH=57:L=6:YL=4:XL=17:G
                                    OSUB 400
1370 IF X$=R1$ THEN 1840 ELSE IF X$=C1$
THEN V=4:H=1:GOSUB 600:GOTO 1300 ELSE IF
                                  PFC THEN 1360
1380 IF LEN(I$)=0 THEN PRINT USING E3$;U
                                  S:GOTO 1400
1390 GOSUB 650:IF E THEN PRINT B$:GOTO 1
                                  360 ELSE US=VAL(I$)
1400 V=13:H=1:GOSUB 600:V=7:GOSUB 600:PR
INT"PRESS 'RETURN'":AL=13:AH=13:L=1:YL=5
                                  :XL=9:GOSUB 400
1410 IF X$=R1$ THEN 1840 ELSE IF X$=C1$
THEN V=7:H=1:GOSUB 600:GOTO 1350 ELSE IF
                                  PFC THEN 1400
1450 I$=" "+ENT$+IB$+P$:GOSUB 740
1460 V=13:H=1:GOSUB 600:PRINT C$;P$;:PRI
                                  NT USING E3$;UB
1470 V=4:H=1:GOSUB 600:PRINT ENT$"UNIT "
P$;BA$;":  ";:AL=46:AH=57:L=6:YL=4:XL=20
                                  :GOSUB 400
1480 IF X$=C1$ THEN 1290 ELSE IF X$=R1$
       THEN 1840 ELSE IF PFC THEN 1450
1490 IF LEN(I$)=0 THEN PRINT USING E3$;U
                                  B: GOTO 1510
1500 GOSUB 650:IF E THEN 1450 ELSE UB =V
                                  AL(I$)
1510 V=13:H=1:GOSUB 600:PRINT"PRESS 'RET
      URN'";:AL=13:AH=AL:L=H:GOSUB 400
1520 IF X$=R1$ THEN 1840 ELSE IF X$=C1$
THEN V=13:H=1:GOSUB 600:GOTO 1450 ELSE I
                                  F PFC THEN 1510
1530 V=13:H=1:GOSUB 600:PRINT C$"DISCOUN
 T "P$"."DB%" FOR ";:PRINT USING E3$;DB
1540 V=4:H=1:GOSUB 600:PRINT ENT$"NO. FO
R DISCOUNT:  ";:AL=48:AH=57:L=2:YL=4:XL=
                                  25:GOSUB 400
1550 IF X$=C1$ THEN 1450 ELSE IF X$=R1$
       THEN 1840 ELSE IF PFC THEN 1530
1560 IF LEN(I$)=0 THEN PRINT DB%:GOTO 15
                                        90
1570 DB%=VAL(I$):IF DB%=0 THEN DB%=1:DB=
                                  UB:GOTO 1620
1580 V=13:H=1:GOSUB 600:PRINT C$"DISCOUN
 T "P$"."DB%" FOR ";:PRINT USING E3$;DB
1590 V=5:H=1:GOSUB 600:PRINT ENT$;P$;"
        ";:AL=46:AH=57:L=6:YL=5:XL=26
                                  :GOSUB 400
1600 IF X$=C1$ THEN V=5:H=1:GOSUB 600:GO
TO 1530 ELSE IF X$=R1$ THEN 1840 ELSE IF
                                  PFC THEN 1590
1610 IF LEN(I$)=0 THEN PRINT USING E3$;D
                                  B ELSE DB=VAL(I$)
1620 V=13:H=1:GOSUB 600:PRINT"PRESS RETU
RN";:AH=13:AL=AH:L=1:YL=V:XL=13:GOSUB 40
                                        0
1630 IF X$=C1$ AND DB=UB THEN V=5:H=1:GO
SUB 600:GOTO 1530 ELSE IF X$=C1$ THEN 15
80 ELSE IF X$=R1$ THEN 1840 ELSE IF PFC
                                  THEN 1620
1670 I$=" "+ENT$+IB$+"WIN DATA ":GOSUB 7
                                        40
1680 V=13:H=1:GOSUB 600:PRINT C$"FORMAT:
"IBF%;TAB(24);:GOSUB 280:GET#1,IBF%:PRIN
                                  T NAM$
1690 V=4:H=1:GOSUB 600:PRINT ENT$;IB$;"G
AME FORMAT: ";:AL=48:AH=58:XL=33:YL=V:L=
                                  2:GOSUB 400
1700 IF X$=R1$ THEN CLOSE#1:GOTO 1840 EL
          SE IF X$=C1$ OR PFC THEN 1690
1710 IF LEN(I$)=0 THEN PRINT IBF%:GOTO 1
730 ELSE IF VAL(I$)=0 OR VAL(I$)>45 THEN
                                  PRINT B$:GOTO 1690
1720 IBF%=VAL(I$):GET#1,IBF%:IF NAM$=STR
      ING$(16,42) THEN PRINT B$:GOTO 1690
1730 CLOSE#1
1740 V=13:H=1:GOSUB 600:PRINT C$"VALUE:
                                        ";IBW%
1750 V=5:H=1:GOSUB 600:PRINT ENT$"MAX. N
UMBER OF PUSHES:   ";:AL=48:AH=57:L=2:YL
                                  =5:XL=32:GOSUB 400
1760 IF X$=R1$ THEN 1840 ELSE IF X$=C1$
THEN H=1:V=5:GOSUB 600:GOTO 1680 ELSE IF
                                  PFC THEN 1750
1770 IF LEN(I$)=0 THEN PRINT BA$;IBW% EL
                                  SE IBW%=VAL(I$)
1780 V=13:H=1:GOSUB 600:PRINT C$;"PAYOUT
                                  :";:PRINT USING E4$;IBP
1790 V=6:H=1:GOSUB 600:PRINT ENT$;"PAYOU
T AMOUNT: ";AH=57:AL=48:L=7:YL=V:XL=22:
                                  GOSUB 400
1800 IF X$=C1$ THEN V=6:H=1:GOSUB 600:GO
TO 1740 ELSE IF X$=R1$ THEN 1840 ELSE IF
                                  PFC THEN 1790
1810 IF LEN(I$)=0 THEN PRINT USING E4$;I
                                  BP ELSE IBP=VAL(I$)
1820 V=13:H=1:GOSUB 600:PRINT PR$:AH=13:
          AL=AH:L=1:YL=V:XL=15:GOSUB 400
1830 IF X$=C1$ THEN 1780 ELSE IF PFC THE
                                  N 1820
1840 GOSUB 3040:GOSUB 4400
1850 RETURN
1860 REM.
1870 REM GET CURRENT TIME FROM RTC
1880 REM
1890 FOR N = 12 TO 0 STEP -1
1900 OUT 60,N: OUT 60,16+N: OUT 60,N
1910 OUT 60,64: T(N)= INP(60)-240: OUT 6
                                        0,0: NEXT
1920 IF T(0)=TX THEN GOTO 1890 ELSE TX=T
                                        (0)
1930 MO$=M$((10*T(10))+T(9))
1940 YR=(10*T(12))+T(11)
1950 DA$=STR$((10*T(8))+T(7))
1960 PM = 0 :IF T(5) => 4 THEN T(5) = T(
                                  5) - 4: PM = 1
1970 HR$=STR$((10*T(5))+T(4)):HR$=RIGHT$
(HR$,LEN(HR$)-1):IF LEN(HR$)=1 THEN HR$=
                                        "0"+HR$
1980 MN$=STR$((10*T(3))+T(2)):MN$=RIGHT$
(MN$,LEN(MN$)-1):IF LEN(MN$)=1 THEN MN$=
                                        "0"+MN$
1990 SEC$=STR$((10*T(1))+T(0)):SEC$=RIGH
T$(SEC$,LEN(MN$)-1):IF LEN(SEC$)=1 THEN
                                  SEC$="0"+SEC$
```

```
2000 RETURN
2040 I$=MN1$:GOSUB 740
2050 PRINT:PRINT"PLEASE ENTER TODAY'S VA
LIDITY CODE": PRINT:PRINT STRING$(15,45)
;STRING$(16,8);:AL=32:AH=90:L=16:YL=5:XL
=1:GOSUB 400
2080 IF X$=R1$ THEN RETURN ELSE IF X$=C1
$ THEN 2040
2090 VC$=I$
2100 REM ON ERROR GOTO ****************
2110 GOSUB 3040
2130 RETURN
2170 I$=MN8$:GOSUB 740
2180 V=12:H=1:GOSUB 600:PRINT C$"DISCOUN
T PERCENT :";DP;"%"
2190 V=3:H=1:GOSUB 600:PRINT"PLEASE ENTE
R THE DISCOUNT PERCENT  :";:AL=48:AH=57:
L=2:YL=3:XL=35:GOSUB 400
2200 IF X$=R1$ THEN RETURN ELSE IF X$=C1
$ OR PFC THEN 2190
2210 DP=VAL(I$)
2220 GOSUB 3040:RETURN
2260 I$=MN4$:GOSUB 740
2270 V=12:H=1:GOSUB 600:PRINT "ENTER PAS
SWORD KEY ";:AL=33:AH=126:L=4:P=1:GOSUB
400:P=0
2300 RETURN
2340 V=19:H=1:GOSUB 600:FOR Y=1 TO 5:PRI
NT LI$:NEXT:V=YL:H=XL:GOSUB 600
2350 RETURN
2390 I$=LEFT$(MN6$,LEN(MN6$)-1)+"S ":GOS
UB 740
2400 V=13:H=1:GOSUB 600:PRINT C$"NUMBER
OF PACKAGE DEALS: "NP%
2420 V=3:H=1:GOSUB 600:PRINT"ENTER NO.'O
F PACKAGE DEALS ";:AH=57:AL=48:L=2:YL=3:
XL=28:GOSUB 400:REM GET INPUT
2450 IF X$=C1$ OR PFC THEN 2420 ELSE IF
X$=R1$ THEN 2810
2460 IF LEN(I$)=0 THEN PRINT BA$;NP%:T1=
NP% ELSE T1=VAL(I$)
2470 IF T1>15 THEN V=13:H=1:GOSUB 600:PR
INT"MAXIMUM NUMBER IS 15":PRINT:INPUT"PR
ESS RETURN TO CONT. ",X$
2480 IF T1=0 THEN V=13:H=1:GOSUB 600:PRI
NT B$"NO PACKAGE DEALS SELECTED.. IS THIS
 CORRECT? (Y/N): ";:X$=INPUT$(1):IF X$="
Y" THEN NP%=
0:GOTO 2810 ELSE IF X$="N" THEN 2400 ELS
E GOTO 2480
2490 NP%=T1
2500 PRINT
2510 FOR X=1 TO NP%
2520 I$=MN6$+"NO."+STR$(X)+" ":GOSUB 740
2530 V=13:H=1:GOSUB 600:PRINT C$"NO. OF
";REG$;CARD$;PD%(X,1)
2540 V=3:H=1:GOSUB 600:PRINT"ENTER NO. O
F ";REG$;CARD$;"    ";:AH=60:AL=48:L=3:YL
=3:XL=32:GOSUB 400
2550 IF X$=C1$ AND X<>1 THEN X=X-1:GOTO
2520 ELSE IF X$=C1$ THEN X=NP%:GOTO 2800
2560 IF X$=R1$ THEN X=NP%:GOTO 2800 ELSE
IF PFC THEN 2540
2570 IF LEN(I$)=0 THEN PRINT BA$;PD%(X,1
):GOTO 2590 ELSE IF ASC(I$)>57 THEN GOSU
B 700: IF E THEN PRINT B$;:GOTO 2520 ELS
E IF VAL(I$)
=0 OR VAL (I$)>NP% THEN PRINT B$;:GOTO 2
520 ELSE X=VAL(I$):GOTO 2520
2580 PD%(X,1)=INT(VAL(I$))
2590 V=13:H=1:GOSUB 600:PRINT C$"NO. OF
";SPEC$;CARD$;PD%(X,2)
2600 V=5:H=1:GOSUB 600:PRINT ENT$;"NO. O
F ";SPEC$;CARD$;"    ";
2610 AL=47:AH=57:YL=5:XL=32:GOSUB 400
2620 IF X$=C1$ THEN V=5:H=1:GOSUB 600:GO
TO 2520
2630 IF X$=R1$ THEN X=NP%:GOTO 2800
2640 IF LEN(I$)=0 THEN PRINT BA$;PD%(X,2
) ELSE PD%(X,2)=VAL(I$)
2650 V=13:H=1:GOSUB 600:PRINT C$"NO. OF
";IB$;PD%(X,3);
2660 V=7:H=1:GOSUB 600:PRINT ENT$;"NO. O
F ";IB$;"    ";
2670 AL=47:AH=57:L=3:YL=7:XL=32:GOSUB 40
0
2680 IF X$=C1$ THEN PRINT:V=6:H=1:GOSUB
600:V=7:GOSUB 600:GOTO 2590
2690 IF X$=R1$ THEN X=NP%:GOTO 2800
2700 IF LEN(I$)=0 THEN PRINT BA$;PD%(X,3
) ELSE IF VAL(I$)>255 THEN PRINT B$;:GOT
O 2650 ELSE PD%(X,3)=VAL(I$)
2710 V=13:H=1:GOSUB 600:PRINT C$;P$"OF P
ACKAGE DEAL NO."X;:PRINT USING E4$;PC(X)
;
2720 V=9:H=1:GOSUB 600:PRINT ENT$;P$"FOR
THIS PACKAGE DEAL $ ";
2730 AL=46:AH=57:L=6:YL=9:XL=37:GOSUB 40
0
2740 IF X$=C1$ THEN V=9:H=1:GOSUB 600:GO
TO 2650
2750 IF X$=R1$ THEN X=NP%:GOTO 2800
2760 GOSUB 650:IF E THEN PRINT B;:GOTO 2
720
2770 IF LEN(I$)=0 THEN PRINT BA$;:PRINT
USING E5$;PC(X) ELSE PC(X)=VAL(I$)
2780 V=13:H=1:GOSUB 600:PRINT PR$;:AL=13
:AH=13:L=1:GOSUB 400:IF X$=C1$ THEN GOSU
B 600:GOTO 2710 ELSE IF X$=R1$ THEN X=NP
%: GOTO 2800
2790 V=3:H=1:GOSUB 600:FOR Y=1 TO 7:PRIN
T LI$:NEXT:V=13:GOSUB 600
2800 NEXT
2810 IF X$=C1$ THEN GOTO 2390
2820 GOSUB 100
2830 REM ON ERROR GOTO ***** TBD *******
2840 OPEN "R",#1,"PKDEALS.DAT",10
2850 FIELD #1, 10 AS T1$
2860 LSET T1$=MKI$(NP%)
2870 PUT #1,1
2880 FIELD #1, 2 AS T1$, 2 AS T2$, 2 AS
T3$, 4 AS T4$
2890 FOR X=1 TO 15
2900 LSET T1$=MKI$(PD%(X,1)):LSET T2$=MK
I$(PD%(X,2)):LSET T3$=MKI$(PD%(X,3)):LSE
T T4$=MKS$(PC(X))
2910 PUT #1, INT(X+1)
2920 NEXT
2930 CLOSE#1:PRINT FRE("")
2940 RETURN
2950 P=1:GOSUB 2260
2960 IF X$=C1$ OR X$=R1$ THEN RETURN
2970 IF I$ <> KPW$ THEN PRINT CL$:V=12:H
=1:GOSUB 600:PRINT STRING$(25,32);"PASSW
ORD KEY INVALID ";:FOR X= 1 TO 10:PRINT
B$;:NEXT:RET
URN
2980 PRINT CL$:V=13:H=1:GOSUB 600:PRINT
"PLEASE ENTER THE NEW PASSWORD ";:P=1:AH
=126:AL=32:L=4:GOSUB 400
2990 IF X$=C1$ THEN GOTO 2980 ELSE IF X$
=R1$ THEN P=0:RETURN
3000 PW$=I$
3040 REM ON ERROR GOTO ******** TBD ****
*****
3050 OPEN "O",#1,"PRICE.DAT":GOSUB 100
3070 WRITE#1,VC$;BN$;BS$;PW$;KPW$;MP;UR;
US;UB;DB%;DB;DP;IBW%;BM$;IBF%;IBP
3080 CLOSE #1:X=FRE("")RETURN
3120 PRINT CL$:I$=" ENTER NAME OF ESTABL
ISHMENT ":GOSUB 740:REM PRINT HEADER ON
SCREEN
3130 V=12:H=1:GOSUB 600:PRINT C$"COMPANY
/BUSINESS NAME: ";BN$
3140 V=3:H=1:GOSUB 600:PRINT"PLEASE ENTE
R THE NAME OF YOUR COMPANY/BUSINESS ":PR
INT:PRINT STRING$(32,45);STRING$(32,8);
3150 AH=90:AL=32:L=32:YL=5:XL=1:GOSUB 40
0
3160 IF X$=R1$ THEN 3210 ELSE IF X$=C1$
OR PFC THEN 3140
3170 IF LEN(I$)=0 THEN PRINT BN$:GOTO 31
90
3180 BN$=I$
```

```
3190 V=12:H=1:GOSUB 600:PRINT PR$;:XL=16
        :YL=V:L=1:AH=13:AL=13:GOSUB 400
3200 IF X$=C1$ THEN 3130 ELSE IF PFC THE
                                    N 3190
3210 GOSUB 3040:REM SAVE BUSINESS FILE
3220 RETURN
3230 REM
3240 REM  PRINT BINGO DATA
3250 REM
3260 GOSUB 3700
3270 GOSUB 3750
3280 T2=32:I$=" BINGO DATA SUMMARY ":GOS
                          UB 620:LPRINT " "
3290 T2=42:I$=" BINGO PRICES ":GOSUB 620
:LPRINT" ":LPRINT"DISCOUNT PERCENTAGE
                                    ";DP"%"
3300 LPRINT P$;"FOR MINIMUM SALE      ";
                        :LPRINT USING E4$;MP
3310 LPRINT" ":LPRINT"UNIT ";P$;"FOR REG
        ULAR CARDS";:LPRINT USING E4$;UR
3320 LPRINT"UNIT ";P$;"FOR SPECIAL CARDS
                    ";:LPRINT USING E4$;US
3330 LPRINT" ":I$=" "+IB$+"DATA ":GOSUB
                              620:LPRINT" "
3340 LPRINT USING E2$;1;:LPRINT" FOR ";:
LPRINT USING E3$;UB;:LPRINT"  OR ";:LPRI
NT USING E2$;DB%;:LPRINT" FOR ";:LPRINT
                                USING E3$;DB
:LPRINT" "
3350 LPRINT IB$"FORMAT:  ";:GOSUB 280:GE
            T#1,IBF%:LPRINT NAM$:CLOSE#1
3360 LPRINT"NO. OF PUSHES FOR WIN: ";IBW
%:LPRINT"PAYOUT AMOUNT:";:LPRINT USING
                                    E4$;IBP
3370 LPRINT" ":T2=42:I$=" PACKAGE DEAL D
                              ATA ":GOSUB 620
3380 LPRINT" ":LPRINT"     TOTAL NUMBER
                    OF PACKAGE DEALS "NP%
3390 LPRINT" ":IF NP%<1 THEN GOTO 3470
3400 FOR X=1 TO NP%
3410 LPRINT"        PACKAGE DEAL NO."X
3420 IF PD%(X,1)>0 THEN LPRINT "REGULAR
        CARDS";:LPRINT USING E2$;PD%(X,1)
3430 IF PD%(X,2)>0 THEN LPRINT "SPECIAL
        CARDS";:LPRINT USING E2$;PD%(X,2)
3440 IF PD%(X,3)>0 THEN LPRINT "INSTANT
        BINGO";:LPRINT USING E2$;PD%(X,3)
3450 LPRINT P$"     ";:LPRINT USING E4$;P
                                    O(X)
3460 LPRINT" ":NEXT
3470 LPRINT STRING$(10,42);" GAME SCHEDU
                LE DATA ";STRING$(10,42)
3480 LPRINT" ":LPRINT"R/S GAM LEV   FORM
        AT NAME       PAYOUTS":LPRINT" "
3490 GOSUB 280
3500 FOR X= 1 TO NG%
3510 FOR Y= 1 TO 4
3520 IF GS%(X,Y)=0 THEN Y=4:GOTO 3560
3530 GET#1,GS%(X,Y):LPRINT " "CHR$(32+RE
GSPEC%(X));TAB(6);:LPRINT USING "##";X;:
            :LPRINT TAB(9);Y;TAB(13);NAM$;
3540 FOR Z=1 TO 3:IF PO(X,Y,Z)>0 THEN LP
RINT TAB(30);Z"-";:LPRINT USING  E5$;PO(
                                    X,Y,Z)
3550 NEXT:LPRINT " "
3560 NEXT:T2=32:I$=STRING$(20,"-"):GOSUB
                620:LPRINT" ":NEXT:CLOSE#1
3570 GOSUB 3610:RETURN
3580 REM
3590 REM       EJECT PRINTER PAPER
3600 REM
3610 GOSUB 1890:REM GET DATE & TIME FROM
                                    RTC
3620 LPRINT" ":LPRINT D$(T(6));": ";MO$;
                    DA$;",";YR+1900;"    ";
3630 IF LEFT$(HR$,1)="0" THEN HR$=RIGHT$
                                    (HR$,1)
3640 LPRINT HR$;":";MN$;":";SEC$;:IF PM
   =1 THEN LPRINT " PM" ELSE LPRINT" AM"
3650 FOR X=1 TO 8:LPRINT" ":NEXT
3660 RETURN
3700 PRINT CL$:V=12:H=1:GOSUB 600:PRINT
"CHECK PRINTER FOR PROPER ALIGNMENT":PRI
NT:PRINT PR$:AH=13:AL=13:L=1:GOSUB 400:I
                                F X$=R1$ OR
X$=C1$ THEN RETURN ELSE IF PFC THEN 3700
3710 PRINT CL$:H=23:V=12:GOSUB 600:PRINT
        "WAIT...PRINTING DATA ";:RETURN
3750 I$=BN$:T2=32:GOSUB 620:I$=BM$:GOSUB
            620:LPRINT" ":X=FRE(""):RETURN
3790 PRINT CL$:I$=MN7$:GOSUB 740
3800 T=1
3810 V=4:H=1:GOSUB 600:PRINT"GAME NO.: "
                                        ;T
3820 V=13:H=1:GOSUB 600:PRINT C$"GAME: "
;:IF REGSPEC%(T)=1 THEN PRINT"SPECIAL" E
                        LSE PRINT "REGULAR"
3830 V=6:H=1:GOSUB 600:PRINT"REGULAR OR
SPECIAL (R/S): ";:AH=90:AL=58:L=1:XL=27:
                                YL=V:GOSUB 400
3840 IF X$=R1$ THEN 4170 ELSE IF X$=C1$
THEN T=T+1:IF T=0 THEN T=1:GOTO 3810 ELS
                                E GOTO 3810
3850 IF PFC THEN 3830
3860 IF LEN(I$)=0 THEN GOTO 3890
3870 IF I$<>"R" AND I$<>"S" THEN PRINT B
                                $:GOTO 3820
3880 IF I$="R" THEN REGSPEC%(T)=0 ELSE R
                                EGSPEC%(T)=1
3890 V=4:H=1:GOSUB 600:PRINT"GAME NO.:
"T;SPC(15);:IF REGSPEC%(T)=1 THEN PRINT"
  SPECIAL GAME" ELSE PRINT"REGULAR GAME"
3900 FOR X=1 TO 4
3910 V=13:H=1:GOSUB 600:PRINT C$"FORMAT:
 ";GS%(T,X);TAB(24);SPC(8);"NAME: ";NM$(
                                GS%(T,X))
3920 V=6:H=1:GOSUB 600:PRINT"LEVEL NO.:
                                        ";X
3930 V=7:H=1:GOSUB 600:PRINT ENT$;"FORMA
T NO.: ";:AL=48:AH=80:L=3:YL=V:XL=18:GOS
                                UB 400
3940 IF X$=R1$ THEN X=4:GOTO 4160
3950 IF X$=C1$ THEN GOSUB 1070:IF X$=R1$
                THEN 4160 ELSE GOTO 3910
3960 IF LEN(I$)=0 THEN PRINT GS%(T,X):IF
 GS%(T,X)=0 THEN FOR Y=X TO 4:GS%(T,Y)=0
:FOR Z=1 TO 3:PO(T,Y,Z)=0:NEXT:NEXT:X=4:
                                GOTO 4160 EL
SE 4010
3970 IF ASC(I$)>57 THEN V=7:H=1:GOSUB 60
0:GOSUB 700:IF E THEN PRINT B$;:GOTO 392
0 ELSE IF VAL(I$)>16 OR VAL(I$)<1 THEN P
                                RINT B$;:GOT
O 3920 ELSE T=VAL(I$):GOTO 3810
3980 IF VAL(I$)>45 THEN PRINT B$;:GOTO 3
                                        920
3990 IF NM$(VAL(I$))=STRING$(16,42) THEN
                        PRINT B$:GOTO 3910
4000 GS%(T,X)=VAL(I$):IF VAL(I$)=0 THEN
FOR Y= X TO 4:GS%(T,Y)=0:FOR Z=1 TO 3:PO
        (T,Y,Z)=0:NEXT:NEXT:X=4:GOTO 4160
4010 V=13:H=1:GOSUB 600:PRINT C$"1ST PLA
CE PAYOUT AMOUNT:";:PRINT USING E4$;PO(T
  ,X,1);:PRINT "   NAME: ";NM$(GS%(T,X))
4020 V=8:H=1:GOSUB 600:PRINT "ENTER 1ST
PLACE PAYOUT: ";:AL=46:AH=58:L=7:YL=V:XL
                                =25:GOSUB 400
4030 IF X$=R1$ THEN X=4:GOTO 4160 ELSE I
F PFC THEN 4020 ELSE IF X$=C1$ THEN H=1:
                        GOSUB 600:GOTO 3910
4040 IF LEN(I$)=0 THEN PRINT USING E4$;P
                        O(T,X,1):GOTO 4060
4050 GOSUB 650:IF E THEN PRINT B$:GOTO 4
            010 ELSE PO(T,X,1)=VAL(I$)
4060 V=13:H=1:GOSUB 600:PRINT C$"2ND PLA
CE PAYOUT AMOUNT:";:PRINT USING E4$;PO(T
  ,X,2);:PRINT "   NAME: ";NM$(GS%(T,X))
4070 V=9:H=1:GOSUB 600:PRINT "ENTER 2ND
PLACE PAYOUT: ";:AL=46:AH=58:L=7:YL=V:XL
                                =25:GOSUB 400
4080 IF X$=R1$ THEN X=4:GOTO 4160 ELSE I
F PFC THEN 4070 ELSE IF X$=C1$ THEN H=1:
                        GOSUB 600:GOTO 4010
4090 IF LEN(I$)=0 THEN PRINT USING E4$;P
                        O(T,X,2):GOTO 4110
```

```
4100 GOSUB 650:IF E THEN PRINT B$:GOTO 4
                060 ELSE PO(T,X,2)=VAL(I$)
4110 V=13:H=1:GOSUB 600:PRINT C$"3TH PLA
CE PAYOUT AMOUNT:";:PRINT USING E4$;PO(T
  ,X,3);:PRINT "   NAME: ";NM$(GS%(T,X))
4120 V=10:H=1:GOSUB 600:PRINT "ENTER 3RD
 PLACE PAYOUT: ";:AL=46:AH=58:L=7:YL=V:X
                                L=25:GOSUB 400
4130 IF X$=R1$ THEN X=4:GOTO 4160 ELSE I
F PFC THEN 4110 ELSE IF X$=C1$ THEN H=1:
                              GOSUB 600:GOTO 4060
4140 IF LEN(I$)=0 THEN PRINT USING E4$;P
                              O(T,X,3):GOTO 4160
4150 GOSUB 650:IF E THEN PRINT B$:GOTO 4
                120 ELSE PO(T,X,3)=VAL(I$)
4160 FOR Y =8 TO 10:V=Y:H=1:GOSUB 600:NE
                                        XT:NEXT
4170 IF X$<>R1$ THEN T=T+1:IF T<17 THEN
                V=7:H=1:GOSUB 600:GOTO 3810
4190 GOSUB 100:FOR X=1 TO 16:IF GS%(X,1)
                                        >0 THEN NG%=X
4200 NEXT
4210 REM
4220 REM  SAVE GAME SCHEDULE FILE
4230 REM
4240 REM ON ERROR GOTO ********
4250 Z=2:OPEN "R",#1,"GAME.DAT",2
4260 FIELD #1,2 AS T1$
4270 RSET T1$=MKI$(NG%)
4280 PUT #1,1
4290 FOR X=1 TO 16
4300 FOR Y=1 TO 4
4310 RSET T1$=MKI$(GS%(X,Y))
4320 PUT #1,Z
4330 Z=Z+1
4340 NEXT:NEXT:CLOSE#1:T=FRE("")
4350 OPEN"O",#1,"REG/SPEC":FOR X=1 TO 16
      :WRITE#1,REGSPEC%(X):NEXT:CLOSE#1
4360 OPEN"O",#1,"PAYOUT":FOR X=1 TO 16:F
OR Y=1 TO 4:FOR Z=1 TO 3:WRITE#1,PO(X,Y,
                Z):NEXT:NEXT:NEXT:CLOSE#1
4370 REM
4380 REM  CREATE DOWNLOAD SCHEDULE
4390 REM
4400 FOR X=1 TO 45:OFFSET(X)=255:NEXT:FO
R X=1 TO 16:FOR Y =1 TO 4:SCHED%(X,Y)=25
5:NEXT:NEXT:FOR X=0 TO 255:WINTAB%(X)=0:
                                        NEXT:WTP=0
4410 FORMAT = IBF%:GOSUB 4510
4420 FOR GAME = 1 TO 16:FOR LEVEL=1 TO 4
4430 FORMAT = GS%(GAME,LEVEL):IF FORMAT=
                                        0 THEN 4460
4440 GOSUB 4510
4450 SCHED%(GAME,LEVEL)=OFFSET(FORMAT)+R
                                EGSPEC%(GAME)
4460 NEXT:NEXT
4470 OPEN"O",#1,"SCHEDULE":WRITE#1,ASC("
                                        1")
4480 FOR GAME=1 TO 16:FOR LEVEL=1 TO 4:W
     RITE#1,SCHED%(GAME,LEVEL):NEXT:NEXT
4490 FOR X=0 TO 255:WRITE#1,WINTAB%(X):N
                EXT:CLOSE#1:X=FRE("")
4500 RETURN
4510 IF OFFSET(FORMAT) <> 255 THEN 4540
ELSE OFFSET(FORMAT) = WTP:IF FORMAT<10 T
HEN RN$=RIGHT$(STR$(FORMAT),1) ELSE RN$=
                                RIGHT$(STR$(
FORMAT),2)
4515 OPEN"I",#1,"WINPAT"+RN$:INPUT#1,WIN
TAB%(WTP):FOR X=WTP+1 TO WINTAB%(WTP)*3+
            WTP:INPUT #1,WINTAB%(X):NEXT
4520 IF WINTAB%(WTP) AND 1 THEN 4530 ELS
            E INPUT #1,WINTAB%(X):X=X+1
4530 WTP=X:CLOSE#1
4540 RETURN
4700 PRINT CL$:V=12:H=22:GOSUB 600:PRINT
 "WAIT...LOADING MAIN MENU ";:RUN"BINGO"
4730 I$=" MANAGER'S MENU ":GOSUB 740:PRI
                                        NT
4740 PRINT"1. ";MN1$
4750 PRINT"2. ";MN2$
4770 PRINT"3. ";MN4$
4780 PRINT"4. ";MN5$
4790 PRINT"5. ";MN6$;BA$;"S"
4800 PRINT"6. ";MN7$
4810 PRINT"7. ";MN8$
4820 PRINT"8. ";MN9$
4830 PRINT"9. ";MN10$
4840 PRINT"10.";MN12$
4850 PRINT"11.";MN13$
4860 PRINT"12.";MN3$
4870 PRINT:PRINT "SELECT ONE: ";
4880 P=0:AH=57:AL=48:L=2:YL=17:XL=13:GOS
                                        UB 400
4890 ON VAL(I$) GOSUB 2040,770,2950,1210
  ,2390,3790,2170,3260,5260,510,3120,4700
4900 GOTO 4730
4910 REM ON ERROR GOTO 5210
4920 OPEN "I",#1,"PRICE.DAT"
4930 INPUT#1,VC$,BN$,BS$,PW$,KPW$,MP,UR,
     US,UB,DR%,DR,DP,JRW%,RN$,JRF%,JRP
4940 CLOSE#1
4950 OPEN "R",#1,"PKDEALS.DAT",10
4960 FIELD #1, 2 AS T1$
4970 GET #1,1:NP%=CVI(T1$)
4980 FIELD #1, 2 AS T1$,2 AS T2$, 2 AS T
                                3$, 4 AS T4$
4990 FOR X= 2 TO NP%+1
5000 GET #1,X
5010 PD%(X-1,1)=CVI(T1$):PD%(X-1,2)=CVI(
T2$):PD%(X-1,3)=CVI(T3$):PC(X-1)=CVS(T4$
                                        )
5020 NEXT:CLOSE#1
5030 Z=2:OPEN "R",#1,"GAME.DAT",2
5040 FIELD #1,2 AS T1$
5050 GET #1,1:NG%=CVI(T1$)
5060 FOR X=1 TO NG%:FOR Y=1 TO 4:GET #1,
                Z:GS%(X,Y)=CVI(T1$):Z=Z+1
5070 NEXT:NEXT
5080 CLOSE #1
5090 OPEN"I",#1,"REG/SPEC":FOR X=1 TO 16
      :INPUT#1,REGSPEC%(X):NEXT:CLOSE#1
5100 OPEN"I",#1,"PAYOUT":FOR X=1 TO 16:F
OR Y=1 TO 4:FOR Z=1 TO 3:INPUT#1,PO(X,Y,
                Z):NEXT:NEXT:NEXT:CLOSE#1
5110 OPEN"R",#1,"CASHIER.DAT",33
5120 FIELD #1, 2 AS T1$, 2 AS OF$
5130 GET#1,1:RN%=CVI(T1$):OF$=LEFT$(OF$,
                                        1)
5140 CLOSE
5150 GOSUB 280
5160 FOR X=1 TO 45:GET#1,X:NM$(X)=NAM$:N
                                EXT:CLOSE#1
5170 GOTO 4730
5180 REM
5190 REM      ON ERROR ROUTINES
5200 REM
5210 PRINT B$CL$;:V=12:H=1:GOSUB 600:PRI
NT "NO "P$"DATA ON DISK. PLEASE "ENT$P$"
DATA.  USE THE MANAGER'S MENU TO "ENT$;P
                                $"DATA":PRIN
T:PRINT:FOR X=1 TO 4500:NEXT
5220 CLOSE#1:OPEN "O",#1,"PRICE.DAT"
5230 WRITE#1," ";" ";" ";"";"6/27";1;1;1
                        ;1;1;1;1;1;1;" ";1;10
5240 KPW$="5/27"
5241 CLOSE#1
5250 GOTO 4920
5260 PRINT CL$:V=12:H=15:GOSUB 600:PRINT
"WAIT...LOADING GAME FORMAT MENU ";:RUN"
                                FORMAT"
59999 STOP
60000 CLEAR:DIM M$(12):OPEN "I",#1,"VRBL
.DAT":INPUT#1,LI$,SP$,C1$,R1$,BA$,ESC$,B
$,E4$,E3$,E2$,E1$,E5$,T$,CARD$,REG$,SPEC
                                $,ENT$,PO$,C
UST$,IB$,OS$,PR$,P$,C$,MN1$,MN2$,MN3$,MN
4$,MN5$,MN6$,MN7$,MN8$,MN9$,MN10$,MN11$,
                        MN12$,MN13$,MN14$
60005 FOR X=1 TO 12:INPUT#1,M$(X):NEXT:F
  OR X=1 TO 7:INPUT#1,D$(X):NEXT:CLOSE#1
60010 MN10$=" GAME FORMAT MENU"
60020 OPEN "O",#1,"VRBL.DAT":WRITE#1,LI$
,SP$,C1$,R1$,BA$,ESC$,B$,E4$,E3$,E2$,E1$
```

```
,E5$,T$,CARD$,REG$,SPEC$,ENT$,PO$,CUST$,
                                IB$,OS$,PR$,
P$,C$,MN1$,MN2$,MN3$,MN4$,MN5$,MN6$,MN7$
,MN8$,MN9$,MN10$,MN11$,MN12$,MN13$,MN14$
60025 FOR X=1 TO 12:WRITE#1,M$(X):NEXT:F
  OR X=1 TO 7:WRITE#1,D$(X):NEXT:CLOSE#1
60030 END
10 REM FORMAT.BAS

20 GOTO 50
30 KILL"FORMAT.BAK":NAME"FORMAT.BAS" AS
          "FORMAT.BAK":SAVE"FORMAT":END
40 SAVE"FORMAT",A:END
50 CLEAR:DIM GS%(16,4),M$(12),D$(7),T(12
                ),NM$(45),PA(25),PT%(100)
60 FOR X=1 TO 12:READ M$(X):NEXT:FOR X=1
       TO 7:READ D$(X):NEXT:CL$=CHR$(26)
70 LI$= STRING$(76," "):SP$=" ":CJ$=CHR$
(17):R1$=CHR$(18):BA$=CHR$(8):ESC$=CHR$(
27):B$=CHR$(7):ENT$="ENTER ":PR$="PRESS
                                'RETURN' TO
CONTINUE ":MN10$=" FORMAT MENU ":HEAD$="
  B   I   N   G   O":LN$="+---+---+---+-
  --+---+":BLANK$="!   ":BLACK$="!***"
80 DATA JAN,FEB,MAR,APR,MAY,JUN,JUL,AUG,
SEP,OCT,NOV,DEC,SUN,MON,TUE,WED,THRU,FRI
                                      ,SAT
90 OPEN"I",#1,"PRICE.DAT":INPUT#1,VC$,BN
$,BS$,PW,KPW$,MP,UR,US,UB,DB%,DB,DP,IBW%
,BM$:REM ONLY BN$ AND BM$ IS USED IN THI
                                S PROGRAM
100 CLOSE#1
110 GOTO 810
120 PRINT CL$:V=12:H=15:GOSUB 400:PRINT
          "WAIT.... SAVING DATA":RETURN
130 FC=1:V=YL:H=XL:GOSUB 400:PRINT STRIN
G$(LEN(I$),32):V=19:H=1:GOSUB 400:PRINT
STRING$(20,42);" FUNCTION CODES ";STRING
                                    $(20,42)
140 PRINT"1. GO BACK TO LAST ENTRY":PRIN
T"2. DONE - RETURN TO MENU":PRINT"SELECT
                                    ONE: ";
150 RETURN
160 PRINT"1. ACCEPT PATTERN":PRINT"2. SA
VE FORMAT PATTERNS":PRINT"3. EXIT TO MEN
                                        U"
170 PRINT"SELECT ONE: ";
180 RETURN
190 OPEN"R",#1,"FORMAT.NAM",18:FIELD#1,1
            6 AS NAM$,2 AS COUNT$:RETURN
200 V=18:H=1:GOSUB 920:INPUT"MORE PATTER
                N FOR THIS FORMAT? ",I$
210 IF LEN(I$)=0 OR LEN(I$)>3 THEN I$="E
                                    ":RETURN
220 IF LEFT$(I$,LEN(I$))=LEFT$("YES",LEN
                (I$)) THEN I$="Y":RETURN
230 IF LEFT$(I$,LEN(I$))=LEFT$("NO",LEN(
                I$)) THEN I$="N":RETURN
240 I$="E":RETURN
250 I$="":PFC=0
260 X$=INPUT$(1)
270 IF FC THEN FC=0:GOSUB 670:IF X$="/"
THEN X$=CJ$:RETURN ELSE IF ASC(X$)>127 T
HEN X$=R1$:RETURN ELSE IF GF =1 AND ASC(
                                X$)=0  THEN
X$=T$:RETURN ELSE PFC=1:RETURN
280 IF X$=CHR$(13) THEN RETURN
290 IF X$=BA$ THEN IF LEN(I$)=0 THEN GOT
O 260 ELSE I$=LEFT$(I$,LEN(I$)-1):PRINT
                BA$;SP$;BA$;:GOTO 260
300 IF X$=ESC$ AND NFC=0 THEN GOSUB 670:
                GOSUB 130:GOTO 250
310 IF ASC(X$)<AL OR ASC(X$) > AH THEN P
                RINT B$;:GOTO 260
320 IF AL=46 THEN IF X$="/" THEN PRINT B
                                    $;
330 IF LEN(I$)=L THEN PRINT B$;:GOTO 260
                            ELSE I$=I$+X$
340 PRINT X$;
350 GOTO 260
360 GOSUB 780:IF X$=R1$ THEN RETURN
370 GOSUB 190:GOSUB 800:T2=42:I$=" FORMA
T LIBRARY ":GOSUB 420:LPRINT " ":LPRINT"
NUMBER  NAME";SPC(15);"PATTERN VALUE":LP
                                RINT" "
380 FOR X=1 TO 45:GET#1,X:LPRINT TAB(3);
X;TAB(9);NAM$;TAB(30);COUNT$:NEXT:CLOSE#
                            1:GOSUB 720
390 RETURN
400 Y$=CHR$(31+V):X1$=CHR$(31+H):PRINT E
SC$"=  ":PRINT ESC$"=";Y$;X1$;
                            ESC$"=";Y$;X1$;
410 RETURN
420 T1=LEN(I$):T1=20-INT((T1/2)+.05):LPR
INT STRING$(T1,T2);I$;:IF LEN(I$)+T1+T1>
                            40 THEN T1=T1-1
430 LPRINT STRING$(T1,T2)
440 RETURN
450 PRINT CL$:V=1:H=1:GOSUB 400:T1=LEN(I
$):T1=INT(T1/2):T1=38-T1:PRINT STRING$(T
            1,127);I$;STRING$(T1,127)
460 RETURN
470 REM ON ERROR GOTO ******** TBD *****
                                    ****
480 REM
490 REM     RETURN TO MANAGER'S MENU
500 REM
510 PRINT CL$:H=15:V=12:GOSUB 400:PRINT
"WAIT...RETURNING TO THE MANAGER'S MENU
                        ";:RUN"MANAGER"
520 REM
530 REM GET CURRENT TIME FROM RTC
540 REM
550 FOR N = 12 TO 0 STEP -1
560 OUT 60,N: OUT 60,16+N: OUT 60,N
570 OUT 60,64: T(N)= INP(60)-240: OUT 60
                                ,0: NEXT
580 IF T(0)=TX THEN GOTO 550 ELSE TX=T(0
                                        )
590 MO$=M$((10*T(10))+T(9))
600 YR=(10*T(12))+T(11)
610 DA$=STR$((10*T(8))+T(7))
620 PM = 0 :IF T(5) => 4 THEN T(5) = T(5
                            ) - 4: PM = 1
630 HR$=STR$((10*T(5))+T(4)):HR$=RIGHT$(
HR$,LEN(HR$)-1):IF LEN(HR$)=1 THEN HR$="
                                0"+HR$
640 MN$=STR$((10*T(3))+T(2)):MN$=RIGHT$(
MN$,LEN(MN$)-1):IF LEN(MN$)=1 THEN MN$="
                                0"+MN$
650 SEC$=STR$((10*T(1))+T(0)):SEC$=RIGHT
$(SEC$,LEN(MN$)-1):IF LEN(SEC$)=1 THEN S
                            EC$="0"+SEC$
660 RETURN
670 V=19:H=1:GOSUB 400:FOR Y=1 TO 5:PRIN
          T LI$:NEXT:V=YL:H=XL:GOSUB 400
680 RETURN
690 REM
700 REM       EJECT PRINTER PAPER
710 REM
720 GOSUB 550:REM GET DATE & TIME FROM R
                                        TC
730 LPRINT" ":LPRINT D$(T(6));": ";MO$;D
                A$;",";YR+1900;"   ";
740 IF LEFT$(HR$,1)="0" THEN HR$=RIGHT$(
                                HR$,1)
750 LPRINT HR$;":";MN$;":";SEC$;:IF PM =
    1 THEN LPRINT " PM" ELSE LPRINT" AM"
760 FOR X=1 TO 8:LPRINT" ":NEXT
770 RETURN
780 PRINT CL$:V=12:H=1:GOSUB 400:PRINT "
CHECK PRINTER FOR PROPER ALIGNMENT":PRIN
T:PRINT PR$:AH=13:AL=13:L=1:GOSUB 250:IF
                            X$=R1$ THEN
 RETURN ELSE IF X$=CJ$ OR JFPFC THEN 780
790 PRINT CL$:H=15:V=12:GOSUB 400:PRINT"
        WAIT...PRINTING DATA ";:RETURN
800 I$=BN$:T2=32:GOSUB 420:I$=BM$:GOSUB
          420:LPRINT" ":X=FRE(""):RETURN
810 Z=2:OPEN"R",#1,"GAME.DAT",2
820 FIELD#1,2 AS T1$
830 GET #1,1:NG%=CVI(T1$)
840 FOR X=1 TO NG%:FOR Y=1 TO 4:GET#1,Z:
                GS%(X,Y)=CVI(T1$):Z=Z+1
```

```
850 NEXT:NEXT:CLOSE#1
860 REM                    MENU
870 I$=MN10$:GOSUB 450
880 V=3:H=1:GOSUB 400:PRINT"1. CREATE FO
RMAT":PRINT"2. DELETE FORMAT":PRINT "3.
PRINT A FORMAT":PRINT "4. PRINT FORMAT L
                                IBRARY":PRIN
T"5. RETURN TO MANAGER'S MENU"
890 V=9:H=1:GOSUB 400:PRINT"SELECT ONE:
 ";:XL=13:YL=V:AH=53:AL=49:L=1:GOSUB 250
900 ON VAL(I$) GOSUB 940,1590,1770,360,4
                                        80
910 GF=0:GOTO 870
920 Y$=CHR$(31+V):X1$=CHR$(31+H):PRINT E
          SC$=" ":PRINT ESC$"=";Y$;X1$;
930 RETURN
940 GF=1: RN%=0:GOSUB 190
950 FOR X=45 TO 1 STEP -1
960 GET#1,X
970 IF NAM$=STRING$(16,42) THEN RN$=STR$
(X):IF X <10 THEN RN$=RIGHT$(RN$,1):RN%=
        X ELSE RN$=(RIGHT$(RN$,2))*RN%=X
980 NEXT
990 CLOSE#1
1000 IF RN%=0 THEN PRINT CL$:H=1:V=12:GO
SUB 920:PRINT"LIBRARY FULL...YOU MUST DE
LETE A FORMAT BEFORE ADDING.":PRINT PR$;
):GOTO 870                      :X$=INPUT$(1
1010 PT%(1)=0:INDEX=2
1020 VALUE=1:PRINT CL$:V=12:H=1:GOSUB 92
0:PRINT ENT$"NAME FOR BINGO FORMAT ";STR
          ING$(16,"-");STRING$(16,8);
1030 AH=90:AL=32:L=16:XL=29:YL=V:GOSUB 2
50:IF X$=R1$ THEN RETURN ELSE IF X$=C1$
                        OR PFC THEN 1020
1040 IF LEN(I$)=0 OR I$=STRING$(LEN(I$),
          32) THEN PRINT B$:GOTO 1020
1050 N$=I$
1060 FOR X=1 TO 25:PA(X)=0:NEXT:PRINT CL
                        $:V=1:H=1:GOSUB 920
1070 PRINT TAB(8);"   B        I        N
                                 G        O"
1080 FOR X=1 TO 5:PRINT TAB(4);STRING$(4
                                    1,45)
1090 PRINT X;:FOR Y=1 TO 2:PRINT TAB(4);
:FOR Z=1 TO 5:PRINT"|          ";:NEXT:PRIN
                                        T"|"
1100 NEXT:NEXT:PRINT TAB(4);STRING$(41,4
5):V=9:H=21:GOSUB 920:PRINT" FREE";:V=10
                :GOSUB 920:PRINT" SPACE";
1110 NFC=1:H=1:V=18:GOSUB 400:PRINT STRI
NG$(25,32);STRING$(25,8);"SELECT SQUARE
                                        "
1120 H=50:V=18:GOSUB 920:PRINT"FORMAT NA
ME: "N$:PRINT TAB(50);"PATTERN NO.: ";VA
    LUE:PRINT TAB(51);"FORMAT NO.: ";RN%
1130 H=17:V=18:GOSUB 920
1140 AH=90:AL=48:L=3:YL=V:XL=15:GOSUB 25
0:NFC=0:IF I$="N3" THEN PRINT B$:GOTO 11
                                        10
1150 IF I$="END" THEN GOSUB 200:IF I$="Y
" THEN 1230 ELSE IF I$="N" THEN 1360 ELS
                        E IF I$="E" THEN 1110
1160 M=0:BI$="BINGO":FOR X=1 TO 5:IF LEF
        T$(I$,1)=MID$(BI$,X,1) THEN M=X
1170 NEXT
1180 IF M= 0 THEN PRINT B$:GOTO 1110
1190 N=VAL(RIGHT$(I$,1)):IF N<1 OR N>5 T
                        HEN PRINT B$:GOTO 1110
1200 X=5*(N-1)+M:IF PA(X) THEN PA(X)=0:S
                P=32 ELSE PA(X)=1:SP=127
1210 H=5+8*(M-1):FOR V=3*N TO 1+3*N:GOSU
          B 920:PRINT STRING$(7,SP):NEXT
1220 GOTO 1110
1230 FOR X=1 TO 25:IF PA(X)>0 THEN Y=50:
                                        X=25
1240 NEXT
1250 IF Y<>50 THEN IF VALUE=1 THEN 1060
                ELSE PRINT B$:GOTO 1110
1260 X=0:FOR I=1 TO 3:PAT%(I)=0:NEXT
1270 FOR BY=1 TO 3:FOR BI=0 TO 7
1280 X=X+1:IF X=13 THEN 1280
1290 IF PA(X) THEN PAT%(BY)=PAT%(BY)+2^B
                                        I
1300 NEXT:NEXT
1310 PT%(1)=PT%(1)+1
1320 FOR X=1 TO 3:PT%(INDEX)=PAT%(X):IND
                        EX=INDEX+1:NEXT
1330 VALUE=VALUE+1
1340 IF I$="N" THEN 1380
1350 GOTO 1060
1360 Y=0:FOR X=1 TO 25:IF PA(X)>0 THEN Y
                                =50:X=25
1370 NEXT:IF Y=50 THEN 1260 ELSE IF VALU
                        E=1  THEN RETURN
1380 X=PT%(1):IF X=0 THEN RETURN
1390 IF X AND 1 THEN 1400 ELSE PT%(INDEX
                        )=0:INDEX=INDEX+1
1400 REM
1410 OPEN "O",#1,"WINPAT"+RN$
1420 FOR X=1 TO INDEX-1:WRITE#1,PT%(X):N
                                        EXT
1430 CLOSE#1
1440 GOSUB 190
1450 VALUE$=STR$(VALUE-1):VALUE$=RIGHT$(
                        VALUE$,LEN(VALUE$)-1)
1460 LSET NAM$=N$:RSET COUNT$=VALUE$
1470 PUT#1,RN%
1480 CLOSE#1
1490 RETURN
1500 GOSUB 190
1510 LSET NAM$=STRING$(16,42)
1520 FOR X= 1 TO 45
1530 PUT#1,X
1540 NEXT
1550 CLOSE#1
1560 REM
1570 REM  DELETE GAME FORMAT
1580 REM
1590 I$=" DELETE GAME FORMAT ":GOSUB 450
1600 V=12:H=1:GOSUB 400:PRINT"PLEASE ENT
ER THE GAME FORMAT NUMBER YOU WANT DELET
ED. ";:XL=54:YL=V:AH=58:AL=48:L=2:GOSUB
                                        250
1610 IF X$=R1$ THEN RETURN ELSE IF X$=C1
                        $ OR PFC THEN 1600
1620 IF VAL(I$)=0 OR VAL(I$)>45 THEN PRI
                        NT B$:GOTO 1600
1630 E=0:FOR X=1 TO 16:FOR Y=1 TO 4:IF G
        S%(X,Y)=VAL(I$) THEN E=1:X=16:Y=4
1640 NEXT:NEXT
1650 IF E=1 THEN V=12:H=1:GOSUB 400:PRIN
T TAB(29);"GAME FORMAT NUMBER ";I$;PR
INT TAB(10)"CANNOT BE DELETED UNTIL REMO
                        VED FROM THE
 SESSION SCHEDULE.":PRINT:PRINT TAB(25);
"PRESS ANY KEY TO CONT. ";X$=INPUT$(1):
                        GOTO 1590
1660 V=12:H=1:GOSUB 400:PRINT"GAME FORMA
        T TO DELETE IS: ";I$;"  ";
1670 GOSUB 190
1680 INDEX=VAL(I$)
1690 GET#1,INDEX
1700 PRINT NAM$
1710 V=14:H=1:GOSUB 400:INPUT"IS THIS TH
                        E CORRECT FORMAT";X$
1720 IF X$="Y" OR X$="YES" THEN 1730 ELS
                                E 1750
1730 LSET NAM$=STRING$(16,42):LSET COUNT
                                        $=""
1740 PUT#1,INDEX
1750 CLOSE#1
1760 RETURN
1770 I$=" DISPLAY FORMAT ":GOSUB 450
1780 V=12:H=1:GOSUB 400:PRINT"PLEASE ENT
ER THE GAME FORMAT NUMBER YOU WANT PRINT
ED. ";:XL=56:YL=V:AH=58:AL=48:L=2:GOSUB
                                        250
1790 IF X$=R1$ THEN RETURN ELSE IF X$=C1
                        $ OR PFC THEN 1780
1800 IF VAL(I$)=0 OR VAL(I$)>45 THEN PRI
                        NT B$:GOTO 1780
1810 N=VAL(I$):RN$=STR$(N):IF N<10 THEN
 RN$=RIGHT$(RN$,1) ELSE RN$=(RIGHT$(RN$,
                                        2))
```

```
1820 GOSUB 780:IF X$=R1$ THEN RETURN
1830 GOSUB 800
1840 GOSUB 190:REM OPEN FORMAT.NAM
1850 GET#1,N:CLOSE#1
1860 N$=NAM$
1870 I$=" GAME FORMAT ":T2=42:GOSUB 420:
LPRINT" ":LPRINT"NUMBER  NAME";SPC(15);"
                    PATTERNS":LPRINT " "
1880 IF N$=STRING$(16,42) THEN LPRINT" "
:LPRINT "  ";N;TAB(9);"NO FORMAT PATTERN
                    S DEFINED":GOTO 2280
1890 LPRINT "  "N;TAB(9);N$;TAB(31);COUN
                    T$:LPRINT" ":LPRINT" "
1900 OPEN"I",#1,"WINPAT"+RN$:INPUT#1,X%
1910 FOR X=1 TO VAL(COUNT$):LPRINT:LPRIN
        T TAB(6);HEAD$:LPRINT TAB(6);LN$
1920 LPRINT TAB(4)"1 ";:INPUT#1,Y%:FOR L
 =1 TO 2:IF Y% AND 1 THEN LPRINT BLACK$;
                    ELSE LPRINT BLANK$;
1930 IF Y% AND 2 THEN LPRINT BLACK$; ELS
                    E LPRINT BLANK$;
1940 IF Y% AND 4 THEN LPRINT BLACK$;ELS
                    E LPRINT BLANK$;
1950 IF Y% AND 8 THEN LPRINT BLACK$; ELS
                    E LPRINT BLANK$;
1960 IF Y% AND 16 THEN LPRINT BLACK$; EL
                    SE LPRINT BLANK$;
1970 LPRINT"|":IF L=1 THEN LPRINT TAB(6)
                                        ;
1980 NEXT:LPRINT TAB(6);LN$:LPRINT TAB(4
        )"2 ";:INPUT#1,Z%:FOR L=1 TO 2
1990 IF Y% AND 32 THEN LPRINT BLACK$; EL
                    SE LPRINT BLANK$;
2000 IF Y% AND 64 THEN LPRINT BLACK$; EL
                    SE LPRINT BLANK$;
2010 IF Y% AND 128 THEN LPRINT BLACK$; E
                    LSE LPRINT BLANK$;
2020 IF Z% AND 1 THEN LPRINT BLACK$; ELS
                    E LPRINT BLANK$;
2030 IF Z% AND 2 THEN LPRINT BLACK$; ELS
                    E LPRINT BLANK$;
2040 LPRINT"|":IF L=1 THEN LPRINT TAB(6)
                                        ;
2050 NEXT:LPRINT TAB(6);LN$:LPRINT TAB(4
                    )"3 ";:FOR L=1 TO 2
2060 IF Z% AND 4 THEN LPRINT BLACK$; ELS
                    E LPRINT BLANK$;
2070 IF Z% AND 8 THEN LPRINT BLACK$; ELS
                    E LPRINT BLANK$;
2080 LPRINT BLACK$;
2090 IF Z% AND 16 THEN LPRINT BLACK$; EL
                    SE LPRINT BLANK$;
2100 IF Z% AND 32 THEN LPRINT BLACK$; EL
                    SE LPRINT BLANK$;
2110 LPRINT"|":IF L=1 THEN LPRINT TAB(6)
                                        ;
2120 NEXT:LPRINT TAB(6);LN$:LPRINT TAB(4
        )"4 ";:INPUT#1,Y%:FOR L=1 TO 2
2130 IF Z% AND 64 THEN LPRINT BLACK$; EL
                    SE LPRINT BLANK$;
2140 IF Z% AND 128 THEN LPRINT BLACK$; E
                    LSE LPRINT BLANK$;
2150 IF Y% AND 1 THEN LPRINT BLACK$; ELS
                    E LPRINT BLANK$;
2160 IF Y% AND 2 THEN LPRINT BLACK$; ELS
                    E LPRINT BLANK$;
2170 IF Y% AND 4 THEN LPRINT BLACK$; ELS
                    E LPRINT BLANK$;
2180 LPRINT"|":IF L=1 THEN LPRINT TAB(6)
                                        ;
2190 NEXT:LPRINT TAB(6);LN$:LPRINT TAB(4
                    )"5 ";:FOR L=1 TO 2
2200 IF Y% AND 8 THEN LPRINT BLACK$; ELS
                    E LPRINT BLANK$;
2210 IF Y% AND 16 THEN LPRINT BLACK$; EL
                    SE LPRINT BLANK$;
2220 IF Y% AND 32  THEN LPRINT BLACK$; E
                    LSE LPRINT BLANK$;
2230 IF Y% AND 64 THEN LPRINT BLACK$; EL
                    SE LPRINT BLANK$;
2240 IF Y% AND 128 THEN LPRINT BLACK$; E
                    LSE LPRINT BLANK$;
2250 LPRINT"|":IF L=1 THEN LPRINT TAB(6)
                                        ;
2260 NEXT
2270 LPRINT TAB(6);LN$:LPRINT " ":NEXT
2280 CLOSE#1
2290 GOSUB 720
2300 RETURN
1 REM BINGO SESSION PROGRAM  VERSION 2.0
                    ----------------------
2 REM
3 GOTO 10
7 KILL"BINGO-2.BAK":NAME "BINGO-2.BAS" A
        S "BINGO-2.BAK":SAVE"BINGO-2":END
10 CLEAR:DIM PD%(15,3),PC(15),T(12),M$(1
2),D$(7),SCHED%(322),DOWNGI%(31),PDS$(20)
                                    ,PDS$(20)
20 LI$=STRING$(76,32):SP$=" ":C1$=CHR$(1
7):R1$=CHR$(18):BA$=CHR$(8):CL$=CHR$(26)
:ESC$=CHR$(27):B$=CHR$(7):E4$="$####.##
                                    ":E3$="$###.
##":E2$="###":E1$="##.##":E5$="####.##":
CARD$="CARDS ":REG$="REGULAR ":SPEC$="SP
                    ECIAL ":ENT$="ENTER "
30 PO$="PAYOUT ":CUST$="CUSTOMER NO. ":I
N$="IMPORTANT BINGO ":OUT$="OTHER SALES":P
$="PRESS 'RETURN' TO CONTINUE - ":WVU$="
                                WIN VALIDATI
ON UNIT":BPO$="BINGO "+PO$
40 FOR X=1 TO 12:READ M$(X):NEXT:FOR X=1
                    TO 7:READ D$(X):NEXT
50 REM PORT ADDRESSES: UART DATA & STATU
                    S, COUNTER DATA & CONTROL
60 BSTAT=44:UDAT = 40: USTAT = 41: C0 =
                    56: C1 = 57: C2 = 58: CC = 59
70 REM SETUP BAUD RATES
80 OUT CC,55:OUT C0,38:OUT C0,0
90 OUT CC,119:OUT C1,38:OUT C1,0
100 REM RESET UART
110 FOR N = 1 TO 5: OUT USTAT,0:NEXT
120 REM SETUP UART
130 OUT USTAT,64:OUT USTAT,78:OUT USTAT,
                                        21
140 REM
150 REM ON ERROR GOTO 4510:I2$="SCHEDULE
                                    DATA"
160 OPEN"I",#1,"SCHEDULE":FOR X= 1 TO 32
        J:INPUT#J,SCHED%(X):NEXT:CLOSE#J
170 I2$="WIN TABLES"
180 OPEN"I",#1,"GAMEINFO":FOR X= 1 TO 31
        :INPUT#1,DOWNGI%(X):NEXT:CLOSE#1
190 I2$="COMMUNICATIONS PROGRAM"
200 OPEN"I",#1,"UPLOAD.SUB":INPUT#1,SR$:
                                    CLOSE#1
210 X = 0:FOR I = 2 TO 321: X = X + SCHE
     D%(I): NEXT: SCHED%(322)=-X AND 255
220 GOTO 4100
230 DATA "JANUARY","FEBRUARY","MARCH","A
PRIL","MAY","JUNE","JULY","AUGUST","SEPT
  EMBER","OCTOBER","NOVEMBER","DECEMBER"
240 DATA "SUN.","MON.","TUES.","WED.","T
                    HUR.","FRI.","SAT."
250 IF PDS(1)>0 THEN FOR X=1 TO 20:LPRIN
T"PACKAGE DEAL NO.";PDS$(X);TAB(28);:LPR
INT USING E4$;PDS(X):IF PDS(X+1)=0 THEN
                                X=20 ELSE NE
XT
260 RETURN
270 V=8:H=1:GOSUB 510:FOR X=1 TO 6:PRINT
     LI$:NEXT:T6=0:PR=0:PS=PR:PB=PR:ST=0
280 TOTAL1=TOTAL1+TOTAL:DISTOTAL1=DISTOT
                                AL1+DISTOTAL
290 RETURN
400 I$="":PFC=0
410 X$=INPUT$(1)
420 IF SC THEN SC=0:GOSUB 7400:IF X$=""
 THEN X$=C1$:RETURN ELSE IF ASC(X$)=127
THEN X$=R1$:RETURN ELSE IF SC% =1 AND AS
                                C(X$)=0  THE
N X$=T$:RETURN ELSE PFC=1:RETURN
430 IF X$=CHR$(13) THEN RETURN
440 IF X$=BA$ THEN IF LEN(I$)=0 THEN GOT
```

```
0 410 ELSE I$=LEFT$(I$,LEN(I$)-1):PRINT
                    BA$;SP$;BA$;:GOTO 410
450 IF X$=ESC$ AND NFC=0 THEN GOSUB 3110
:V=YL:H=XL:GOSUB 510:PRINT STRING$(LEN(I
$),32):V=19:H=1:GOSUB 510:PRINT STRING$(
                                20,42);" FUN
CTION CODES ";STRING$(20,42):PRINT"1. GO
 BACK TO LAST ENTRY":FC=1:PRINT"2. EXIT
  TO MENU":PRINT"SELECT ONE: ";:GOTO 400
460 IF ASC(X$)<AL OR ASC(X$) > AH THEN P
                                RINT BELL$:A$
470 IF AL=46 THEN IF X$="/" THEN PRINT B
                                $;:GOTO 410
480 IF LEN(I$)=L THEN PRINT B$;:GOTO 410
                              ELSE I$=I$+X$
490 IF P THEN PRINT "*"; ELSE PRINT X$;
500 GOTO 410
510 Y$=CHR$(31+V):X1$=CHR$(31+H):PRINT E
SC$"=  ":PRINT ESC$"=";X$;X1$;L1$;PRINT
                              ESC$"=";Y$;X1$;
511 RETURN
512 FOR X= GN% TO 16:FOR Y=LN% TO 4:FOR
Z= PL% TO 3:IF GS(X,Y,Z)<>0 THEN GN%=X:L
                  N%=Y:PL%=Z:X=16:Y=4:Z=3
513 NEXT:NEXT:NEXT
514 RETURN
530 T1=LEN(I$):T1=20-INT((T1/2)+.05):LPR
INT STRING$(T1,T2);I$;:IF LEN(I$)+T1+T1>
                              40 THEN T1=T1-1
540 LPRINT STRING$(T1,T2)
550 RETURN
560 T1=0:E=T1:FOR Y=1 TO LEN(I$)
561 IF MID$(I$,Y,1)=" " THEN T1=T1+1:T3=
                                  LEN(I$)-Y
562 IF T1>1 THEN Y=LEN(I$):E=1
563 NEXT:IF T3>2 THEN E=1
564 RETURN
566 RETURN
610 E=0:IF ASC(I$)<>80 THEN PRINT B$;:E=
1:RETURN ELSE IF LEN(I$)=1 THEN E=1:PRIN
                                T B$;:RETURN
620 I$=RIGHT$(I$,LEN(I$)-1):FOR Y=LEN(I$
                                ) TO 1 STEP -1
630 IF ASC(MID$(I$,Y,1))>57 AND ASC(MID$
  (I$,Y,1))<91 THEN E=1:Y=1:PRINT B$;
640 NEXT:RETURN
650 V=1:H=1:GOSUB 510:T1=LEN(I$):T1=INT(
                              T1/2):T1=38-T1
660 PRINT STRING$(T1,127);I$;STRING$(T1,
                                      127)
670 RETURN
680 V=9:H=1:GOSUB 510:R=R-LASTR:IF R<0 T
                                    HEN R=0
690 TOTAL=TOTAL-(LASTR*UR):IF TOTAL<0 TH
                                  EN TOTAL=0
700 RETURN
710 V=10:H=1:GOSUB 510:S=S-LASTS:IF S<0
                                    THEN S=0
720 RETURN
730 E=0:IF PR>0 OR PS>0 OR PB >0 THEN PR
=0:PS=0:PB=0:TOTAL=TOTAL-TS:TS=0:E=1:G
                                    OSUB 780
740 IF E THEN RETURN
750 IB=IB-LASTIB:IF IB<0 THEN IB=0
760 TOTAL=TOTAL-(((LASTIB-(INT(LASTIB/DB
  %)*DB%))*UB)+(INT(LASTIB/DB%)*DB))
770 RETURN
780 V=11:H=1:GOSUB 510:RETURN
790 V=13:H=10:GOSUB 510:PRINT "PLEASE IN
  SERT ANOTHER CARD ";PR$;:X$=INPUT$(1)
800 IF INP(BSTAT) AND 3 THEN PRINT CL$:V
=12:H=15:GOSUB 510:PRINT"BAD BATTERIES "
                ;PR$;:X$=INPUT$(1):GOTO 790
810 GOSUB 1590:IF X$=R1$ THEN 810
820 RETURN
890 GOSUB 3980
900 GOSUB 4040:T14=1:IF CF=0 THEN GOSUB
                  3190:IF CF =0 THEN RETURN
910 GOSUB 1530:REM GET DATA FROM CARD
920 IF X$=R1$ THEN RETURN ELSE IF X$=C1$
                              OR PFC THEN 910
930 NS%=0:PRINT CL$:I$=" "+ENT$+CUST$:GO
SUB 650:V=4:H=1:GOSUB 510:PRINT ENT$;CUS
T$:PRINT:PRINT  STRING$(25,45);STRING$(2
                                5,8);:AL=32:
AH=90:L=25:XL=1:YL=7:GOSUB 400
940 IF X$=R1$ THEN RETURN ELSE IF X$=C1$
          THEN 930 ELSE IF PFC THEN 930
950 IF LEN(I$) = 0 OR I$=STRING$(LEN(I$)
,32) THEN PRINT B$;:GOTO 930 ELSE CN$=I$
960 T=0:SC%=1
970 T6=0:IBT=0:TOTAL1=0:ST=TOTAL1:DISTOT
AL1=ST:R=0:S=0:IB=0:MS=IB:LASTIB=IB:LAST
R=R:LASTS=S:PB1=S:PR1=R:PS1=S:PB=0:PS=0:
                              PR=0:FOR X=1
 TO 20:PDS(X)=0:NEXT:U=1
990 PRINT CL$:I$=" SELL BINGO CARDS ":GO
SUB 650:PRINT STRING$(76,42):PRINT"*";TA
                                B(76);"*"
990 PRINT"*";:IF RS%=1 THEN PRINT SPC(33
); "RESALE"; ELSE PRINT SPC(33);"NEW SAL
                                      E";
1000 PRINT TAB(76)"*":PRINT"*";TAB(76);"
                  *":PRINT STRING$(76,42)
1010 T=0:V=8:H=1:GOSUB 510:PRINT REG$;CA
RD$;BA$":  ";:AL=48:AH=80:L=3:YL=13:XL=1
                              7:GOSUB 400
1020 IF X$=R1$ THEN RETURN ELSE IF X$=C1
$ THEN 930 ELSE IF X$=T$ THEN T=1:GOTO 1
                150 ELSE IF PFC THEN 1010
1030 IF LEN(I$)=0 THEN I$="0"
1040 T2=0:MSF=0:IF ASC(I$)>57 THEN GOSUB
     2990:IF E THEN 1010 ELSE GOTO 1170
1050 R=R+VAL(I$):LASTR=VAL(I$)
1060 V=9:H=1:GOSUB 510:PRINT SPEC$;CARD$
;BA$":  ";:AL=48:AH=57:L=2:YL=9:XL=15:GO
                                  SUB 400
1070 IF X$=R1$ THEN RETURN ELSE IF X$=C1
$ THEN GOSUB 680:GOTO 1010 ELSE IF PFC T
                                  HEN 1060
1080 IF LEN(I$)=0 THEN I$="0"
1090 S=S+VAL(I$):LASTS=VAL(I$)
1100 V=10:H=1:GOSUB 510: PRINT IB$;BA$":
  ";:AL=48:AH=57:L=3:YL=10:XL=15:GOSUB 4
                                      00
1110 IF X$=R1$ THEN RETURN ELSE IF X$=C1
$ THEN GOSUB 710:GOTO 1060  ELSE IF PFC
                                THEN 1100
1120 T=3
1130 IF LEN(I$)=0 THEN I$="0"
1140 IB=IB+VAL(I$):LASTIB=VAL(I$)
1150 IBT=((LASTIB-(INT(LASTIB/DB%)*DB%))
              *UB) +(INT(LASTIB/DB%)*DB)
1160 ST=(LASTR*UR)+(LASTS*UR)+IBT
1170 TOTAL=T6+ST
1180 IF TOTAL1<MP AND TOTAL<MP AND RS%=0
 THEN PRINT CL$:H=1:V=13:GOSUB 510:PRINT
"MINIMUM SALE OF ";:PRINT USING E3$;MP;:
                              PRINT" MUST
BE ENTERED ";B$;:FOR X=1 TO 4000:NEXT:GO
                                  TO 970
1190 IF D THEN DISAMT=TOTAL*(DP/100):DIS
          TOTAL= TOTAL-(TOTAL*(DP/100))
1200 V=11:H=1:GOSUB 510:PRINT STRING$(76
                                      ,42)
1210 IF X$=C1$ THEN GOSUB 780:GOTO 1100
1220 IF TOTAL+TOTAL1=0 THEN X$="":GOTO 1
270 ELSE V=12:H=1:GOSUB 510:PRINT"TOTAL
  . ";:IF D THEN PRINT USING E4$;DISTOTAL
                              +DISTOTAL1;
ELSE PRINT USING E4$;TOTAL+TOTAL1;:PRINT
                                    "  ";
1230 V=13:H=1:GOSUB 510:PRINT"CASH IN:
    ";:SC%=0:AL=46:AH=57:L=7:YL=V:XL=V:G
                              OSUB 400:SC%=1
1240 IF X$=R1$ THEN RETURN ELSE IF X$=C1
$ THEN V=13:H=1:GOSUB 510:V=12:H=1:GOSUB
 510:GOSUB 730:IF E THEN GOTO 1010 ELSE
                                GOTO 1210
1250 IF PFC THEN 1230
1260 RS%=RS%+RS%:RS%=RS%+RS%:RS%=RS%+RS%
1270 IF LEN(I$)=0 THEN GOSUB 270:GOTO 10
                                      10
```

```
1280 GOSUB 560:IF E THEN PRINT B$;:GOTO
                                        1230
1290 R=R+PR1:S=S+PS1:IB=IB+PB1
1300 CKTOTAL=TOTAL1+TOTAL:IF D THEN CKTO
                    TAL=DISTOTAL1+DISTOTAL
1310 IF VAL(I$)<CKTOTAL-.005 OR VAL(I$)>
        9999.99 THEN PRINT B$;:GOTO 1230
1320 CHANGE=ABS(CKTOTAL-VAL(I$))
1330 V=17:H=19:GOSUB 510:PRINT USING 57$
;VAL(I$);:PRINT"  -  CHANGE ....";:PRINT
                          USING E3$;CHANGE
1340 LPRINT TAB(4);"ITEM";TAB(20);"QTY";
                TAB(33);"AMT":LPRINT " "
1350 IF R>0 THEN LPRINT REG$;CARD$;TAB(2
0);:LPRINT USING E2$;R;:LPRINT TAB(28);:
                LPRINT USING E4$;(R-PR1)*UR
1360 IF S>0 THEN LPRINT SPEC$;CARD$;TAB(
20);:LPRINT USING E2$;S;:LPRINT TAB(28);
              :LPRINT USING E4$;(S-PS1)*US
1370 JB4=JB-PBJ
1380 IF IB>0 THEN LPRINT IB$;TAB(20);:LP
RINT USING E2$;IB;:LPRINT TAB(28);:LPRIN
T USING E4$;((IB4-(INT(IB4/DB%)*DB%))*UB
                                )+(INT(IB4/D
B%)*DB)
1390 GOSUB 250
1400 LPRINT TAB(30);STRING$(11,61)
1410 IF D THEN LPRINT TAB(18);"SUBTOTAL"
;TAB(28);:LPRINT USING E4$;TOTAL:LPRINT
TAB(18);"DISCOUNT";TAB(30);:LPRINT USING
                                E3$;DISAMT:
LPRINT TAB(30);STRING$(11,61)
1420 LPRINT TAB(18);"TOTAL";TAB(28);:LPR
                    INT USING E4$;CKTOTAL
1430 LPRINT TAB(18);"CASH IN";TAB(28);:L
PRINT USING E4$;VAL(I$):LPRINT TAB(18);"
CHANGE ";TAB(28);:LPRINT USING E4$;CHANG
                                        E
1440 LPRINT" ":LPRINT"THANK YOU FOR PLAY
                    ING BINGO...GOOD LUCK"
1450 GOSUB 1910
1460 GOSUB 3930
1470 T9=1
1480 GOSUB 2390:REM SAVE TRANSACTION TO
                                        DISK
1490 T1=FRE("")
1500 GOTO 900
1510 REM GET DATA FROM CARD
1520 PRINT CL$:I$=" BINGO CARD SALES ":G
                              OSUB 650:RETURN
1530 GOSUB 1520:V=12:H=5:GOSUB 510:PRINT
  "INSERT BINGO CARD IN CRADLE - ";PR$;
1540 YL=V:XL=63:L=1:AH=13:AL=AH:GOSUB 40
                                        0
1550 IF X$=R1$ THEN RETURN ELSE IF  X$=C
                        1$ OR PFC THEN 1530
1560 IF INP(BSTAT) AND 1 THEN GOSUB 1520
:V=12:H=15:GOSUB 510:PRINT"BAD BATTERIES
                ":PR$;:INPUT"",I$:GOTO 1570
1570 GOSUB 1730:REM GET DATA FROM CARD.
                              STORED IN A4$
1580 VC1$=MID$(A4$,15,16):IF VC1$=LEFT$(
            VC$,16) THEN RS%=1 ELSE RS%=0
1590 IF MS%=1 THEN PRINT CL$
1600 V=YL:H=1:GOSUB 510:PRINT ENT$;"SERI
AL NO. OF CARD ";STRING$(8,45);STRING$(8
    ,8):AH=96:AL=45:XL=25:L=8:GOSUB 400
1610 IF X$=R1$ THEN RETURN ELSE IF PFC O
                        R X$=C1$ THEN 1600
1620 IF LEN(I$)=0 OR I$=STRING$(LEN(I$),
32) THEN PRINT B$:GOTO 1600 ELSE SN$=I$+
                                        "
1630 FOR I = 1 TO 8:DOWNGI%(I+1) = ASC(M
                        ID$(SN$,I,1)):NEXT
1640 RETURN
1650 REM SAVE GAME INFO TO CARD
1660 X = 0:FOR I = 2 TO 30: X = X + DOWN
GI%(I): NEXT: DOWNGI%(31)=-X AND 255:X=0
1670 GOSUB 1810:IF X=50 THEN PRINT CL$:H
=17:V=12:GOSUB 510:PRINT"BINGO CARD COMM
UNICATIONS ERROR DETECTED - REPLACE CARD
                                ":PRINT:PRIN
T PR$;:INPUT"",I$:GOTO 1670
1680  FOR I = 1 TO 1429+1: OUT UDAT,DOWN
GI%(I): NEXT: GOSUB 1760:IF DA THEN X=X+
1:IF X=5 THEN PRINT CL$:H=17:V=12:GOSUB
                                510:PRINT"CO
MMUNICATIONS ERROR DETECTED - REPLACE CA
 RD ";PR$;B$;:GOSUB 790:RETURN ELSE 1680
1690 REM SAVE SCHEDULE TO CARD
1700 X = 0
1710 GOSUB 1810:FOR I = 1 TO 1454+256+1
 : OUT UDAT,SCHED%(I): NEXT:GOSUB 1760:I
F DA THEN X=X+1:IF X=5 THEN H=17:V=1:GOS
                                UB 510:PRINT
"BAD CARD ";PR$;B$;:GOSUB 790:RETURN ELS
                                        E 1710
1720 RETURN
1730 A4$="1234567890123456 7":A4$=A4$+A4$
                : GOSUB 1810:X=INP(UDAT)
1740 ULGISR = 256*PEEK(VARPTR(SR$)+2)+PE
     EK(VARPTR(SR$)+1):CALL ULGISR (A4$)
1750 RETURN
1760 REM UART INPUT ROUTINE
1770 X=0
1780 X = X + 1: IF X = 10 THEN DA = 255:
                                        RETURN
1790 IF INP(USTAT) AND 2 THEN 1800 ELSE
                                        1780
1800 DA = INP(UDAT): RETURN
1810 REM ESTABLISH LINK
1820 OUT USTAT,13: FOR L = 1 TO 40: NEXT
                : X=0: REM BREAK OUT
1830 IF INP(BSTAT) AND 8 THEN X=X+1 ELSE
                                        1850
1840 IF X<50 THEN 1830 ELSE OUT USTAT,5:
            RETURN: REM ERROR EXIT X=50
1850 OUT USTAT,5: X=0
1860 IF INP(BSTAT) AND 8 THEN X=0:RETURN
                        : REM GOOD EXIT
1870 X=X+1:IF X<50 THEN 1860 ELSE RETURN
                    : REM ERROR EXIT X=50
1880 REM
1890 REM THE MYSTERIOUS SUBROUTINE
1900 REM
1910 R2=R:S2=S:IB2=IB
1920 IF RS%=0 THEN LPRINT" ":T2=32:I$="C
        ARD(S) SERIAL NUMBER":GOSUB 530
1930 IF RS% THEN R=R+ASC(MID$(A4$,31,1))
:S=S+ASC(MID$(A4$,32,1)):IB=IB+ASC(MID$(
                                A4$,33,1))
1940 IF R>10 THEN DOWNGI%(26)=10 ELSE DO
                                WNGI%(26)=R
1950 IF S>10 THEN DOWNGI%(27)=10 ELSE DO
                                WNGI%(27)=S
1960 IF IB>255 THEN DOWNGI%(28)=255 ELSE
                            DOWNGI%(28)=IB
1970 GOSUB 2700:REM GET RTC
1980 TI=VAL(LEFT$(BS$,2)):IF RIGHT$(BS$,
                2)="PM" THEN TI=TI+12
1990 IF TI=12 AND RIGHT$(BS$,2)="AM" THE
                                        N TI=0
2000 TI1=VAL(H$):IF PM AND TI1>0 AND TI1
<12 THEN TI1=TI1+12 ELSE IF PM=0 AND TI1
                            =12 THEN TI1=0
2010 TI=TI*60+VAL(MID$(BS$,4,2)):TI1=TI1
                            *60+VAL(MN$)
2020 TIME=1
2030 IF TI1<TI AND RIGHT$(BS$,2)="PM" AN
        D PM=0 THEN TIME=0: GOTO 2050
2040 IF TI1>TI AND INT(TI1-TI)<240 THEN
  TIME=0 ELSE IF TI1>TI THEN TI=TI+24*60
2050 IF TIME <>0 THEN TIME=ABS(TI-TI1)
2060 IF TIME>79 THEN TIME=79
2070 DOWNGI%(30)=16 * INT(TIME/10) + TIM
                    E-10*INT(TIME/10)
2080 GOSUB 1660:IF DA THEN RS%=0:GOTO 19
20:REM SEND DATA TO CARD. DA = BAD CHECK
                                        SUM
2090 IF RS%=0 THEN LPRINT TAB(T14);SN$;:
TJ4=TJ4+9:IF TJ4=>37 THEN TJ4=1:LPRINT"
                                        "
2100 R=R-10:IF R<0 THEN R=0
2110 S=S-10:IF S<0 THEN S=0
```

```
2120 IB=IB-256:IF IB<0 THEN IB=0
2130 IF R=0 AND S=0 AND IB=0 THEN MS%=0:
                                    RETURN
2140 MS%=1
2150 PRINT CL$:V=12:H=1:GOSUB 510:PRINT"
THIS CARD IS FULL. PLEASE INSERT ANOTHER
 CARD AND ";PR$:AH=13:AL=AH:L=1:NFC=1:GO
                                SUB 400:NFC=
0:T=1:GOSUB 2390
2160 GOSUB 1750:IF X$=R1$ THEN 2160
2170 IF INP(BSTAT) AND 1 THEN PRINT CL$:
V=12:H=1:GOSUB 510:PRINT"BAD BATTERIES "
            ;PR$;:X$=INPUT$(1):GOTO 2170
2180 GOSUB 1570:IF X$=R1$ THEN 2180
2190 IF RS% AND R1=10 AND S1=10 AND IB1=
                                255 THEN 2150
2200 GOTO 1930
2210 REM    OTHER SALES
2220 IF CF=0 THEN GOSUB 3190:IF CF=0 THE
                                    N RETURN
2230 PRINT CL$:I$=" "+OS$+" ":GOSUB 650
2240 V=5:H=1:GOSUB 510:PRINT ENT$;"TYPE
            OF SALE ";:AH=90:AL=32:L=30
2250 PRINT:PRINT:YL=7:XL=H:PRINT STRING$
     (70-45):STRING$(70-9):GOSUB 400
2260 IF X$=R1$ THEN RETURN ELSE IF X$=C1
                    $ OR PFC=1 THEN 2240
2270 IF LEN(I$)=0 OR I$=STRING$(LEN(I$),
32) THEN PRINT B$:GOTO 2240 ELSE OS1$=I$
2280 V=9:H=1:GOSUB 510:PRINT ENT$;"AMOUN
T: $";:AH=57:AL=46:L=6:YL=V:XL=16:GOSUB
                                    400
2290 IF X$=C1$ THEN V=9:H=1:GOSUB 510:GO
TO 2240 ELSE IF X$=R1$ THEN RETURN ELSE
                        IF PFC THEN 2280
2300 OS=VAL(I$):IF OS=0 THEN PRINT B$:GO
                                TO 2280
2310 GOSUB 560:IF E THEN PRINT B$:GOTO 2
                                    300
2320 V=13:H=1:GOSUB 510:PRINT PR$;:AH=13
     :AL=13:L=1:YL=13:XL=30:GOSUB 400
2330 IF X$=R1$ THEN RETURN ELSE IF X$=C1
$ THEN V=13:H=1:GOSUB 510:GOTO 2280 ELSE
                        IF PFC THEN 2320
2340 T2=42:I$=" "+OS$+" ":GOSUB 530:LPRI
NT" ":LPRINT OS1$:LPRINT"AMOUNT ";:LPRIN
    T USING E4$;OS:GOSUB 3930:GOSUB 4040
2350 T9=2:GOSUB 2390:REM SAVE OTHER SALE
                            S TRANSACTION
2360 T1=FRE("")
2370 RETURN
2380 REM  SAVE TRANSACTION TO DISK
2390 GOSUB 1520:V=12:H=19:GOSUB 510:PRIN
     T"WAIT....SAVING TRANSACTION":PRINT
2400 ON T9 GOTO 2410,2530:REM 1= BINGO S
                        ALES: 2= OTHER SALES
2410 REM ON ERROR GOTO *** TBD ***
2420 IF LEN(CN$)<25 THEN CN$=CN$+STRING$
                        (25-LEN(CN$),42)
2430 IF LEN(SN$)<8 THEN SN$=SN$+STRING$(
                        8-LEN(SN$),42)
2440 OPEN "R",#1,"BSALES."+CHR$(47+RN%),
45:FIELD #1, 2 AS T1$:GET #1,1:NOREC%=CV
I(T1$):IF NOREC%=0 THEN NOREC%=2 ELSE NO
                                REC%=NOREC%+
1
2450 FIELD #1, 25 AS CN1$, 8 AS SN1$, 2
AS R$, 2 AS S$,2 AS IBT$, 4 AS TOTAL$,2
                                    AS MS$
2460 LSET CN1$=CN$:LSET SN1$=SN$:RSET R$
=MKI$(R2):RSET S$=MKI$(S2):RSET IBT$=MKI
$(IB2):RSET TOTAL$=MKS$(CKTOTAL):RSET MS
                                $=MKI$(MS%)
2470 PUT #1,NOREC%
2480 IF MS%=0 THEN STOTAL=STOTAL+CKTOTAL
:NOCUST%=NOCUST%+1:TOTREC%=TOTREC%+R2:TO
    TSPEC%=TOTSPEC%+S2:TOTIB%=TOTIB%+IB2
2490 FIELD#1,2 AS T1$,4 AS TOTAL$, 2 AS
NC$,2 AS R$,2 AS S$,2 AS IBT$:RSET T1$=M
KI$(NOREC%):RSET TOTAL$=MKS$(STOTAL):RSE
                                T NC$=MKI$(N
OCUST%):RSET R$=MKI$(TOTREC%):RSET S$=MK
    I$(TOTSPEC%):RSET IBT$=MKI$(TOTIB%)
2500 PUT #1,1
2510 CLOSE#1
2520 RETURN
2530 REM ON ERROR GOTO **** TBD ***
2540 OPEN "R",#1,"OSALES."+CHR$(47+RN%),
34:FIELD#1,2 AS T1$:GET#1,1:NOREC%=CVI(T
1$):IF NOREC%=0 THEN NOREC%=2 ELSE NOREC
                                %=NOREC%+1
2550 OSTOTAL=OSTOTAL+OS
2560 FIELD #1, 30 AS TYP$,4 AS TOTAL$
2570 LSET TYP$=OSI$:RSET TOTAL$=MKS$(OS)
2580 PUT #1,NOREC%:FIELD #1,2 AS T1$,4 A
S TOTAL$:RSET T1$=MKI$(NOREC%):RSET TOTA
                            L$=MKS$(OSTOTAL)
2590 PUT #1,1
2600 CLOSE#1
2610 RETURN
2620 NOWIN%=NOWIN%+NW%:PAYOUTS=PAYOUTS+T
:FIELD#1,2 AS T1$,4 AS TOTAL$,2 AS NW$:R
SET T1$=MKI$(NOREC%):RSET TOTAL$=MKS$(PA
                                YOUTS):RSET
NW$=MKI$(NOWIN%)
2630 PUT #1,1
2640 REM BINGO SESSION IS STILL IN PROGR
                        ESS. GET ALL TOTALS
2650 OPEN"R",#2,"BSALES."+CHR$(47+RN%),4
5:FIELD#2,2AST1$,4 AS TOTAL$,2 AS NC$,2
AS R$,2 AS S$,2 AS IBT$:GET#2,1:STOTAL=C
                                VS(TOTAL$):N
OCUST%=CVI(NC$):TOTREC%=CVI(R$):TOTSPEC%
    =CVI(S$):TOTIB%=CVI(IBT$):CF=1
2660 CLOSE#2
2662 OPEN "R",#1,"OSALES."+CHR$(47+RN%),
34:FIELD#1,2 AS T1$,4 AS TOTAL$:GET#1,1:
        OSTOTAL=CVS(TOTAL$):CLOSE#1
2689 RETURN
2690 REM GET CURRENT TIME FROM RTC
2700 FOR N = 12 TO 0 STEP -1
2710 OUT 60,N: OUT 60,16+N: OUT 60,N
2720 OUT 60,64: T(N)= INP(60)-240: OUT 6
                                0,0: NEXT
2730 IF T(0)=TX THEN GOTO 2700 ELSE TX=T
                                    (0)
2740 MO$=M$((10*T(10))+T(9)):M1$=STR$((1
0*T(10))+T(9)):M1$=RIGHT$(M1$,LEN(M1$)-1
    ):IF LEN(M1$)=1 THEN M1$="0"+M1$
2750 YR=(10*T(12))+T(11):YR$=STR$(YR):YR
            $=RIGHT$(YR$,LEN(YR$)-1)
2760 DA$=STR$((10*T(8))+T(7)):D$=RIGHT$(
DA$,LEN(DA$)-1):IF LEN(D$)=1 THEN D$="0"
                                    +D$
2770 DATE$=M1$+"/"+D$+"/"+YR$
2780 PM = 0: IF T(5) => 4 THEN T(5) = T(
    5) - 4: PM = 1:PM$="PM" ELSE PM$="AM"
2790 H$=STR$((10*T(5))+T(4)):H$=RIGHT$(H
$,LEN(H$)-1):IF LEN(H$)=1 THEN H$="0"+H$
2800 MN$=STR$((10*T(3))+T(2)):MN$=RIGHT$
(MN$,LEN(MN$)-1):IF LEN(MN$)=1 THEN MN$=
                                "0"+MN$
2810 SEC$=STR$((10*T(1))+T(0)):SEC$=RIGH
T$(SEC$,LEN(SEC$)-1):IF LEN(SEC$)=1 THEN
                            SEC$="0"+SEC$
2820 CT$=H$+":"+MN$+" "+PM$
2830 RETURN
2840 GOTO 2950:REM SAVE THIS:IF OF$ <>"O
" THEN 3530 ELSE GOSUB 5250:IF X$=R1$ OR
 X$=C1$ THEN RETURN ELSE IF PFC THEN 340
                                0 ELSE IF I$
<>PW$ THEN PRINT CL$:V=12:H=1:GOSUB 510:
PRINT"      PASSWORD ENTRY INCORRECT ";:
FOR X=1 TO 10:PRINT CHR$(7);:NEXT:RETURN
2850 PRINT CL$;B$:I$=" CAUTION - CAUTION
 - CAUTION - CAUTION - CAUTION - ":GOSUB
                                    650
2860 V=10:H=1:GOSUB 510:PRINT"BINGO SESS
ION IN PROGRESS. DO YOU WANT TO END THE
SESSION (Y/N): ";:AL=56:AH=90:L=1:XL=70:
                            YL=V:GOSUB 4
00
```

```
2870 IF X$=R1$ THEN RETURN ELSE IF X$=C1
                        $ OR PFC THEN 2850
2880 IF I$="N" OR I$<> "Y" THEN RETURN
2890 REM   CLOSE BINGO SESSION
2900 OPEN "R",#1,"CASHIER.DAT",33
2910 FIELD #1, 2 AS T1$,2 AS OF$
2920 RSET T1$=MKI$(RN%):LSET OF$="C":REM
          OF$= BINGO SESSION IS "CLOSED"
2930 PUT#1,1
2940 CLOSE#1
2950 PRINT CL$:I$=" CASHIER'S MENU ":GOS
                                    UB 650
2960 V=12:H=24:GOSUB 510:PRINT"WAIT...LO
                        ADING MAIN MENU ";
2970 RUN"BINGO"
2980 REM  PROCESS PACKAGE DEALS
2990 GOSUB 610:IF E THEN RETURN
3000 T1=0:T6=T1:T3=T1
3010 IF NP%=0 THEN E=1:V=19:H=1:GOSUB 51
0:PRINT STRING$(76,42):PRINT:PRINT "NO P
ACKAGE DEALS AVAILABLE -- ";PR$;" ";:X$=
                                INPUT$(1):IF
 ASC(X$)<>13 THEN PRINT B$;:GOTO 3010 EL
                                SE RETURN
3020 T1=VAL(I$):IF T1>NP% THEN V=19:H=1:
GOSUB 510:PRINT STRING$(76,42):PRINT:PRI
NT"NO. OF PACKAGE DEALS EXCEEDED -- PRES
                                S 'RETURN' "
;:E=1:X$=INPUT$(1):IF ASC(X$)<>13 THEN P
          RINT B$;:GOTO 3010 ELSE RETURN
3030 IF T1=0 THEN E=1:PRINT B$;:RETURN
3040 T6=PC(T1):PR=PD%(T1,1):PS=PD%(T1,2)
:PB=PD%(T1,3):PDS(U)=PC(T1):PDS$(U)=STR$
                                (T1):U=U+1
3050 RETURN
3060 REM  PASSWORD INPUT ROUTINE
3070 PRINT CL$:I$=" PASSWORD ENTRY ":GOS
UB 650:PRINT:IF P THEN PRINT "ENTER PASS
WORD KEY TO CHANGE PASSWORD: "; ELSE PRI
                                NT"ENTER PAS
SWORD PLEASE: ";
3080 AL=32:AH=126:L=4:P=1:GOSUB 400:P=0
3090 RETURN
3100 REM  CLEAR MESSAGE AREA
3110 V=19:H=1:GOSUB 510:FOR Y=1 TO 5:PRI
  NT LI$:NEXT:V=YL:H=XL:GOSUB 510:RETURN
3120 RETURN
3130 REM DISCOUNT ON/OFF PROCEDURE
3140 GOSUB 3070:REM GET PASSWORD ENTRY
3150 IF X$=C1$ THEN 3140 ELSE IF X$=R1$
THEN RETURN ELSE IF I$<>PW$ THEN PRINT C
L$:V=13:H=1:GOSUB 510:PRINT TAB(25)"PASS
                                WORD INVALID
":FOR X=1 TO 10:PRINT B$;:NEXT:RETURN
3160 IF D THEN D=0 ELSE D=1
3170 RETURN
3180 REM  ENTER CASHIERS NAME
3190 PRINT CL$:I$=" CASHIERS NAME ":GOSU
B 650:V=12:H=1:GOSUB 510:PRINT"PLEASE EN
TER CASHIERS NAME: ":PRINT STRING$(25,45
                                );STRING$(25
,8);
3200 AL=32:AH=90:L=25:YL=12:XL=29:GOSUB
                                        400
3210 IF X$=C1$ THEN 3190 ELSE IF X$=R1$
                                THEN RETURN
3220 IF PFC THEN 3190
3230 IF LEN(I$)=0 OR I$=STRING$(LEN(I$),
32) THEN PRINT CL$:V=13:H=1:GOSUB 510:PR
INT B$"CASHIERS NAME MUST BE ENTERED PRI
                                OR TO ANY TR
ANSACTIONS":PRINT:PRINT PR$;:INPUT"",I$:
                                CF=0:RETURN
3240 GOSUB 2700:REM GET DATE FROM RTC
3250 REM ON ERROR GOTO ********
3260 OPEN "R",#1,"CASHIER.DAT",33
3270 FIELD #1, 25 AS T1$,8 AS T2$
3280 LSET T1$=I$:LSET T2$=DATE$
3290 PUT #1,RN%
3300 FIELD #1, 2 AS T1$,2 AS OF$
3310 RSET T1$=MKI$(RN%):LSET OF$="O":REM
          OF$= BINGO SESSION IS "OPEN"
3330 PUT #1,1
3335 OF$="O"
3340 CLOSE#1
3350 CF=1:REM CASHIERS NAME HAS BEEN ENT
                                    ERED FLAG
3360 RETURN
3910 REM      EJECT PRINTER PAPER
3920 REM
3930 GOSUB 2700:REM GET DATE & TIME FROM
                                        RTC
3940 IF T14<>1 THEN LPRINT " "
3950 LPRINT" ":LPRINT D$(T(6));": ";NO$;
                DA$;",";YR+1900;"    ";
3960 IF LEFT$(H$,1)="0" THEN H$=RIGHT$(H
                                    $,1)
3970 LPRINT H$;":";MN$;":";SEC$;:IF PM =
    1 THEN LPRINT " PM" ELSE LPRINT" AM"
3980 FOR X=1 TO 6:LPRINT" ":NEXT
3990 RETURN
4000 REM
4010 REM
4020 REM      PRINT HEADER ON PRINTER
4030 REM
4040 I$=BN$:T2=32:GOSUB 530:I$=BM$:GOSUB
                    530:LPRINT" ":RETURN
4050 PRINT CL$:I$=" PASSWORD ENTRY ":GOS
                                    UB 650
4060 V=12:H=1:GOSUB 510:PRINT"PLEASE ENT
                        ER PASSWORD ";
4070 AL=32:AH=126:L=4:P=1:GOSUB 400:P=0:
                                    RETURN
4080 GOSUB 4050:IF X$=R1$ OR X$=C1$ THEN
 RETURN ELSE IF I$<>PW$ THEN PRINT CL$:V
=12:H=1:GOSUB 510:PRINT"      PASSWORD E
                                NTRY INCORRE
CT ";:FOR X=1 TO 10:PRINT CHR$(7);:NEXT:
                                    RETURN
4090 ON ERROR 5750: I2$="SESSION DATA"
4100 OPEN "R",#1,"CASHIER.DAT",33
4110 FIELD #1, 2 AS T1$,2 AS OF$
4120 GET#1,1:RN%=CVI(T1$):OF$=LEFT$(OF$,
                                        1)
4130 CLOSE#1
4140 IF OF$="O"THEN GOSUB 2650:GOTO 4200
4150 IF RN%=0 THEN RN%=2 ELSE RN%=RN%+1
4160 CLOSE#1:OPEN"R",#1,"BSALES."+CHR$(4
7+RN%),45:CLOSE#1:KILL"BSALES."+CHR$(47+
                                    RN%)
4161 OPEN"R",#1,"OSALES."+CHR$(47+RN%),3
4:CLOSE#1:KILL"OSALES."+CHR$(47+RN%):CLO
SE#1:OPEN"R",#1,"BONUSPAY."+CHR$(47+RN%)
                                ,6:KILL"BONU
SPAY."+CHR$(47+RN%):CLOSE#1
4164 OPEN"R",#1,"BPAY."+CHR$(47+RN%),6:K
ILL"BPAY."+CHR$(47+RN%):CLOSE#1:OPEN"R",
#1,"O/RPAY."+CHR$(47+RN%),56:CLOSE#1:KIL
                                L"O/RPAY."+C
HR$(47+RN%):
4170 RN=RN%
4180 IF RN% >6 THEN PRINT CL$;B$;"THIS D
ISK CAN ONLY BE USED FOR 5 BINGO SESSION
S. PLEASE INSERT ANOTHER DISK.":PRINT:PR
                                INT"PRESS RE
TURN WHEN READY":X$=INPUT$(1):IF X$<>CHR
    $(13) THEN 4180 ELSE RESET:GOTO 10
4190 IF RN%=6 THEN PRINT CL$B$;:V=12:H=1
:GOSUB 510:PRINT "THIS WILL BE THE LAST
BINGO SESSION FOR THIS DISK.  PLEASE MAK
                                E A NOTE OF
IT":FOR X=1 TO 4000:NEXT
4200 ON ERROR GOTO 4510
4210 I2$="PRICING DATA"
4220 OPEN "I",#1,"PRICE.DAT"
4230 INPUT#1,VC$,BN$,BS$,PW$,KPW$,MP,UR,
      US,UB,DB%,DB,DP,IBW%,BM$,IBF%,IBP
4240 CLOSE#1
4250 VC$=VC$+STRING$(16,32)
4260 FOR I = 1 TO 16:DOWNGI%(I+9) = ASC(
MID$(VC$,I,1)):NEXT:REM VALIDATION CODE
                    INTO DOWNLOAD STRING
4270 DOWNGI%(29)=IBW%
4280 I2$="PACKAGE DEAL DATA"
```

```
4290 OPEN "R",#1,"PKDEALS.DAT",10
4300 FIELD #1, 2 AS TJ$
4310 GET #1,1:NP%=CVI(T1$)
4320 FIELD #1, 2 AS T1$,2 AS T2$, 2 AS T
                                3$, 4 AS T4$
4330 FOR X= 2 TO NP%+1
4340 GET #1,X
4350 PD%(X-1,1)=CVI(T1$):PD%(X-1,2)=CVI(
T2$):PD%(X-1,3)=CVI(T3$):PC(X-1)=CVS(T4$
                                         )
4360 NEXT:CLOSE#1:ON ERROR GOTO 0
4370 NCK=0:GOSUB 2700:I$=SEC$:FOR X=1 TO
 500:NEXT X:GOSUB 2700:IF I$=SEC$ THEN N
                                      CK=1
4380 PRINT CL$:I$=" CASHIER'S MENU ":GOS
                                UB 650:PRINT
4385 PRINT"1.  INITIALIZE "WVU$
4390 PRINT"2.  SELL "CARD$
4400 PRINT"3.  "QQ$
4410 PRINT"4.  DISCOUNT ";:IF D THEN PRI
            NT "* ON *" ELSE PRINT "OFF"
4440 PRINT"5.  PAYOUTS"
4450 PRINT"6.  ENTER BANNER MESSAGE"
4455 PRINT"7.  MAIN MENU"
4460 PRINT:PRINT "SELECT ONE: ";
4470 AH=55:AL=49:L=1:YL=10:XL=13:P=0:GOS
                                      UB 400
4480 ON VAL(I$) GOSUB 5570,890,2220,3140
                              ,4580,5630,2840
4490 SC%=0
4500 GOTO 4380
4510 REM    DISK ON ERROR ROUTINES
4520 PRINT CL$;B$;:I$=" CASHIER'S MENU E
RROR TRAP ":GOSUB 650:V=12:H=30:GOSUB 51
          0:PRINT"* * *  ALERT  * * *";B$
4530 H=(40-(LEN(I2$))/2)-9:V=14:GOSUB 51
          0:PRINT I2$;" NOT FOUND ON DISK"
4540 H=10:V=16:GOSUB 510:PRINT"RETURNING
 TO MAIN MENU - REFER TO MANUAL FOR CORR
ECTIVE ACTION";B$:PRINT:PRINT STRING$(25
                                    ," ");PR$;B$
;:INPUT"",I$
4550 CLOSE:GOTO 2950
4560 IF CF=0 THEN GOSUB 3190:IF CF =0 TH
                                     EN RETURN
4590 PRINT CL$:H=15:V=12:GOSUB 510:PRINT
"WAIT...LOADING PAYOUT MENU ";:RUN"PAYPR
                                        GM"
5570 PRINT CL$:I$=" INITIALIZE "+WVU$+"
                                   ":GOSUB 650
5590 V=12:H=1:GOSUB 510:PRINT PR$;:XL=36
:YL=V:L=1:AH=13:AL=13:GOSUB 400:IF X$=R1
$ THEN RETURN ELSE IF X$<>CHR$(13) THEN
                                        5590
5610 PRINT V=12:H=1:GOSUB 510:PRINT TAB(
10);"WAIT...LOADING "WVU$" INITIALIZATIO
                N PROGRAM ";:RUN"WVUPROG"
5620 REM   ENTER BANNER MESSAGE
5630 PRINT CL$:I$=" ENTER BANNER MESSAGE
                                   ":GOSUB 650
5640 V=13:H=1:GOSUB 510:PRINT "CURRENT M
                                  SG.: ";BM$
5650 V=3:H=1:GOSUB 510:PRINT"ENTER BANNE
R MESSAGE":PRINT:PRINT STRING$(40,45);ST
RING$(40,8);:YL=V+1:XL=H:AH=96:AL=32:L=4
                                  0:GOSUB 400
5660 IF X$=R1$ THEN RETURN ELSE IF X$=C1
                          $ OR PFC THEN 5650
5670 IF LEN(I$)=0 THEN PRINT BM$;STRING$
                          (39,32); ELSE BM$=I$
5680 V=13:H=1:GOSUB 510:PRINT PR$;:YL=V:
          XL=16:AH=13:AL=AH:L=1:GOSUB 400
5690 IF X$=R1$ THEN RETURN ELSE IF X$=C1
$ THEN GOSUB 510:GOTO 5640 ELSE IF PFC T
                                     HEN 5680
5700 OPEN "O",#1,"PRICE.DAT"
5710 WRITE#1,VC$,BN$,BS$,PW$,KPW$,MP,UR,
        US,UB,DB%,DB,DP,IBW%,BM$,IBF%,IBP
5720 CLOSE#1
5730 RETURN
10 GOTO 30
20 KILL"WVUPROG.BAK":NAME"WVUPROG.BAS" A
        S "WVUPROG.BAK":SAVE"WVUPROG":END
30 CLEAR:DIM PD%(15,3),PC(15),T(12),M$(1
2),D$(7),SCHED%(322),DOWNGI%(31),PDS(20)
                                  ,PDS$(20)
40 WVU$="WIN VALIDATION UNIT":ESC$=CHR$(
27):CL$=CHR$(26):B$=CHR$(7):ENT$="ENTER
":PR$="PRESS RETURN TO CONTINUE - ":LI$=
                                STRING$(76,3
2):C1$=CHR$(17):R1$=CHR$(13):BA$=CHR$(8)
                                :SP$=CHR$(32)
50 REM PORT ADDRESSES: UART DATA & STATU
          S, COUNTER DATA & CONTROL
60 BSTAT=44:UDAT = 40: USTAT = 41: C0 =
          56: C1 = 57: C2 = 58: CC = 59
70 REM SETUP BAUD RATES
80 OUT CC,55:OUT C0,38:OUT C0,0
90 OUT CC,119:OUT C1,38:OUT C1,0
100 REM RESET UART
110 FOR N = 1 TO 5: OUT USTAT,0:NEXT
120 REM SETUP UART
130 OUT USTAT,64:OUT USTAT,78:OUT USTAT,
                                         21
140 OPEN"I",#1,"UPLOAD.SUB":INPUT#1,SR$:
                                  CLOSE#1
150 GOTO 590
160 I$="":PFC=0
170 X$=INPUT$(1)
180 IF FC THEN FC=0:GOSUB 580:IF X$="\"
THEN X$=C1$:RETURN ELSE IF ASC(X$)=127 T
HEN X$=R1$:RETURN ELSE IF SC% =1 AND ASC
                                (X$)=0  THEN
 X$=T$:RETURN ELSE PFC=1:RETURN
190 IF X$=CHR$(13) THEN RETURN
200 IF X$=BA$ THEN IF LEN(I$)=0 THEN GOT
O 170 ELSE I$=LEFT$(I$,LEN(I$)-1):PRINT
                        BA$;SP$;BA$;:GOTO 170
210 IF X$=ESC$ AND NFC=0 THEN GOSUB 580:
V=YL:H=XL:GOSUB 260:PRINT STRING$(LEN(I$
),32):V=19:H=1:GOSUB 260:PRINT STRING$(2
                                  0,42);"FUNCT
ION CODES";STRING$(20,42);PRINT"1. GO BA
CK TO LAST ENTRY":FC=1:PRINT"2. EXIT TO
CASHIER'S MENU":PRINT"SELECT ONE: ";:GOT
                                       O 160
220 IF ASC(X$)<AL OR ASC(X$) > AH THEN P
                                RINT B$;:GOTO 170
230 IF LEN(I$)=L THEN PRINT B$;:GOTO 170
                                ELSE I$=I$+X$
240 PRINT X$;
250 GOTO 170
260 Y$=CHR$(31+V):X1$=CHR$(31+H):PRINT E
SC$"=  ":PRINT ESC$"=";Y$;X1$;LI$:PRINT
                                ESC$"=";Y$;X1$;
270 RETURN
280 W=1:W=1:GOSUB 250:T1=LEN(I$):T1=INT(
                                T1/2):T1=38-T1
290 PRINT STRING$(T1,127);I$;STRING$(T1,
                                       127)
300 RETURN
310 REM UART INPUT ROUTINE
320 X=0
330 X = X + 1: IF X = 10 THEN DA = 255:
                                     RETURN
340 IF INP(USTAT) AND 2 THEN 350 ELSE 33
                                         0
350 DA = INP(UDAT): RETURN
360 REM ESTABLISH LINK
370 OUT USTAT,13: FOR L = 1 TO 40: NEXT
                  : X=0: REM BREAK OUT
380 IF INP(BSTAT) AND 8 THEN X=X+1 ELSE
                                       400
390 IF X<50 THEN 380 ELSE OUT USTAT,5:RE
          TURN: REM ERROR EXIT X=50
400 OUT USTAT,5: X=0
410 IF INP(BSTAT) AND 8 THEN X=0:RETURN:
                                REM GOOD EXIT
420 X=X+1:IF X<50 THEN 410 ELSE RETURN:
                      REM ERROR EXIT X=50
```

```
430 REM GET CURRENT TIME FROM RTC
440 FOR N = 12 TO 0 STEP -1
450 OUT 60,N: OUT 60,16+N: OUT 60,N
460 OUT 60,64: T(N)= INP(60)-240: OUT 60
                                    ,0: NEXT
470 IF T(0)=TX THEN GOTO 440 ELSE TX=T(0
                                        )
480 MO$=M$((10*T(10))+T(9)):M1$=STR$((10
*T(10))+T(9)):M1$=RIGHT$(M1$,LEN(M1$)-1)
          :IF LEN(M1$)=1 THEN M1$="0"+M1$
490 YR=(10*T(12))+T(11):YR$=STR$(YR):YR$
                  =RIGHT$(YR$,LEN(YR$)-1)
500 DA$=STR$((10*T(8))+T(7)):D$=RIGHT$(D
A$,LEN(DA$)-1):IF LEN(D$)=1 THEN D$="0"+
                                        D$
510 DATE$=M1$+"/"+D$+"/"+YR$
520 PM = 0.:IF T(5) => 4 THEN T(5) = T(5
    ) - 4: PM = 1:PM$="PM" ELSE PM$="AM"
530 H$=STR$((10*T(5))+T(4)):H$=RIGHT$(H$
 ,LEN(H$)-1):IF LEN(H$)=1 THEN H$="0"+H$
540 MN$=STR$((10*T(3))+T(2)):MN$=RIGHT$(
MN$,LEN(MN$)-1):IF LEN(MN$)=1 THEN MN$="
                                      0"+MN$
550 SEC$=STR$((10*T(1))+T(0)):SEC$=RIGHT
$(SEC$,LEN(SEC$)-1):IF LEN(SEC$)=1 THEN
                                SEC$="0"+SEC$
560 CT$=H$+":"+MN$+" "+PM$
570 RETURN
580 V=19:H=1:GOSUB 260:FOR Y=1 TO 5:PRIN
   T LI$:NEXT:V=YL:H=XL:GOSUB 260:RETURN
590 REM
600 OPEN"I",#1,"PRICE.DAT"
610 INPUT#1,VC$:REM GET VALIDATION CODE
620 VC$=VC$+STRING$(16,32)
630 FOR I=1 TO 16:DOWNGI%(I+9)=ASC(MID$(
VC$,I,1)):NEXT:REM VALIDATION CODE INTO
                              DOWNLOAD STRING
640 CLOSE#1
650 OPEN"R",#1,"CASHIER.DAT",33:FIELD#1,
2AST1$,2ASOF$:GET#1,1:RN%=CVI(T1$):OF$=L
                                EFT$(OF$,1)
660 IF OF$=CHR$(0) THEN OF$="C"
670 CLOSE#1:IF OF$="C" THEN IF RN%=0 THE
                      N RN%=2 ELSE RN%=RN%+1
680 RN=RN%
690 GOSUB 1030
700 H=1:V=4:GOSUB 260:PRINT"INSERT "WVU$
" INTO CRADLE UNIT":PRINT:PRINT PR$;:XL=
29:YL=6:AH=13:AL=13:GOSUB 160:IF X$=R1$
                                THEN 1050 EL
SE IF X$=C1$ OR PFC THEN 690
710 IF INP(BSTAT) AND 1 THEN I2$=" BATTE
RY":GOSUB 1040:IF X$=R1$ THEN 1050 ELSE
                                        690
720 V4$="12345678":V4$=V4$+V4$:GOSUB 360
                                :X=INP(UDAT)
730 MID$(SR$,2,1)="6":MID$(SR$,6,1)=CHR$
                                        (15)
740 ULGISR=256*PEEK(VARPTR(SR$)+2)+PEEK(
VARPTR(SR$)+1):CALL ULGISR (V4$):MID$(SR
$,5,1)=CHR$(77):MID$(SR$,9,1)="4"
750 VSN$=MID$(V4$,8,8):N=VAL(MID$(V4$,1,
                        3)):IF N><0 THEN 970
760 IF VSN$><STRING$(8,0) THEN 1010
770 GOSUB 1030
780 H=1:V=3:GOSUB 260:PRINT ENT$;WVU$;"
OPERTOR'S NAME":PRINT:PRINT STRING$(25,4
5);STRING$(25,8);:AH=90:AL=32:XL=H:YL=5:
                                L=25:GOSUB 1
60
790 IF X$=R1$ THEN 1050 ELSE IF X$=C1$ O
                              R PFC THEN 790
800 IF LEN(I$)=0 OR I$=STRING$(LEN(I$),3
                  2) THEN PRINT B$:GOTO 780
810 NAM1$=I$:V=3:H=1:GOSUB 260
820 H=1:V=5:GOSUB 260:PRINT ENT$;WVU$" S
ERIAL NUMBER: ";STRING$(8,45);STRING$(8,
8);:AH=96:AL=45:XL=42:YL=V:L=8:GOSUB 160
830 IF X$=R1$ THEN 1050 ELSE IF PFC THEN
                  820 ELSE IF X$=C1$ THEN 770
840 IF LEN(I$)=0 OR I$=STRING$(LEN(I$),3
2) THEN PRINT B$:GOTO 820 ELSE SN$=I$+"
                                        "
850 FOR I=1 TO 8:DOWNGI%(I+1)=ASC(MID$(S
      N$,I,1)):NEXT:DOWNGI%(1)=ASC("2")
860 X=0:FOR I = 2 TO 30: X=X + DOWNGI%(I
    ): NEXT: DOWNGI%(31)=-X AND 255:XY=0
870 GOSUB 360:IF X><50 THEN 880 ELSE I2$
=" LINK":GOSUB 1040:IF X$=R1$ THEN 1050
        ELSE IF X$=C1$ THEN 690 ELSE 870
880 FOR I=1 TO 31: OUT UDAT,DOWNGI%(I):N
                                        EXT
890 GOSUB 310:IF DA THEN XY=XY+1:IF XY><
5 THEN 870 ELSE I2$=" COMMUNICATIONS":GO
SUB 1040:IF X$=R1$ THEN 1050 ELSE IF X$=
                                C1$ THEN 690
 ELSE 870
900 GOSUB 260:PRINT WVU$" ";LEFT$(SN$,(L
            EN(SN$)-8));" INITIALIZED";
910 H=1:V=14:GOSUB 260:PRINT"ANY MORE ";
WVU$;"S TO INITIALIZE";:INPUT I$:GOSUB 9
20:IF I$="Y" OR I$="YES" THEN GOTO 690 E
                                LSE I$="N":G
OTO 1050
920 PRINT CL$:V=12:H=15:GOSUB 260:PRINT"
WAIT...SAVING "WVU$" DATA: ";:FOR X=1 TO
                                    500:NEXT
930 OPEN"R",#1,"WVU"+CHR$(47+RN%)+".DAT"
,41:FIELD#1,2 AS T$:GET#1,1:RECNO%=CVI(T
1$):IF RECNO%=0 THEN RECNO%=2 ELSE RECNO
                                  %=RECNO%+1
940 GOSUB 440
950 FIELD#1,8 AS TIME$,8 AS SN1$,25 AS N
AM$:LSET TIME$=CT$:LSET SN1$=SN$:LSET NA
M$=NAM1$:PUT#1,RECNO%:FIELD#1,2 AS T1$:R
                                SET T1$=MKI$
(RECNO%):PUT#1,1:CLOSE#1
960 RETURN
970 GOSUB 1030:H=5:V=5:GOSUB 260:PRINT"T
HIS "WVU$" CONTAINS THE FOLLOWING DATA:"
:PRINT:PRINT:PRINT"NUMBER OF VALIDATIONS
                                :  ";N:PRINT
:PRINT"CURRENT SERIAL NUMBER: "VSN$
980 PRINT:PRINT:INPUT"* * * DO YOU WANT
TO OVER WRITE THIS DATA";I$:IF I$="Y" OR
            I$="YES" THEN 990 ELSE 690
990 GOSUB 360:OUT UDAT,ASC("5"):FOR H=1
                                TO 100:NEXT H
1000 GOTO 770
1010 GOSUB 1030:H=5:V=5:GOSUB 260:PRINT"
THIS "WVU$" HAS BEEN PREVIOUSLY INITIALI
ZED":PRINT STRING$(18," ");" AS SERIAL N
                                UMBER:  ";VS
N$
1020 PRINT:PRINT:INPUT"DO YOU WANT TO CH
ANGE THIS SERIAL NUMBER";I$:IF I$="Y" OR
            I$="YES" THEN 770 ELSE 690
1030 PRINT CL$:I$=" INITIALIZE "+WVU$+"S
            ":GOSUB 280:VHM$=I$:RETURN
1040 GOSUB 1030:H=7:V=11:GOSUB 260:PRINT
 WVU$;I2$;" FAILURE DETECTED - PLEASE RE
PLACE";B$:PRINT:PRINT:PRINT SPC(7);PR$;:
                                XL=36:YL=14:
AH=13:AL=13:GOSUB 160:RETURN
1050 IF I$="N" THEN 1070
1060 PRINT CL$:H=1:V=12:GOSUB 260:PRINT"
PRESS 'RETURN' TO EXIT TO THE CASHIER'S
PROGRAM ";:X$=INPUT$(1):IF X$<>CHR$(13)
                                THEN 690
1070 PRINT CL$:H=18:V=12:GOSUB 260:PRINT
"WAIT...RETURNING TO THE CASHIER'S MENU
                            ";:RUN"BINGO-2"
10 REM BINGO PAYOUT PROGRAM  VERSION 1.1
                                        .2
20 REM
30 GOTO 50
40 KILL"PAYPRGM.BAK":NAME "PAYPRGM.BAS"
      AS "PAYPRGM.BAK":SAVE"PAYPRGM":END
50 CLEAR:DIM T(12),M$(12),D$(7),GPO(16,4
,7),PPO(16,4,7),POWUPPAK(16,4,7)
60 LI$=STRING$(76,32):SP$=" ":C1$=CHR$(1
7):R1$=CHR$(18):BA$=CHR$(8):CL$=CHR$(26)
:ESC$=CHR$(27):B$=CHR$(7):E4$="$$####.##
                                    ":E3$="$$##.
##":E2$="###":E1$="##.##":E5$="####.##":
```

```
CARD$="CARDS ":REG$="REGULAR ":SPEC$="SP
                    ECIAL ":ENT$="ENTER "
70 PO$="PAYOUT ":PR$="PRESS 'RETURN' TO
          CONTINUE - ":BPO$="BINGO "+PO$
80 FOR X=1 TO 12:READ M$(X):NEXT:FOR X=1
                    TO 7:READ D$(X):NEXT
90 GOTO 1000
100 DATA "JANUARY","FEBRUARY","MARCH","A
PRIL","MAY","JUNE","JULY","AUGUST","SEPT
  EMBER","OCTOBER","NOVEMBER","DECEMBER"
110 DATA "SUN.","MON.","TUES.","WED.","T
                    HUR.","FRI.","SAT."
120 I$="":PFC=0
130 X$=INPUT$(1)
140 IF FC THEN FC=0:GOSUB 830:IF X$="'"
THEN X$=C1$:RETURN ELSE IF ASC(X$)=127 T
HEN X$=R1$:RETURN ELSE IF SC% =1 AND ASC
                    (X$)=0  THEN
 X$=T$:RETURN ELSE PFC=1:RETURN
150 IF X$=CHR$(13) THEN RETURN
160 IF X$=BA$ THEN IF LEN(I$)=0 THEN GOT
O 130 ELSE I$=LEFT$(I$,LEN(I$)-1):PRINT
                    BA$;SP$;BA$;:GOTO 130
170 IF X$=ESC$ AND NFC=0 THEN GOSUB 830:
V=YL:H=XL:GOSUB 230:PRINT STRING$(LEN(I$
),32):V=19:H=1:GOSUB 230:PRINT STRING$(2
                    0,42);" FUNC
TION CODES ";STRING$(20,42):PRINT"1. GO
BACK TO LAST ENTRY":FC=1:PRINT"2. EXIT T
  O MENU":PRINT"SELECT ONE: ";:GOTO 120
180 IF ASC(X$)<AL OR ASC(X$) > AH THEN P
                    RINT B$;:GOTO 130
190 IF AL=45 THEN IF X$="/" THEN PRINT B
                    $;:GOTO 130
200 IF LEN(I$)=L THEN PRINT B$;:GOTO 130
                    ELSE I$=I$+X$
210 PRINT X$;
220 GOTO 130
230 Y$=CHR$(31+V):X1$=CHR$(31+H):PRINT E
SC$"=  ":PRINT ESC$"=";Y$;X1$;LI$:PRINT
                    ESC$"=";Y$;X1$;
240 RETURN
250 FOR X= GN% TO 16:FOR Y=LN% TO 4:FOR
Z= PL% TO 3:IF SPO(X,Y,Z)<>0 THEN GN1%=X
                    :LN1%=Y:PL1%=Z:X=16:Y=4:Z=3
260 NEXT:PL%=1:NEXT:LN%=1:NEXT:GN%=GN1%:
                    LN%=LN1%:PL%=PL1%
270 RETURN
280 T1=LEN(I$):T1=20-INT((T1/2)+.05):LPR
INT STRING$(T1,T2);I$;:IF LEN(I$)+T1+T1>
                    40 THEN T1=T1-1
290 LPRINT STRING$(T1,T2)
300 RETURN
310 T1=0:E=T1:FOR Y=1 TO LEN(I$)
320 IF MID$(I$,Y,1)="." THEN T1=T1+1:T3=
                    LEN(I$)-Y
330 IF T1>1 THEN Y=LEN(I$):E=1
340 NEXT:IF T3>2 THEN E=1
350 RETURN
360 RETURN
370 E=0:IF ASC(I$)<>80 THEN PRINT B$;:E=
1:RETURN ELSE IF LEN(I$)=1 THEN E=1:PRIN
                    T B$;:RETURN
380 I$=RIGHT$(I$,LEN(I$)-1):FOR Y=LEN(I$
                    ) TO 1 STEP -1
390 IF ASC(MID$(I$,Y,1))>57 AND ASC(MID$
    (I$,Y,1))<91 THEN E=1:Y=1:PRINT B$;
400 NEXT:RETURN
410 V=1:H=1:GOSUB 230:T1=LEN(I$):T1=INT(
                    T1/2):T1=38-T1
420 PRINT STRING$(T1,127);I$;STRING$(T1,
                    127)
430 RETURN
440 PRINT BA$;:IF GPO(GN%,LN%,PL%)= 0 TH
EN AMT=SPO(GN%,LN%,PL%):PRINT USING E4$;
AMT ELSE PRINT USING E4$;GPO(GN%,LN%,PL%
                    ):AMT=0
450 RETURN
460 IF SPO(GN%,LN%,PL%)=0 THEN IF SPO(GN
        %,LN%,2)=0 THEN PL%=1 ELSE PL%=2
470 RETURN
480  H=15:V=12:PRINT CL$:GOSUB 230:PRINT
"WAIT...RETURNING TO THE CASHIER'S MENU
                    ";
490 CLOSE: RUN"BINGO-2"
500 OPEN"R",#1,"BPAY."+CHR$(47+RN%),6
510 FIELD#1,2 AS T1$,4 AS AMT$
520 GET#1,1:RECNO%=CVI(T1$):IF RECNO%=0
        THEN GN%=1:LN%=1:PL%=1:GOTO 600
530 TOTPAY=CVS(AMT$)
540 FOR X=1 TO 16:FOR Y=1 TO 4:FOR Z= 1
                    TO 3
550 PORN%=(INT((X-1)+.05)*12)+(INT((Y-1)
                    +.05)*3)+Z+1
560 GET#1,PORN%:GPO(X,Y,Z)=CVS(AMT$):NEX
                    T:NEXT:NEXT
570 FOR X=1 TO 16:FOR Y=1 TO 4:FOR Z=1 T
                    O 3
580 IF RECNO%=(INT((X-1)+.05)*12)+(INT((
Y-1)+.05)*3)+Z+1 THEN GN%=X:LN%=Y:PL%=Z:
                    X=16:Y=4:Z=3
590 NEXT:NEXT:NEXT
600 CLOSE#1:OPEN"R",#1,"BONUSPAY."+CHR$(
                    47+RN%),6
610 FIELD#1,2 AS T1$,4 AS AMT$
620 GET#1,1:TOTBONUS=CVS(AMT$):RECNO%=CV
            I(T1$):IF RECNO%=0 THEN 660
630 FOR X=1 TO 16:FOR Y=1 TO 4:FOR Z= 1
                    TO 3
640 PORN%=(INT((X-1)+.05)*12)+(INT((Y-1)
                    +.05)*3)+Z+1
650 GET#1,PORN%:BONUSPAY(X,Y,Z)=CVS(AMT$
                    ):NEXT:NEXT:NEXT
660 RETURN
670 REM GET CURRENT TIME FROM RTC
680 FOR N = 12 TO 0 STEP -1
690 OUT 60,N: OUT 60,16+N: OUT 60,N
700 OUT 60,64: T(N)= INP(60)-240: OUT 60
                    ,0: NEXT
710 IF T(0)=TX THEN GOTO 680 ELSE TX=T(0
                    )
720 MO$=M$((10*T(10))+T(9)):M1$=STR$((10
*T(10))+T(9)):M1$=RIGHT$(M1$,LEN(M1$)-1)
        :IF LEN(M1$)=1 THEN M1$="0"+M1$
730 YR=(10*T(12))+T(11):YR$=STR$(YR):YR$
                    =RIGHT$(YR$,LEN(YR$)-1)
740 DA$=STR$((10*T(8))+T(7)):D$=RIGHT$(D
A$,LEN(DA$)-1):IF LEN(D$)=1 THEN D$="0"+
                    D$
750 DATE$=M1$+"/"+D$+"/"+YR$
760 PM = 0 :IF T(5) => 4 THEN T(5) = T(5
    ) - 4: PM = 1:PM$="PM" ELSE PM$="AM"
770 H$=STR$((10*T(5))+T(4)):H$=RIGHT$(H$
,LEN(H$)-1):IF LEN(H$)=1 THEN H$="0"+H$
780 MN$=STR$((10*T(3))+T(2)):MN$=RIGHT$(
MN$,LEN(MN$)-1):IF LEN(MN$)=1 THEN MN$="
                    0"+MN$
790 SEC$=STR$((10*T(1))+T(0)):SEC$=RIGHT
$(SEC$,LEN(SEC$)-1):IF LEN(SEC$)=1 THEN
                    SEC$="0"+SEC$
800 CT$=H$+":"+MN$+" "+PM$
810 RETURN
820 REM  CLEAR MESSAGE AREA
830 V=19:H=1:GOSUB 230:FOR Y=1 TO 5:PRIN
  T LI$:NEXT:V=YL:H=XL:GOSUB 230:RETURN
840 RETURN
850 REM      EJECT PRINTER PAPER
860 REM
870 GOSUB 680:REM GET DATE & TIME FROM R
                    TC
880 IF T4<>5 THEN LPRINT " "
890 LPRINT" ":LPRINT D$(T(6));": ";MO$;D
                    A$;",";YR+1900;"    ";
900 IF LEFT$(H$,1)="0" THEN H$=RIGHT$(H$
                    ,1)
910 LPRINT H$;":";MN$;":";SEC$;:IF PM =1
    THEN LPRINT " PM" ELSE LPRINT" AM"
920 FOR X=1 TO 6:LPRINT" ":NEXT
930 RETURN
940 REM
950 REM
960 REM      PRINT HEADER ON PRINTER
970 REM
980 I$=BN$:T2=32:GOSUB 280:I$=BM$:GOSUB
                    280:LPRINT" ":RETURN
990 ON ERROR 5750: I2$="SESSION DATA"
1000 OPEN "R",#1,"CASHIER.DAT",33
```

```
1010 FIELD #1, 2 AS T1$,2 AS OF$
1020 GET#1,1:RN%=CVI(T1$):OF$=LEFT$(OF$,
                                        1)
1030 CLOSE#1
1040 GOSUB 500:REM GET TOTALS FROM FILES
1050 CLOSE
1060 RN=RN%
1070 OPEN"I",#1,"PAYOUT":FOR X=1 TO 16:F
OR Y=1 TO 4:FOR Z=1 TO 3:INPUT#1,SPO(X,Y
                ,Z):NEXT:NEXT:NEXT:CLOSE#1
1080 GOTO 1140
1090 REM    DISK ON ERROR ROUTINES
1100 PRINT CL$;B$;:I$=" SALES MENU ERROR
 TRAP ":GOSUB 410:V=12:H=30:GOSUB 230:PR
                INT"* * *  ALERT  * * *";B$
1110 H=(40-(LEN(I2$))/2)-9:V=14:GOSUB 23
        0:PRINT I2$;" NOT FOUND ON DISK"
1120 H=10:V=16:GOSUB 230:PRINT"RETURNING
 TO SALES MENU - REFER TO MANUAL FOR COR
RECTIVE ACTION";B$:PRINT:PRINT STRING$(2
                                    5," ");PR$;B
$;:INPUT"",I$
1130 CLOSE:GOTO 1010
1140 PRINT CL$;:I$=" "+BPO$+"MENU ":GOSU
                    B 410:H=1:V=3:GOSUB 230
1150 PRINT"   1.  "BPO$
1160 PRINT"   2.  OTHER PAYOUTS"
1170 PRINT"   3.  REFUNDS"
1180 PRINT"   4.  RETURN TO CASHIER'S ME
                                        NU"
1190 PRINT:PRINT"SELECT ONE: ";:AH=52:AL
            =49:L=1:YL=8:XL=13:GOSUB 120
1200 T=VAL(I$)
1210 ON T GOSUB 1230,2740,2740,480
1220 GOTO 1140
1230 AMT1=0:AMT=0:PRINT CL$:I$=" "+BPO$
1240 GOSUB 410
1250 H=1:V=12:GOSUB 230:PRINT"CURRENT GA
                                ME NO.: ";GN%
1260 H=1:V=3:GOSUB 230:PRINT ENT$"GAME N
O.: ";:AH=57:AL=48:YL=V:XL=17:L=2:GOSUB
120:IF X$=R1$ THEN RETURN ELSE IF X$=C1$
                                    OR PFC THEN
 1250
1270 IF LEN(I$)=0 THEN PRINT TAB(25);GN%
                                    :GOTO 1300
1280 IF VAL(I$)=0 OR VAL(I$) > 16 THEN P
      RINT B$:GOTO 1250 ELSE GN%=VAL(I$)
1290 H=1:GOSUB 230:PRINT ENT$"GAME NO.:
      ";TAB(25);GN%:REM REPOSITION ENTRY
1300 H=1:V=12:GOSUB 230:PRINT"CURRENT LE
                                VEL NO.: ";LN%
1310 H=1:V=4:GOSUB 230:PRINT ENT$"LEVEL
NO.: ";:YL=V:XL=18:AH=52:AL=49:L=1:GOSUB
 120:IF X$=R1$ THEN RETURN ELSE IF X$=C1
                                    $ THEN H=1:G
OSUB 230:GOTO 1250 ELSE IF PFC THEN 1300
1320 IF LEN(I$)=0 THEN PRINT TAB(25);LN%
:GOSUB 460:GOTO 1350 ELSE IF VAL(I$)=0 O
R SPO(GN%,VAL(I$),1)=0 THEN PRINT B$:GOT
                                    O 1300 ELSE
LN%=VAL(I$)
1330 GOSUB 460
1340 H=1:GOSUB 230:PRINT ENT$"LEVEL NO.:
                                    ";TAB(25);LN%
1350 H=1:V=12:GOSUB 230:PRINT"CURRENT PL
                                    ACE: ";PL%
1360 H=1:V=5:GOSUB 230:PRINT ENT$"PLACE:
 ";:YL=V:XL=14:AH=51:AL=49:L=1:GOSUB 120
:IF X$=R1$ THEN RETURN ELSE IF X$=C1$ TH
                                    EN H=1:GOSUB
 230:GOTO 1300 ELSE IF PFC THEN 1350
1370 IF LEN(I$)=0 THEN PRINT TAB(25);PL%
:GOTO 1390 ELSE IF VAL(I$)=0 OR SPO(GN%,
LN%,VAL(I$)) =0 THEN PRINT B$:GOTO 1350
                                    ELSE PL%=VAL
(I$)
1380 H=1:GOSUB 230:PRINT ENT$"PLACE: ";T
                                    AB(25);PL%
1390 H=1:V=12:GOSUB 230: PRINT"CURRENT S
CHEDULED PAYOUT:";:PRINT USING E4$;SPO(G
N%,LN%,PL%);:PRINT TAB(40);"- CURRENT EN
                                    TERED PAYOUT
:";:PRINT USING E4$;GPO(GN%,LN%,PL%)
1400 TEMPAMT=0:H=1:V=6:GOSUB 230:PRINT E
NT$"PAYOUT AMOUNT: $";:YL=V:XL=23:AL=45:
AH=57:L=8:GOSUB 120:IF X$=R1$ THEN RETUR
                                    N ELSE IF X$
=C1$ THEN H=1:GOSUB 230:GOTO 1350 ELSE I
                                    F PFC THEN 1400
1410 IF LEN(I$)=0 THEN GOSUB 440:GOTO 14
                                    50
1420 GOSUB 310:IF E THEN PRINT B$:GOTO 1
                                    390
1430 IF ABS(VAL(I$)) > 9999.99 THEN PRIN
                                    T B$:GOTO 1390
1440 AMT=VAL(I$):T(1)=0:PRINT STRING$(LE
          N(I$)+1,8);:PRINT USING E4$;AMT
1450 IF GPO(GN%,LN%,PL%)+AMT<>SPO(GN%,LN
%,PL%) THEN H=1:V=11:GOSUB 230:PRINT B$;
"SCHEDULED PAYOUT DOES NOT EQUAL ACTUAL
                                    PAYOUT" ELSE
 1470
1460 H=1:V=12:GOSUB 230:PRINT PR$;:AL=13
:AH=AL:L=1:XL=60:YL=V:GOSUB 120:IF X$=R1
$ THEN RETURN ELSE IF X$=C1$ THEN H=1:V=
                                    11:GOSUB 230
:GOTO 1390 ELSE IF PFC THEN 1460
1470 TEMPAMT1=0:T=0:V=11:H=1:GOSUB 230:V
=12:GOSUB 230:PRINT"ANY BONUS PAYOUTS? "
  ;:L=3:XL=20:YL=V:AH=90:AL=65:GOSUB 120
1480 IF X$=R1$ THEN RETURN ELSE IF X$=C1
        $ THEN 1390 ELSE IF PFC THEN 1470
1490 IF I$="Y" OR I$="YES" THEN 1500 ELS
                                    E 1560
1500 T=1:H=1:V=12:GOSUB 230:PRINT"CURREN
T ENTERED BONUS PAYOUT FOR THIS GAME, LE
VEL, PLACE:";:PRINT USING E4$;BONUSPAY(G
                                    N%,LN%,PL%):
V=7:H=1:GOSUB 230:PRINT ENT$"BONUS PAYOU
T AMOUNT: $";:YL=V:XL=29:AL=45:AH=57:L=8
                                    :GOSUB 120
1510 IF X$=R1$ THEN RETURN ELSE IF X$=C1
$ THEN H=1:GOSUB 230:GOTO 1470 ELSE IF P
                                    FC THEN 1500
1520 IF LEN(I$)=0 THEN AMT1=0:PRINT USIN
                                    G E4$;0:GOTO 1560
1530 GOSUB 310:IF E THEN PRINT B$:GOTO 1
                                    500
1540 IF ABS(VAL(I$)) > 9999.99 THEN PRIN
                                    T B$:GOTO 1500
1550 AMT1=VAL(I$)
1560 IF GPO(GN%,LN%,PL%)>0 THEN GOTO 250
0 ELSE V=12:H=1:GOSUB 230:PRINT ENT$"NUM
BER OF WINNERS: ";:L=2:XL=20:YL=V:AH=57:
                                    AL=48:GOSUB
120:IF X$=R1$ THEN RETURN ELSE IF X$=C1$
 AND T=1 THEN GOTO 1500 ELSE IF X$=C1$ A
ND T=0 THEN GOTO 1470 ELSE IF PFC THEN 1
                                    560
1562 IF I$="" THEN NOWIN%=1 ELSE NOWIN%=V
                                    AL(I$)
1565 IF NOWIN%=1 THEN GOSUB 2000:GOTO 25
                                    00
1570 IF AMT>0 THEN GOSUB 1700
1580 IF AMT1>0 THEN GOSUB 1900
1590 GOTO 2500
1700 TEMPAMT=INT((AMT/NOWIN%)+.99)
1710 V=6:H=1:GOSUB 230:PRINT ENT$"PAYOUT
 AMOUNT:        ";:PRINT USING E4$;TEMPAM
                                    T*NOWIN%
1720 V=15:H=1:GOSUB 230:PRINT "PAYOUT PE
R PERSON:       ";:PRINT USING E4$;TEMPAM
                                    T
1740 RETURN
1900 TEMPAMT1=INT((AMT1/NOWIN%)+.99)
1910 V=7:H=1:GOSUB 230:PRINT ENT$"BONUS
PAYOUT AMOUNT: ";:PRINT USING E4$;TEMPAM
                                    T1*NOWIN%
1920 V=16:H=1:GOSUB 230:PRINT "BONUS AMO
UNT PER PERSON:";:PRINT USING E4$;TEMPAM
                                    T1
1940 RETURN
2000 IF TEMPAMT>0 THEN TEMPAMT=0:V=6:H=1
:GOSUB 230:PRINT ENT$"PAYOUT AMOUNT:
                    ";:PRINT USING E4$;AMT
```

```
2010 IF TEMPAMT1>0 THEN TEMPAMT1=0:V=7:H
=1:GOSUB 230:PRINT ENT$"BONUS PAYOUT AMO
                UNT: ";:PRINT USING E4$;AMT1
2020 RETURN
2500 H=1:V=12:GOSUB 230:PRINT PR$;:AL=13
:AH=AL:L=1:XL=60:YL=V:GOSUB 120:IF X$=R1
$ THEN RETURN ELSE IF X$=C1$ THEN V=15:H
                                =1:GOSUB 230
:V=16:GOSUB 230:IF GPO(GN%,LN%,PL%)>0 TH
                                EN 1470 ELSE 1560
2502 IF PFC THEN 2500
2510 IF AMT=0 AND AMT1=0 THEN 2680 ELSE
PRINT CL$:H=20:V=12:GOSUB 230:PRINT"WAIT
                ...SAVING TRANSACTION ";
2515 IF TEMPAMT>0 THEN AMT=TEMPAMT*NOWIN
                                        %
2516 IF TEMPAMT1>0 THEN AMT1=TEMPAMT1*NO
                                        WIN%
2520 GPO(GN%,LN%,PL%)=GPO(GN%,LN%,PL%)+A
MT:TOTPAY=TOTPAY+AMT:BONUSPAY(GN%,LN%,PL
%)=BONUSPAY(GN%,LN%,PL%)+AMT1:TOTBONUS=T
                                OTBONUS+AMT1
2530 OPEN"R",#1,"SPAY."+CHR$(47+RN%),6
2540 FIELD#1,2 AS T1$,4 AS AMT$:GET#1,1:
                                PORN1%=CVI(T1$)
2550 RSET T1$=" ":RSET AMT$=MKS$(GPO(GN%
                                ,LN%,PL%))
2560 PORN%=(INT((GN%-1)+.05)*12)+(INT((L
                                N%-1)+.05)*3)+PL%+1
2570 PUT#1,PORN%
2580 IF PORN1%>= PORN% THEN RSET T1$=MKI
$(PORN1%) ELSE RSET T1$=MKI$(PORN%)
2590 RSET AMT$=MKS$(TOTPAY):PUT#1,1
2600 CLOSE#1
2610 OPEN"R",#1,"BONUSPAY."+CHR$(47+RN%)
                                        ,6
2620 FIELD#1,2 AS T1$,4 AS AMT$
2630 RSET T1$=" ":RSET AMT$=MKS$(BONUSPA
                                Y(GN%,LN%,PL%))
2640 PUT#1,PORN%
2650 IF PORN1%=> PORN% THEN RSET T1$=MKI
$(PORN1%) ELSE RSET T1$=MKI$(PORN%)
2660 RSET AMT$=MKS$(TOTBONUS):PUT#1,1
2670 CLOSE#1
2680 PL%=PL%+1:IF PL%>3 THEN PL%=1:LN%=1
                                        N%+1
2690 IF LN%>4 THEN LN%=1:GN%=GN%+1:PL%=1
                                        ELSE
2700 IF GN%>16 THEN GN%=16
2710 IF SPO(GN%,LN%,PL%)=0 THEN GOSUB 25
                                        0
2720 H=1:FOR V=4 TO 7:GOSUB 230:NEXT:GOT
                                        O 1230
2730 RETURN
2740 PRINT CL$:IF T=2 THEN I$=" OTHER PA
                YOUT " ELSE I$=" REFUNDS "
2750 GOSUB 410
2760 H=1:V=3:GOSUB 230:PRINT ENT$"DISCRI
PTION: ";STRING$(25,45);STRING$(25,8);:A
    H=96:AL=32:YL=V:XL=20:L=25:GOSUB 120
2770 IF X$=R1$ THEN RETURN ELSE IF X$=C1
                $ OR PFC THEN 2760
2780 IF LEN(I$)=0 OR I$=STRING$(LEN(I$),
 32) THEN PRINT B$:GOTO 2760 ELSE SN$=I$
2790 H=1:V=5:GOSUB 230:PRINT ENT$"RECIPI
ENT ID: ";STRING$(25,45);STRING$(25,8);:
    YL=V:XL=21:AH=96:AL=32:L=25:GOSUB 120
2800 IF X$=R1$ THEN RETURN ELSE IF X$=C1
$ THEN H=1:GOSUB 230:GOTO 2760 ELSE IF P
                                FC THEN 2790
2810 IF LEN(I$)=0 OR I$=STRING$(LEN(I$),
 32) THEN PRINT B$:GOTO 2790 ELSE CN$=I$
2820 H=1:V=7:GOSUB 230: PRINT ENT$;:IF T
=2 THEN PRINT PO$"AMOUNT: $"; ELSE PRINT
                "REFUND AMOUNT: $";
2830 YL=V:XL=23:AL=45:AH=57:L=8:GOSUB 12
0:IF X$=R1$ THEN RETURN ELSE IF X$=C1$ T
HEN H=1:GOSUB 230:GOTO 2790 ELSE IF PFC
                                THEN 2820
2840 GOSUB 310:IF E THEN PRINT B$:GOTO 2
                                        820
2850 IF ABS(VAL(I$)) > 9999.99 OR VAL(I$
)=0 THEN PRINT B$:GOTO 2820 ELSE AMT=VAL
                                        (I$)
2860 H=1:V=9:GOSUB 230:PRINT PR$;:AL=13:
AH=AL:L=1:XL=60:YL=V:GOSUB 120:IF X$=R1$
 THEN RETURN ELSE IF X$=C1$ THEN H=1:GOS
                                UB 230:GOTO
2820 ELSE IF PFC THEN 2860
2970 PRINT CL$:AH=15:AV=12:GOSUB 270:PRINT
"WAIT...SAVING TRANSACTION ";:OPEN"R",#1
,"D/RPAY."+CHR$(47+RN%),56:FIELD#1,2 AS
                                T1$,25 AS DI
SC$,25 AS TYP$,4 AS AMT$:GET#1,1:RECNO%=
CVI(T1$):IF RECNO%=0 THEN RECNO%=2 ELSE
                                RECNO%=RECNO%+1
2980 RSET T1$=MKI$(T-2):LSET DISC$=SN$:L
        SET TYP$=CN$:RSET AMT$=MKS$(AMT)
2990 PUT#1,RECNO%:RSET T1$=MKI$(RECNO%):
                                PUT#1,1:CLOSE#1
2900 RETURN
10 REM ACCOUNTING PROGRAM_____
                                        VER 1.0.1
20 GOTO 40
30 KILL"ACOUNT-1.BAK":NAME "ACOUNT-1.BAS
  " AS "ACOUNT-1.BAK":SAVE"ACOUNT-1":END
40 CLEAR:DIM GS%(16,4),PO%(15,3),PC(15),
  M$(12),T(12),D$(7),PO(16,4,3),FCN$(20)
50 LI$=STRING$(76,32):SP$=" ":C1$=CHR$(1
7):R1$=CHR$(13):BA$=CHR$(8):CL$=CHR$(26)
:ESC$=CHR$(27):S$=CHR$(7):E4$="$$####.##
                                ":E3$="$$##.
##":E2$="####":E5$="####.##":T$=CHR$(19)
:CARD$="CARDS ":REG$="REGULAR ":SPEC$="S
                PECIAL ":ENT$="ENTER "
60 E6$="$$##,###.##":E7$="##":DL$="DETAI
L LISTING OF ":BI$="BINGO ":WU$="WIN VAL
                IDATION UNIT"
70 PO$="PAYOUT ":CUST$="CUSTOMER NO. ":I
B$="INSTANT BINGO ":OS$="OTHER SALES":PR
$="PRESS 'RETURN' TO CONTINUE ":TL$="TOT
                                AL"
80 FOR X=1 TO 12:READ M$(X):NEXT:FOR X=1
                TO 7:READ D$(X):NEXT
90 OPEN"I",#1,"UPLOAD.SUB":INPUT#1,SR$:C
                                LOSE#1
100 MID$(SR$,6,1)=CHR$(15)
110 BSTAT=44:UDAT=40:USTAT=41:C0=56:C1=5
                7:C2=58:CC=59
120 REM SETUP BAUD RATES
130 OUT CC,55:OUT C0,38:OUT C0,0
140 OUT CC,119:OUT C1,38:OUT C1,0
150 REM RESET UART
160 FOR N = 1 TO 5: OUT USTAT,0:NEXT
170 REM SETUP UART
180 OUT USTAT,64:OUT USTAT,78:OUT USTAT,
                                        21
190 GOTO 3400
200 DATA "JANUARY ","FEBUARY ","MARCH ",
"APRIL ","MAY ","JUNE ","JULY ","AUGUST.
","SETEMBER ","OCTOBER ","NOVEMBER ","DE
                                CEMBER "
210 DATA "SUN","MON","TUES","WED","THUR"
                                ,"FRI","SAT"
220 I$="":PFC=0
230 X$=INPUT$(1)
240 IF FC THEN FC=0:GOSUB 650:IF X$="`"
THEN X$=C1$:RETURN ELSE IF ASC(X$)=127 T
HEN X$=R1$:RETURN ELSE IF SC% =1 AND ASC
                                (X$)=0  THEN
 X$=T$:RETURN ELSE PFC=1:RETURN
250 IF X$=CHR$(13) THEN RETURN
260 IF X$=BA$ THEN IF LEN(I$)=0 THEN GOT
O 230 ELSE I$=LEFT$(I$,LEN(I$)-1):PRINT
                BA$;SP$;BA$;:GOTO 230
270 IF X$=ESC$ AND NFC=0 THEN GOSUB 650:
V=YL:H=XL:GOSUB 330:PRINT STRING$(LEN(I$
),32):V=19:H=1:GOSUB 330:PRINT STRING$(2
                0,42);" FUNC
TION CODES "&STRING$(20,42)&PRINT"1. GO
                BACK TO LAST ENTRY":FC=1
280 IF X$=ESC$ AND NFC=0 THEN IF SC%=1 T
HEN PRINT"2. CANCEL AND RETURN TO MENU":
```

```
PRINT"3. "TL$:PRINT "SELECT ONE :";:GOTO
                                    220 ELSE PR
INT"2. FINISHED AND RETURN TO MENU":PRIN
                T "SELECT ONE :";:GOTO 220
290 IF ASC(X$)<AL OR ASC(X$) > AH THEN P
                                RINT B$;:GOTO 230
300 IF LEN(I$)=L THEN PRINT B$;:GOTO 230
                                    ELSE I$=I$+X$
310 PRINT X$;
320 GOTO 230
330 X$=CHR$(71+W):X1$=CHR$(71+W):PRINT E
SC$="  ":PRINT ESC$=";Y$;X1$;LI$:PRINT
                                    ESC$=";Y$;X1$;
340 RETURN
350 T1=LEN(I$):T1=20-INT((T1/2)+.05):LPR
INT STRING$(T1,T2);I$;:IF LEN(I$)+T1+T1>
                                    40 THEN T1=T1-1
360 LPRINT STRING$(T1,T2)
370 RETURN
380 REM    PRINT SCREEN HEADER
390 REM
400 PRINT CL$:V=1:H=1
410 GOSUB 330:T1=LEN(I$):T1=INT(T1/2):T1
                                        =38-T1
420 PRINT STRING$(T1,127);I$;STRING$(T1,
                                        127)
430 RETURN
440 E=0:IF RN%=0 THEN PRINT B$;CL$:V=12:
H=1:GOSUB 330:PRINT"NO "BI$"SESSION DATA
 AVAILABLE ON THIS DISKETT.  PRESS ANY K
                                EY TO CONTIN
UE: ":V=21:GOSUB 330:Y$=INPUT$(1):E=1
450 RETURN
460 V=12:H=1:GOSUB 330:PRINT B$"THIS "WU
$" CONTAINS NO DATA. PRESS ANY KEY TO CO
                                NT ";:X$=INPUT$(1)
470 RETURN
480 Z=NOREC%:FOR X=1 TO Z
490 REM GET CURRENT TIME FROM RTC
500 REM
510 FOR N = 12 TO 0 STEP -1
520 OUT 60,N: OUT 60,16+N: OUT 60,N
530 OUT 60,64: T(N)= INP(60)-240: OUT 60
                                        ,0: NEXT
540 IF T(0)=TX THEN GOTO 510 ELSE TX=T(0
                                        )
550 MO$=M$((10*T(10))+T(9))
560 YR=(10*T(12))+T(11)
570 DA$=STR$((10*T(8))+T(7))
580 PM = 0 :IF T(5) => 4 THEN T(5) = T(5
                                    ) - 4: PM = 1
590 HR$=STR$((10*T(5))+T(4)):HR$=RIGHT$(
HR$,LEN(HR$)-1):IF LEN(HR$)=1 THEN HR$="
                                        0"+HR$
600 MN$=STR$((10*T(3))+T(2)):MN$=RIGHT$(
MN$,LEN(MN$)-1):IF LEN(MN$)=1 THEN MN$="
                                        0"+MN$
610 SEC$=STR$((10*T(1))+T(0)):SEC$=RIGHT
$(SEC$,LEN(MN$)-1):IF LEN(SEC$)=1 THEN S
                                    EC$="0"+SEC$
620 RETURN
630 REM  CLEAR MESSAGE AREA
640 REM
650 V=19:H=1:GOSUB 330:FOR Y=1 TO 5:PRIN
    T LI$:NEXT:V=YL:H=XL:GOSUB 330:RETURN
660 RETURN
670 REM      EJECT PRINTER PAPER
680 REM
690 GOSUB 510:REM GET DATE & TIME FROM R
                                        TC
700 LPRINT" ":LPRINT D$(T(6));": ";MO$;D
                    A$;",";YR+1900;"    ";
710 LPRINT HR$;":";MN$;":";SEC$;:IF PM =
    1 THEN LPRINT " PM" ELSE LPRINT" AM"
720 FOR X=1 TO 7:LPRINT" ":NEXT
730 RETURN
740 REM          PRINT HEADER ON PRINTER
750 REM
760 I$=BN$:T2=32:GOSUB 350:I$=BM$:GOSUB
                                    350:RETURN
770 OPEN"R",#1,"BSALES."+CHR$(48+X),45:F
 IELD#1,2 AS NR$:GET#1,1:NOREC%=CVI(NR$)
780 FIELD#1,25 AS CN1$,8 AS SN1$,2 AS R$
,2 AS S1$,2 AS IB1$,4 AS TOTAL$,2 AS MS$
790 RETURN
800 FOR Z=1 TO LEN(CN$):IF MID$(CN$,Z,1)
 = "*" THEN FCN$(W)=LEFT$(CN$,Z-1):Z=LEN
                                (CN$):CN$=FCN$(W)
810 NEXT:RETURN
820 FOR Z=1 TO LEN(SN$):IF MID$(SN$,Z,1)
 ="*" THEN SN$=LEFT$(SN$,Z-1):Z=LEN(SN$)
830 NEXT
840 RETURN
850  GOSUB 440:IF E THEN RETURN ELSE PRI
 NT CL$:I$=" SUMMARY  REPORT ":GOSUB 400
860 GOSUB 880:IF X$=R1$ THEN RETURN ELSE
                                    GOSUB 950
870 RETURN
880 PRINT"THE DATES ARE:";TAB(40);"CASHI
                        ER'S NAME:":PRINT" "
890 FOR Y=1 TO RN%:PRINT "SESSION";Y"- "
        ;NBS$(Y,2);TAB(40);NBS$(Y,1):NEXT
900 V=13:H=1:GOSUB 330:PRINT"SELECT ONE:
 ";:YL=V:XL=13:AL=49:AH=48+RN%:GOSUB 220
910 IF X$=R1$ THEN RETURN ELSE IF X$=C1$
                                OR PFC THEN 900
920 V=3:H=1:GOSUB 330:V=5:GOSUB 330:V=13
:GOSUB 330:FOR Y= 1 TO RN%:V=Y+6:GOSUB 3
                                    30:NEXT
930 X=VAL(I$)
940 RETURN
950 PRINT CL$:I$=" SUMMARY REPORT FOR "+
            BI$+"SESSION #"+I$:GOSUB 400
960 V=3:H=1:I$=" "+BI$+"SALES ":GOSUB 41
                                        0
970 V=5:H=1:GOSUB 330:PRINT"  "TL$;TAB(1
8);"REGULAR";TAB(35);"SPECIAL";TAB(51);"
                                    INSTANT"
980 V=6:H=1:GOSUB 330:PRINT"CUSTOMERS";T
AB(19);"CARDS";TAB(36);"CARDS";TAB(52);B
                                    I$;TAB(67);TL$
990 PRINT TAB(3);NC%(X);TAB(18);NR%(X);T
AB(35);NS%(X);TAB(51);NIB%(X);TAB(60);:P
                    RINT USING E4$;TOT(X)
1000 V=8:H=1:I$=" "+OS$+" ":GOSUB 410
1010 V=10:H=1:GOSUB 330:PRINT"NUMBER OF
                                "OS$;TAB(67);TL$
1020 PRINT;TAB(8);NOS%(X);TAB(60);:PRINT
                                USING E4$;OS(X)
1030 V=12:H=1:I$=" PAYOUTS ":GOSUB 410
1040 V=13:H=4:GOSUB 330:PRINT "PAYOUT";T
AB(26);"BONUS";TAB(46);"OTHER";TAB(66);"
                                    REFUNDS
1050 V=14:H=1:GOSUB 330:PRINT "   "TL$;T
AB(29)"PAYOUT";TAB(49);"PAYOUT";TAB(69);
                                        TL$
1060 PRINT USING E4$;TOTPAY(X);:PRINT TA
B(23);:PRINT USING E4$;TOTBONUS(X);:PRIN
T TAB(43);:PRINT USING E4$;OTHERPAY(X);:
                                PRINT TAB(63
);:PRINT USING E4$;REFUND(X)
1070 NET=TOT(X)+OS(X)-TOTPAY(X)-TOTBONUS
                (X)-REFUND(X)-OTHERPAY(X)
1080 V=18:H=1:GOSUB 330:PRINT" NET INCOM
                E/LOSS";STRING$(38,"-");
1085 IF NET<0 THEN PRINT"(";:PRINT USING
 E6$;ABS(NET);:PRINT" )" ELSE PRINT USIN
                                    G E6$;NET
1090 V=20:H=1:GOSUB 330:INPUT"PRINT THIS
 REPORT (Y/N) ",X$:IF X$ <>"Y" AND X$<>"
          YES" AND X$<>"YE" THEN RETURN
1100 I$="SUMMARY REPORT FOR "+BI$+"SESSI
          ON #"+STR$(X):T2=32:GOSUB 350
1110 LPRINT" ":I$=" "+BI$+"SALES ":GOSUB
                                    350
1120 LPRINT"NO. OF CUSTOMER";STRING$(19,
                                    "-");NC%(X)
1130 LPRINT TL$" REGULAR CARDS SOLD-----
                                    -----";NR%(X)
1140 LPRINT TL$" SPECIAL CARDS SOLD-----
                                    -----";NS%(X)
1150 LPRINT TL$" "IB$"CARDS SOLD----";NI
                                    B%(X)
1160 LPRINT TL$" "BI$"SALES-------------
                    ";:LPRINT USING E4$;TOT(X)
```

```
1170 LPRINT" ":I$=" "+OS$+" ":GOSUB 350
1180 LPRINT"NO. OF SALES----------
                        ------";NOS%(X)
1190 LPRINT TL$" AMOUNT----------
                -";:LPRINT USING E4$;OS(X)
1200 LPRINT TL$" SALES----------"
        ;:LPRINT USING E6$;OS(X)+TOT(X)
1210 LPRINT" ":I$=" PAYOUTS ":GOSUB 350
1220 LPRINT TL$" "BI$PO$"AMOUNT---";:LPR
                INT USING E4$;TOTPAY(X)
1230 LPRINT TL$" BONUSES PAID----------"
        ;:LPRINT USING E4$;TOTBONUS(X)
1240 LPRINT TL$" OTHER PAYOUTS---------"
        ;:LPRINT USING E4$;OTHERPAY(X)
1250 LPRINT TL$" REFUNDS----------"
        ;:LPRINT USING E4$;REFUND(X)
1260 LPRINT TL$" PAYOUTS----------"
;:LPRINT USING E4$;TOTBONUS(X)+OTHERPAY(
                X)+TOTPAY(X)+REFUND(C)
1270 LPRINT" ":LPRINT "NET INCOME/LOSS--
                        ----------";
1275 IF NET<0 THEN LPRINT"(";:LPRINT USI
NG E4$;ABS(NET);:LPRINT" )" ELSE LPRINT
                        USING E4$;NET
1280 GOSUB 690:GOSUB 760
1290 RETURN
1300 PRINT CL$:V=12:H=10:GOSUB 330:PRINT
 "PRESS RETURN WHEN YOU ARE READY TO PRI
NT DATA. ";:YL=V:XL=58:L=1:AH=13:AL=13:G
                        OSUB 220
1310 IF X$=C1$ OR PFC THEN 1300
1320 RETURN
1330 MS%=0:FLAG=0:GOSUB 440:IF E THEN RE
TURN ELSE PRINT CL$:I$=" DETAIL LISTING
        OF "+BI$+"SALES ":GOSUB 400
1340 I1$=I$
1350 GOSUB 880:IF X$=R1$ THEN RETURN
1360 GOSUB 1300:IF X$=R1$ THEN RETURN
1370 PRINT CL$:V=12:H=25:GOSUB 330:PRINT
        "WAIT...PRINTING DATA: ";
1380 I$=I1$:T2=32:GOSUB 350:LPRINT" "
1390 GOSUB 770:REM GET REC. NO
1400 IF NOREC%=0 THEN LPRINT"NO "BI$"SAL
                ES ON DISK":GOTO 1580
1410 FOR Y=2 TO NOREC%
1420 GET#1,Y:SN$=SN1$:CN$=CN1$
1430 GOSUB 800:GOSUB 820:REM REMOVE "*"
                FROM CUST NO. AND S/N
1440 MS%=CVI(MS$):R1%=CVI(R$):S1%=CVI(S1
$):IB%=CVI(IB1$):TOTAL=CVS(TOTAL$)
1450 IF MS%>0 AND FLAG = 1 THEN GOTO 155
                                0
1460 IF MS% >0 THEN FLAG =1
1470 IF MS%=0 AND FLAG =1 THEN FLAG=0:GO
                                TO 1550
1480 T=1
1490 LPRINT CUST$;CN$:LPRINT" "
1500 IF R1%>0 THEN LPRINT"REGULAR CARDS
        :";:LPRINT USING E2$;R1%
1510 IF S1%>0 THEN LPRINT"SPECIAL CARDS
        :";:LPRINT USING E2$;S1%
1520 IF IB%>0 THEN LPRINT IB$" :";:LPRIN
                T USING E2$;IB%
1530 LPRINT TL$" AMOUNT  ";:LPRINT USING
                        E4$;TOTAL
1540 LPRINT"CARD(S) SERIAL NUMBER  :":LP
                        RINT" "
1550 LPRINT TAB(T);SN$;:T=T+9:IF T>35 TH
                EN T=1:LPRINT" "
1560 IF MS%=0 THEN LPRINT" ":LPRINT" "
1570 NEXT
1580 CLOSE#1
1590 GOSUB 690:GOSUB 760
1600 RETURN
1610 REM      READ VALIDATION UNITS
1620 REM
1630 OPEN"R",2,"FORMAT.NAM",18:FIELD#2,1
6 AS NAM$:OPEN"R",3,"GAME.DAT",2:FIELD#3
,2 AS FORMAT$:OPEN"R",#1,"WVU."+CHR$(48+
                        RN%),15
1640 I$=" READ VALIDATION UNIT ":GOSUB 4
                        00
1650 V=12:H=5:GOSUB 330:PRINT"PLUG "WU$"
                INTO CRADLE AND ";PR$;
1660 YL=V:XL=74:L=1:AH=13:AL=AH:GOSUB 22
                        0
1670 IF X$=R1$ THEN CLOSE:RETURN ELSE IF
                X$=C1$ OR PFC THEN 1650
1680 IF INP(BSTAT) AND 1 THEN V=12:H=1:G
OSUB 330:H=15:GOSUB 330:PRINT"BAD BATTER
   IES ";PR$;:X$=INPUT$(1):H=1:GOTO 1650
1690 REM GET DATA FROM WVU. STORED IN A4
                                $
1700 FIELD#1,2 AS NR$:GET#1,1:RECNO%=CVI
(NR$):IF RECNO%=0 THEN RECNO%=2 ELSE REC
                        NO%=RECNO%+1
1710 FIELD#1,15 AS DAT$
1720 A4$="12345678":A4$=A4$+A4$: GOSUB 2
                200:X=INP(UDAT)
1730 MID$(SR$,2,1)="6":REM UPLOAD HEADER
                        COMMAND
1740 GOSUB 2110:REM GET RECORD
1750 WSN$=MID$(A4$,8,8):I$=" "+WU$+" DAT
A ":I1$=I$:GOSUB 400:H=1:V=2:GOSUB 330:P
RINT"NUMBER OF VALIDATIONS: ";VAL(LEFT$(
                A4$,3));:PRI
NT"     SERIAL NUMBER: ";WSN$:PRINT
1760 N = VAL(MID$(A4$;1,3)):IF N=0 THEN
                        1830
1770 PRINT"  CARD(S)":PRINT"SERIAL NO.
 GAME     LEVEL     PLACE     CARD     F
                ORMAT NAME"
1780 LCNTR=6:H=1:XL=H
1790 LSET DAT$=LEFT$(A4$,15):PUT#1,RECNO
                                %
1800 MID$(SR$,2,1)="7":REM UPLOAD NEXT R
                ECORD COMMAND
1810 FOR I = 1 TO N:GOSUB 2200:Q=INP(UDA
T):GOSUB 2110:LSET DAT$=LEFT$(A4$,15):PU
T#1,RECNO%+I:GOSUB 2000:NEXT:RECNO%=RECN
                        O%+N+1
1820 FIELD#1,2 AS NR$:RSET NR$=MKI$(RECN
                O%):PUT#1,1
1830 IF N=0 THEN GOSUB 460:GOTO 1640:REM
                NO DATA IN WVU
1840 GOSUB 2200:OUT UDAT,ASC("5"):REM CL
                        EAR WVU
1850 H=1:V=19:GOSUB 330:PRINT"PRINT THIS
 WVU DATA? ";:YL=V:XL=22:AH=90:AL=55:L=3
:GOSUB 220:IF X$=R1$ THEN CLOSE:RETURN E
                LSE IF X$=C1
$ OR PFC THEN 1850
1860 IF LEN(I$)=0 THEN 1640 ELSE IF I$<>
        LEFT$("YES",LEN(I$)) THEN 1640
1870 H=1:V=19:GOSUB 330:PRINT"PRINTING W
        VU DATA ";:GOSUB 760:LPRINT" "
1880 T2=ASC("*"):I$=I1$:GOSUB 350:LPRINT
 TAB(8);"NUMBER OF";TAB(28);"SERIAL":LPR
INT TAB(7);"VALIDATIONS";TAB(28);"NUMBER
                ":LPRINT TAB
(11):LPRINT USING E7$;N;:LPRINT TAB(28);
                        WSN$
1890 LPRINT"CARD":LPRINT"S/N";TAB(10);"G
        A LE PL.CRD  FORMAT NAME"
1900 FIELD#1,15 AS DAT$:RECNO%=RECNO%-N-
                        1
1910 FOR I=1 TO N
1920 GET#1,RECNO%+I:A4$=DAT$:GOSUB 1950
1930 NEXT:GOSUB 690
1940 GOTO 1640
1950 J=ASC (MID$(A4$,2,1)) AND 15: IF J
= 15 THEN LPRINT MID$(A4$,8,8);" "IB$:RE
                        TURN
1960 SN$=MID$(A4$,8,8):GAME=VAL(MID$(A4$
,5,2)):LEVEL$=MID$(A4$,7,1):CRD=VAL(MID$
        (A4$,2,1)):PLACE$=LEFT$(A4$,1)
1970 GET#3,(INT((GAME-1)+.05)*4)+VAL(LEV
        EL$)+1:NAM=CVI(FORMAT$):GET#2,NAM
1980 LPRINT SN$;TAB(10);:LPRINT USING E7
$;GAME;:LPRINT TAB(14);LEVEL$;TAB(17);PL
ACE$;TAB(19);:LPRINT USING E7$;CRD;:LPRI
                NT TAB(24);N
AM$
1990 RETURN
```

```
2000 J=ASC (MID$(A4$,2,1)) AND 15: IF J
= 15 THEN V=LCNTR:GOSUB 330:PRINT MID$(A
          4$,8,8);"      "IB$;:GOTO 2040
2010 SN$=MID$(A4$,8,8):GAME=VAL(MID$(A4$
,5,2)):LEVEL$=MID$(A4$,7,1):CRD=VAL(MID$
          (A4$,2,1)):PLACE$=LEFT$(A4$,1)
2020 GET#3,(INT((GAME-1)+.05)*4)+VAL(LEV
      EL$)+1:NAM=CVI(FORMAT$):GET#2,NAM
2030 V=LCNTR:GOSUB 330:PRINT SN$;TAB(18)
;GAME;TAB(28);LEVEL$;TAB(38);PLACE$;TAB(
                    47);CRD;TAB(55);NAM$
2040 LCNTR=LCNTR+1
2050 IF LCNTR<19 THEN RETURN
2060 H=1:V=LCNTR:GOSUB 330:PRINT PR$;"FO
          R MORE WVU DATA";:INPUT"",I$
2070 LCNTR=6
2080 FOR X=LCNTR TO 19:V=X:GOSUB 330:NEX
                                        T
2090 RETURN
2100 REM
2110 ULGISR = 256*PEEK(VARPTR(SR$)+2)+PE
     EK(VARPTR(SR$)+1):CALL ULGISR (A4$)
2120 RETURN
2130 REM
2140 REM UART INPUT ROUTINE
2150 REM
2160 X=0
2170 X = X + 1: IF X = 10 THEN DA = 255:
                                    RETURN
2180 IF INP(USTAT) AND 2 THEN 2190 ELSE
                                      2170
2190 DA = INP(UDAT): RETURN
2200 REM ESTABLISH LINK
2210 OUT USTAT,13: FOR L = 1 TO 40: NEXT
                        : X=0: REM BREAK
2220 IF INP(BSTAT) AND 8 THEN X=X+1 ELSE
                                      2240
2230 IF X<50 THEN 2220 ELSE OUT USTAT,5:
V=19:H=17:GOSUB 330:PRINT"NB BAD CARD ";
B$;PR$;:X$=INPUT$(1):H=1:GOTO 2210:REM W
                              AIT FOR BREA
K
2240 OUT USTAT,5: X=0 : REM END BREAK
2250 IF INP(BSTAT) AND 8 THEN RETURN ELS
                                E X=X+1
2260 IF X<50 THEN 2250 ELSE H=17:V=19:GO
SUB 330:PRINT"NR BAD CARD ";PR$;B$;:H=1:
X$=INPUT$(1):GOTO 2210: REM WAIT END BRE
                                      AK
2270 GOSUB 440:IF E THEN RETURN ELSE PRI
     NT CL$:I$=" "+DL$+OS$+" ":GOSUB 400
2280 I1$=I$
2290 GOSUB 880:IF X$=R1$ THEN RETURN
2300 GOSUB 1300:IF X$=R1$ THEN RETURN
2310 V=12:H=1:GOSUB 330:H=25:GOSUB 330:P
          RINT "WAIT...PRINTING DATA: ";
2320 T2=32:I$=I1$:LPRINT" ":GOSUB 350:LP
                                    RINT " "
2330 OPEN"R",#1,"OSALES."+CHR$(48+X),34:
FIELD#1,2 AS NR$:GET#1,1:NOREC%=CVI(NR$)
2340 FIELD#1,30 AS TYPE$,4 AS TOTAL$
2350 IF NOREC%=0 THEN LPRINT"NO "OS$" ON
                        DISKETT":GOTO 2420
2360 LPRINT TAB(10);"TYPE";TAB(34);"AMOU
                                      NT"
2370 FOR Y=2 TO NOREC%
2380 GET#1,Y
2390 TOTAL=CVS(TOTAL$)
2400 LPRINT TYPE$;:LPRINT USING E4$;TOTA
                                        L
2410 NEXT
2420 CLOSE#1
2430 GOSUB 690:GOSUB 760
2440 RETURN
2450 GOSUB 440:IF E THEN RETURN ELSE PRI
NT CL$:I$=" "+DL$+BI$+"PAYOUTS ":GOSUB 4
                                      00
2460 DTOT=0:STOT=0:I1$=I$:GOSUB 880:IF X
                        $=R1$ THEN RETURN
2470 GOSUB 1300:IF X$=R1$ THEN RETURN
2480 V=12:H=1:GOSUB 330:H=25:GOSUB 330:P
          RINT"WAIT...PRINTING DATA: ";
2490 I$=I1$:T2=32:LPRINT" ":GOSUB 350:LP
                                    RINT " "
2500 OPEN"R",#1,"BPAY."+CHR$(48+X),6:FIE
LD#1,2 AS NR$,4 AS TOTAL$:GET#1,1:NOREC%
          =CVI(NR$):TOTAL=CVS(TOTAL$)
2510 OPEN"R",#2,"BONUSPAY."+CHR$(48+X),6
:FIELD#2,2 AS BNR$,4 AS BTOTAL$:GET#2,1:
   BNOREC%=CVI(BNR$):BTOTAL=CVS(BTOTAL$)
2520 IF NOREC%=0 THEN LPRINT "NO PAYOUTS
                        ON DISK":GOTO 2670
2530 LPRINT" GA  LEV";TAB(17)"ACTUAL";TA
                                B(26);"SCHED"
2540 LPRINT " NO. NO.  PL";TAB(19)"PAY";
        TAB(27);"PAY     DIFF":LPRINT" "
2550 FOR A = 1 TO 16:FOR B=1 TO 4:FOR C=
                                    1 TO 3
2560 REC%=((A-1)*12)+((B-1)*3)+C+1
2570 IF PO(A,B,C)=0 THEN 2620
2580 GET#1,REC%:GET#2,REC%:TOT=CVS(TOTAL
$):BTOT=CVS(BTOTAL$):STOT=STOT+PO(A,B,C)
2590 DIFPAY=PO(A,B,C)-TOT
2600 LPRINT A;SPC(2);B;TAB(11);C;TAB(16)
;:LPRINT USING E5$;TOT;:LPRINT TAB(24);:
LPRINT USING E5$;PO(A,B,C);:LPRINT " ";:L
                                PRINT USING
E5$;DIFPAY:DTOT=DTOT+DIFPAY
2610 IF BTOT>0 THEN LPRINT "BONUS PAID";
          TAB(11);:LPRINT USING E5$;BTOT
2620 NEXT:NEXT:LPRINT" ":NEXT
2630 LPRINT"":LPRINT BI$PO$TL$"=========
          ==>";:LPRINT USING E4$;TOTAL
2640 LPRINT"":LPRINT "SCHEDULED "PO$TL$"
      =======>";:LPRINT USING E4$;STOT
2650 LPRINT"":LPRINT "DIFERENCE=========
    ===========>";:LPRINT USING E4$;DTOT
2660 LPRINT"":LPRINT "BONUSES PAID "TL$"
  ===========>";:LPRINT USING E4$;BTOTAL
2670 CLOSE#1:CLOSE#2
2680 GOSUB 690:GOSUB 760
2690 RETURN
2700 REM FIND S/N AND CUSTOMER NO."
2710 GOSUB 440:IF E THEN RETURN ELSE PRI
NT CL$:I$=" S/N TO "+CUST$:I1$=I$:GOSUB
                                      400
2720 GOSUB 880:IF X$=R1$ THEN RETURN ELS
          E IF X$=C1$ OR PFC THEN 2720
2730 I$=I1$:GOSUB 400:W=1
2750 V=3:H=1:GOSUB 330:PRINT"ENTER SERIA
    L NO. OF "BI$"CARD YOU WANT TO FIND"
2760 V=5:H=1:GOSUB 330:L=8:AL=32:AH=96:X
                        L=13:YL=V:GOSUB 220
2770 IF X$=C1$ OR X$=R1$ OR PFC THEN RET
                                      URN
2780 FSN$=I$
2790 V=12:H=1:GOSUB 330:PRINT"FINDING SE
                              RIAL NO....";
2800 GOSUB 770
2810 FOR Y=2 TO NOREC%
2820 GET#1,Y:SN$=SN1$:CN$=CN1$
2830 IF FSN$=LEFT$(SN$,LEN(FSN$)) THEN F
          CN$(W)=CN$:GOSUB 800:W=W+1
2840 NEXT
2850 CLOSE#1
2860 Y=0:FOR Z=1 TO 20:IF FCN$(Z)<>"" TH
                              EN Y=50:Z=20
2870 NEXT
2880 IF Y<>50 THEN V=12:H=1:GOSUB 330:PR
INT"SERIAL NO.  ";FSN$;" NOT FOUND IN "B
I$"SESSION NO.";X;CHR$(7);:FOR Y= 1 TO 3
                              000:NEXT:RET
URN
2890 PRINT CL$:I$=" SERIAL NO."+FSN$+" "
                                :GOSUB 400
2900 GOSUB 820
2910 H=1:V=3:GOSUB 330:PRINT"SERIAL NO.
                          ";TAB(30);FSN$
2920 FOR Z=1 TO 20:IF FCN$(Z)="" THEN Y=
                              Z-1:Z=20
2930 NEXT
2940 H=1:V=5:GOSUB 330:PRINT CUST$;TAB(3
0);FCN$(1):REM :FOR X= 1 TO Y:FOR Z=1 TO
 3:N=((X-1)*3)+Z:PRINT FCN$(N);" ";:NEXT
                              :PRINT:NEXT
```

```
2950 V=22:H=1:GOSUB 330:PRINT"PRINT THIS
                                PAGE (Y/N) ";
2960 AH=90:AL=59:L=1:YL=V:XL=23:GOSUB 22
0:IF X$=R1$ THEN RETURN ELSE IF PFC OR X
$=C1$ THEN 2950 ELSE IF I$="N" THEN FOR
                                X=1 TO 20:FC
N$(X)="":NEXT:RETURN ELSE IF I$<>"Y" THE
                                        N 2950
2970 LPRINT" ":LPRINT"SERIAL NO. ";TAB(2
                                    5);CUST$
2980 LPRINT FSN$;TAB(36-LEN(FCN$(1)));FC
                                        N$(1)
2990 GOSUB 690:GOSUB 760
3000 RETURN
3010 PRINT CL$:V=12:H=23:GOSUB 330:PRINT
            "WAIT...LOADING MAIN MENU ";
3020 RUN BI$
3030 END
3040 GOSUB 440:IF E THEN RETURN ELSE PRI
NT CL$:I$=" DETAIL LISTING OF OTHER PAYO
                                UTS ":GOSUB 400
3050 TOTAL1=0:I1$=I$:GOSUB 880:IF X$=R1$
                                THEN RETURN
3060 GOSUB 1300:IF X$=R1$ THEN RETURN
3070 V=12:H=1:GOSUB 330:H=25:GOSUB 330:P
            RINT"WAIT...PRINTING DATA: ";
3080 I$=I1$:T2=32:LPRINT" ":GOSUB 350:LP
                                RINT" "
3090 OPEN"R",#1,"O/RPAY."+CHR$(48+X),56:
FIELD#1,2 AS NR$:GET#1,1:NOREC%=CVI(NR$)
3100 FIELD#1,2 AS FLAG$,25 AS TYPE$,25 A
                    S RECPID$,4 AS TOTAL$
3110 IF NOREC%=0 THEN LPRINT "NO OTHER P
                AYOUTS ON DISK":GOTO 3190
3120 LPRINT"DISCRIPTION/RECIPIENT ID";TA
                B(31);"AMOUNT":LPRINT" "
3130 FOR Y=2 TO NOREC%
3140 GET#1,Y
3150 TOTAL=CVS(TOTAL$):FLAG%=CVI(FLAG$):
IF FLAG%= 1 THEN GOTO 3170  ELSE TOTAL1
                =TOTAL1+TOTAL:FLAG%=0
3160 LPRINT TYPE$;TAB(30);:LPRINT USING
      E3$;TOTAL:LPRINT RECPID$:LPRINT" "
3170 NEXT
3180 LPRINT" ":LPRINT TL$"==============
      =======>";:LPRINT USING E4$;TOTAL1
3190 CLOSE#1
3200 GOSUB 690:GOSUB 760
3210 RETURN
3220 GOSUB 440:IF E THEN RETURN ELSE PRI
NT CL$:I$=" DETAIL LISTING OF REFUNDS":G
                                OSUB 400
3230 TOTAL1=0:I1$=I$:GOSUB 880:IF X$=R1$
                                THEN RETURN
3240 GOSUB 1300:IF X$=R1$ THEN RETURN
3250 V=12:H=1:GOSUB 330:H=25:GOSUB 330:P
            RINT"WAIT...PRINTING DATA: ";
3260 I$=I1$:T2=32:LPRINT" ":GOSUB 350:LP
                                RINT" "
3270 OPEN"R",#1,"O/RPAY."+CHR$(48+X),56:
FIELD#1,2 AS NR$:GET#1,1:NOREC%=CVI(NR$)
3280 FIELD#1,2 AS FLAG$,25 AS TYPE$,25 A
                    S RECPID$,4 AS TOTAL$
3290 IF NOREC%=0 THEN LPRINT "NO REFUNDS
                ON DISK":GOTO 3370
3300 LPRINT"DISCRIPTION/RECIPIENT ID";TA
                B(31);"AMOUNT":LPRINT" "
3310 FOR Y=2 TO NOREC%
3320 GET#1,Y
3330 TOTAL=CVS(TOTAL$):FLAG%=CVI(FLAG$):
IF FLAG%= 0 THEN 3350  ELSE TOTAL1=TOTAL
                                1+TOTAL
3340 LPRINT TYPE$;TAB(30);:LPRINT USING
      E3$;TOTAL:LPRINT RECPID$:LPRINT" "
3350 NEXT
3360 LPRINT" ":LPRINT TL$"==============
      =======>";:LPRINT USING E4$;TOTAL1
3370 CLOSE#1
3380 GOSUB 690:GOSUB 760
3390 RETURN
3400 OPEN"R",#1,"CASHIER.DAT",33
3410 FIELD#1,2 AS T1$:GET#1,1:RN%=CVI(T1
$):IF RN%=0 THEN CLOSE#1:GOTO 3680 ELSE
DIM NBS$(RN%-1,2),NC%(RN%-1),NR%(RN%-1),
                        NS%(RN%-1),N
IB%(RN%-1),TOT(RN%-1),NOS%(RN%-1),OSTOT(
RN%-1),TOTPAY(RN%-1),OTHERPAY(X),REFUND(
                        X),TOTBONUS(X)
3420 FIELD#1,25 AS T1$,8 AS T2$
3430 FOR X = 2 TO RN%
3440 GET#1,X:NBS$(X-1,1)=T1$:NBS$(X-1,2)
                                    =T2$
3450 NEXT
3460 CLOSE#1
3470 FOR X = 1 TO RN%-1
3480 OPEN"R",#1,"BSALES."+CHR$(48+X),50:
FIELD#1,2 AS NR$,4 AS TOTAL$,2 AS CN1$,2
 AS R$, 2 AS S$,2 AS IBT$:GET#1,1:NOREC%
                                -=CVI(NR$):TO
T(X)=CVS(TOTAL$):NC%(X)=CVI(CN1$):NR%(X)
=CVI(R$):NS%(X)=CVI(S$):NIB%(X)=CVI(IBT$
                                        )
3490 CLOSE#1
3500 OPEN"R",#1,"OSALES."+CHR$(48+X),34:
FIELD#1,2 AS NR$,4 AS TOTAL$:GET#1,1:NOS
      %(X)=CVI(NR$)-1:OS(X)=CVS(TOTAL$)
3510 IF NOS%(X)<0 THEN NOS%(X)=0
3520 CLOSE#1
3530 OPEN"R",#1,"BPAY."+CHR$(48+X),6:FIE
LD#1,2 AS NR$,4 AS TOTAL$:GET#1,1:TOTPAY
                        (X)=CVS(TOTAL$)
3540 CLOSE#1
3550 OPEN"R",#1,"BONUSPAY."+CHR$(48+X),6
:FIELD#1,2ASNR$,4 AS TOTAL$:GET#1,1:TOTB
                        ONUS(X)=CVS(TOTAL$)
3560 CLOSE#1
3570 OPEN"R",#1,"O/RPAY."+CHR$(48+X),56:
FIELD#1,2ASNR$,25 AS DISC$,25 AS ID$,4 A
                    S AMT$:GET#1,1:NR=CVI(NR$)
3580 FOR Z=2 TO NR:FLAG=0:GET#1,Z:FLAG=C
VI(NR$):AMOUNT=CVS(AMT$):IF FLAG =0 THEN
 OTHERPAY(X)=OTHERPAY(X)+AMOUNT ELSE REF
                        UND(X)=REFUN
D(X)+AMOUNT
3590 NEXT:CLOSE#1
3600 NEXT
3610 RN%=RN%-1
3620 OPEN"I",#1,"PAYOUT":FOR X=1 TO 16:F
OR Y=1 TO 4:FOR Z=1 TO 3:INPUT #1,PO(X,Y
                    ,Z):NEXT:NEXT:NEXT:CLOSE#1
3640 REM ON ERROR GOTO *** TBD ***
3650 OPEN"I",#1,"PRICE.DAT"
3660 INPUT#1,VC$,BN$,BS$,PW$,KPW$,MP,UR,
      US,UB,DB%,DB,DP,IBW%,BM$,IBF%,IBP
3670 CLOSE#1
3680 PRINT CL$:I$=" ACCOUNTING MENU ":GO
                                SUB 400
3690 V=3:H=1:GOSUB 330:PRINT"1. SUMMARY
                OF ALL SALES AND PAYOUTS"
3700 PRINT"2. "DL$BI$"SALES"
3710 PRINT"3. "DL$OS$
3720 PRINT"4. "DL$BI$PO$
3730 PRINT"5. "DL$"OTHER "PO$
3740 PRINT"6. "DL$"REFUNDS"
3750 PRINT"7. FIND S/N AND "CUST$
3760 PRINT"8. READ VALIDATION UNIT."
3770 PRINT"9. MAIN MENU"
3780 H=1:V=13:GOSUB 330:PRINT"SELECT ONE
: ";:L=1:AL=49:AH=57:XL=13:YL=V:GOSUB 22
                                        0
3790 IF X$=C1$ OR X$=R1$ THEN 3780 ELSE
                        IF PFC THEN 3780
3800 ON VAL(I$) GOSUB 850,1330,2270,2450
                ,3040,3220,2710,1630,3010
3810 GOTO 3680
```

What is claimed is:

1. An automatic gaming system for a chance based game, said system having a load mode and a play mode and comprising:

a plurality of electronc gaming boards, each having respective memory means and each being adapted to be used in the load mode to receive and store in said respective memory means a serial gaming schedule comprising a plurality of win patterns which describe a scheduled sequence of successive independent games each having at least one predetermined win pattern and including means operable in the play mode for recalling said stored gaming schedule from said memory means and executing it to play the respective individual games in the scheduled sequence; and system means, including a programmed processor, operable during the load mode for downloading to each of said plurality of electronic gaming boards said gaming schedule.

2. An automatic gaming system as set forth in claim 1 wherein:

each of said plurality of electronic gaming boards includes means for shifting from said first mode to said second mode after a predetermined time interval has elapsed.

3. An automatic gaming system as set forth in claim 2 wherein:

said predetermined time interval is variable.

4. An automatic gaming system as set forth in claim 3 wherein:

said system means further includes means for downloading each of said plurality of electronic gaming boards with a different time interval dependent upon the difference between the real time when each gaming board is downloaded with said gaming schedule and a reference time which corresponds to a real future time.

5. An automatic gaming system for a chance based game comprising:

a plurality of electronic gaming boards on which to play said chance based game, each including a communications means having a serial data transmit line and a serial data receive line;

a system means including a programmed processor and communications means having a serial data transmit line and a serial data receive line;

said system transmit line connectable to said gaming board receive line and said system receive line connectable to said gaming board transmit line when data is to be transferred between said system means and one of said gaming boards;

said system means and gaming boards operating under a communications protocol where said system means initiates a communications attempt to one of said gaming boards by changing the state of the signal on its transmit line within a specified period of time, said system means acknowledges said reply by changing the state of the signal on its transmit line, and said one gaming board indicates a ready condition by changing the state of the signal on its transmit line.

6. An automatic gaming system for a chance based game as set forth in claim 5 wherein:

said system means in response to said ready condition transmits on its transmit line a command which is decodable by said gaming board.

7. An automatic gaming system for a chance based game as set forth in claim 6 wherein:

said system means transmits commands including a download command.

8. An automatic gaming system for a chance based game as set forth in claim 7 wherein:

said system means transmits a serial data block consisting of a plurality of data bytes after transmitting said download command.

9. An automatic gaming system for a chance based game as set forth in claim 8 wherein:

said system means transmits different data blocks depending on the value of said download command.

10. An automatic gaming system for a chance based game as set forth in claim 9 wherein:

said gaming board replys to said downloaded data block by transmitting a checksum to said system means which was calculated from said data bytes.

11. An automatic gaming system for a chance based game as set forth in claim 10 wherein:

said system means transmits commands including an upload command.

12. An automatic gaming system for a chance based game as set forth in claim 11 wherein:

said gaming board transmits a serial data block consisting of a plurality of data bytes after said upload command.

13. An automatic gaming system for a chance based game as set forth in claim 12 wherein:

said gaming board transmits different data blocks depending on the value of said upload command.

14. An automatic gaming system for a chance based game as set forth in claim 13 wherein:

said gaming board follows said uploaded data block by transmitting a checksum to said system means which was calculated from said data bytes.

15. An automatic gaming system for a chance based game as set forth in claim 5 further including:

a plurality of validation units with which to validate win claims of said electronic gaming cards, each validation unit including a communications means having a serial data transmit line and a serial data receive line;

said system transmit line connector to said validation unit receive line and said system receive line connectable to said validation unit transmit line when data is to be transferred between said system means and one of said validation units; and said system means and validation unit operating under a communications protocol where said system means initiates a communications attempt to one of said validation units by changing the state of the signal on its transmit line, said validation unit replies by changing the state of the signal on its transmit line within a specified period of time, said system means acknowledges said reply by changing the state of the signal on its transmit line, and said validation unit indicates a ready condition by changing the state of the signal on its transmit line.

16. An automatic gaming system for a chance based game as set forth in claim 15 wherein:

said system means in response to said ready condition transmits on its transmit line a command which is decodable by said validation unit.

17. An automatic gaming system for a chance based game as set forth in claim 16 wherein:

said system means transmits commands including a download command.

18. An automatic gaming system for a chance based game as set forth in claim 17 wherein:

said system means transmits a serial data block consisting of a plurality of data bytes after transmitting said download command.

19. An automatic gaming system for a chance based game as set forth in claim 18 wherein:

said system means transmits different data blocks depending on the value of said download command.

20. An automatic gaming system for a chance based game as set forth in claim 19 wherein:

said validation unit replys to said downloaded data block by transmitting a checksum to said system means which was calculated from said data bytes.

21. An automatic gaming system for a chance based game as set forth in claim 20 wherein:

said system means transmits commands including an upload command.

22. An automatic gaming system for a chance based game as set forth in claim 21 wherein:

said validation unit transmits a serial data block consisting of a plurality of data bytes after said upload command.

23. An automatic gaming system for a chance based game as set forth in claim 22 wherein:

said validaton unit transmits different data blocks depending on the value of said upload command.

24. An automatic gaming system for a chance based game as set forth in claim 23 wherein:

said validation unit follows said uploaded data block by transmitting a checksum to said system means which was calculated from said data bytes.

25. An automatic gaming system for a chance based game as set forth in claim 15 wherein:

said validation unit transmit line connectable to said gaming board receive line and said validation unit receive line connectable to said gaming board transmit line, when data is to be transferred between said validation unit and said gaming board; and said validation unit and said gaming board operating under a communications protocol where said validation unit signals a communications attempt to one of said gaming boards by changing the state of the signal on its transmit line, said one gaming board replys by changing the state of the signal on its transmit line within a specified period of time, said validation unit acknowledges said replay by changing the state of the signal on its transmit line, and said one gaming board indicates a ready condition by changing the state of the signal on its transmit line.

26. An automatic gaming system for a chance based game as set forth in claim 25 wherein:

said validation unit in response to said ready condition transmits on its transmit line a command which is decodable by said gaming board.

27. An automatic gaming system for a chance based game as set forth in claim 26 wherein:

said validation unit transmits commands including a download command.

28. An automatic gaming system for a chance based game as set forth in claim 27 wherein:

said validation unit transmits a serial data block consisting of a plurality of data bytes after transmitting said download command.

29. An automatic gaming system for a chance based game as set forth in claim 28 wherein:

said validation unit transmits different data blocks depending on the value of said download command.

30. An automatic gaming system for a chance based game as set forth in claim 29 wherein:

said gaming board replys to said downloaded data block by transmitting a checksum to said validation unit which was calculated from said data bytes.

31. An automatic gaming system for a chance based game as set forth in claim 30 wherein:

said validation unit transmits commands including an upload command.

32. An automatic gaming system for a chance based game as set forth in claim 31 wherein:

said gaming board transmits a serial data block consisting of a plurality of data bytes in response to said upload command.

33. An automatic gaming system for a chance based game as set forth in claim 32 wherein:

said gaming board transmits different data blocks depending on the value of said upload command.

34. An automatic gaming system for a chance based game as set forth in claim 33 wherein:

said gaming board follows said uploaded data block by transmitting a checksum to said validation unit which was calculated from said data bytes.

35. An automatic gaming system for a chance based game, said system having a load mode and a play mode and comprising:

a plurality of electronic gaming boards, each having respective memory means and each being adapted to be used in the load mode to receive and store in the respective memory means a validation code and a serial gaming schedule comprising a plurality of win patterns which describe a scheduled sequence of successive independent games each having at least one predetermined win pattern and including means operable in the play mode for recalling said stored gaming schedule from said memory means and executing it to play the respective individual games in the scheduled sequence;

a plurality of validation units for validating win claims for said electronic gaming boards, each of said validation units including means for comparing a validation code stored in said validation units to a validation code stored in said electronic gaming boards; and system means, including a programmed processor, operable during the load mode for downloading to each of said plurality of electronic gaming boards said gaming schedule and for downloading to each of said plurality of electronic gaming boards said validation code, and for downloading to each of said validation units said validation code.

* * * * *

UNITED STATES PATENT AND TRADEMARK OFFICE

CERTIFICATE OF CORRECTION

PATENT NO. : 4,848,771

DATED : July 18, 1989

INVENTOR(S) : John Richardson

It is certified that error appears in the above-identified patent and that said Letters Patent is hereby corrected as shown below:

Column 1, line 22, "90" should not be boldface ;
line 38, change "and" to --any--.
Column 3, line 53, change " 'Portable" to --"Portable--;
line 54, change "System,'" to --System,"--.
Column 6, line 21, change "communication" to --communications--.
Column 7, line 63, "256" should not be boldface .
Column 8, line 22, "79" should not be boldface .
Column 10, line 32, change "gaming" to --game--;
line 33, delete "gaming";
line 39, delete comma (third occurrence).
Column 11, line 53, change "protrocol" to --protocol--.
Column 12, line 37, delete comma.
Column 13, line 37, change "settng" to --setting--;
line 42, change "data" to --date--.
Column 14, line 28, change "illustrated" to --illustrates--.
Column 15, line 58, change "routin" to --routine--.

UNITED STATES PATENT AND TRADEMARK OFFICE

CERTIFICATE OF CORRECTION

PATENT NO. : 4,848,771

DATED : July 18, 1989

INVENTOR(S) : John Richardson

It is certified that error appears in the above-identified patent and that said Letters Patent is hereby corrected as shown below:

Column 16, line 19, change "refuns" to --refunds--;
line 21, change "dyanamics" to --dynamics--.

Column 65, line 43, change "replay" to --reply--.

UNITED STATES PATENT AND TRADEMARK OFFICE

CERTIFICATE OF CORRECTION

PATENT NO. : 4,848,771

DATED : July 18, 1989

INVENTOR(S) : John Richardson

It is certified that error appears in the above-identified patent and that said Letters Patent is hereby corrected as shown below:

Column 1, line 55, change "dauber" to --dabber--.
Column 3, line 36, change "level" to --levels--.
Column 6, line 53, change "with" to --With--.
Column 12, line 11, change "brings" to --bring--.
Column 64, line 10, change "replys" to --replies--.
Column 65, line 6, change "replys" to --replies--;
line 41, change "replys" to --replies--.
Column 66, line 10, change "replys" to --replies--.

Signed and Sealed this

Eighteenth Day of August, 1992

*Attest:*

DOUGLAS B. COMER

*Attesting Officer* *Acting Commissioner of Patents and Trademarks*